US010773407B2

(12) United States Patent
Washington et al.

(10) Patent No.: US 10,773,407 B2
(45) Date of Patent: Sep. 15, 2020

(54) SHAVING RAZOR CARTRIDGE

(71) Applicant: The Gillette Company LLC, Boston, MA (US)

(72) Inventors: Jack Anthony Washington, Mendon, MA (US); Matthew Michael Long, Methuen, MA (US); Zachary Oliver Veugen, Fall River, MA (US); Ashok Bakul Patel, Needham, MA (US); Michael Hal Bruno, Burlington, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/367,376

(22) Filed: Mar. 28, 2019

(65) Prior Publication Data

US 2019/0299462 A1 Oct. 3, 2019

Related U.S. Application Data

(60) Provisional application No. 62/650,663, filed on Mar. 30, 2018.

(51) Int. Cl.
*B26B 21/40* (2006.01)
*B26B 21/52* (2006.01)
(Continued)

(52) U.S. Cl.
CPC ..... *B26B 21/521* (2013.01); *B26B 21/227* (2013.01); *B26B 21/4043* (2013.01);
(Continued)

(58) Field of Classification Search
CPC ..... B26B 21/227; B26B 21/4018; B26B 21/4025; B26B 21/4031; B26B 21/4043;
(Continued)

(56) References Cited

U.S. PATENT DOCUMENTS 8,033,023 B2 * 10/2011 Johnson ..... B26B 21/225 30/50
8,978,258 B2 * 3/2015 Patel ..... B26B 21/4093 30/527
(Continued)

FOREIGN PATENT DOCUMENTS

GB 2030909 A 4/1980

OTHER PUBLICATIONS

PCT Search Report PCT/US2049/024450 dated Jul. 8, 2019, 13 pages.

*Primary Examiner* — Hwei-Siu C Payer
(74) *Attorney, Agent, or Firm* — John M. Lipchitz

(57) ABSTRACT

A shaving razor cartridge includes a housing and at least one razor blade. The housing extends between a front and rear end and defines an overall width. The housing includes a blade support portion and a housing portion. The blade support portion is positioned between the front and rear ends and includes a cap and a guard spaced from the cap. The handle interface portion is positioned between the front and rear ends and includes a front and rear wall. The front wall includes lower and interior surfaces. The rear wall includes a lower surface, a central portion, a first distal portion, and a second distal portion. The central, first distal and second portions each include respective interior surfaces. The at least one razor blade is disposed in the blade support portion. Each of the first distal portion and the second distal portion extends from the central portion.

20 Claims, 39 Drawing Sheets

(51) Int. Cl.
*B26B 21/44* (2006.01)
*B26B 21/22* (2006.01)
*B26B 21/48* (2006.01)

(52) U.S. Cl.
CPC ..... *B26B 21/4068* (2013.01); *B26B 21/443* (2013.01); *B26B 21/446* (2013.01); *B26B 21/48* (2013.01); *B26B 21/225* (2013.01); *B26B 21/4018* (2013.01); *B26B 21/4025* (2013.01); *B26B 21/4031* (2013.01); *B26B 21/522* (2013.01); *B26B 21/528* (2013.01)

(58) Field of Classification Search
CPC . B26B 21/4068; B26B 21/443; B26B 21/446; B26B 21/48; B26B 21/521; B26B 21/522; B26B 21/528
See application file for complete search history.

(56) References Cited

U.S. PATENT DOCUMENTS 9,475,202 B2 * 10/2016 Griffin ..... B26B 21/225
9,993,931 B1 * 6/2018 Zucker ..... B26B 21/521
10,137,584 B2 * 11/2018 Lee ..... B26B 21/14
2003/0074798 A1 4/2003 Follo
2003/0079348 A1 * 5/2003 Follo ..... B26B 21/225 30/50
2003/0204954 A1 * 11/2003 Wain ..... B26B 21/227 30/49
2011/0088269 A1 * 4/2011 Walker, Jr. ..... B26B 21/225 30/527
2012/0096718 A1 4/2012 Howell
2012/0124840 A1 5/2012 Iaccarino
2012/0151775 A1 * 6/2012 Ren ..... B26B 21/227 30/50
2013/0081276 A1 4/2013 Wain
2019/0299447 A1 * 10/2019 Johnson ..... B26B 21/4043
2019/0299450 A1 * 10/2019 Johnson ..... B26B 21/446
2019/0299451 A1 * 10/2019 Long ..... B26B 21/521
2019/0299452 A1 * 10/2019 Johnson ..... B26B 21/48
2019/0299461 A1 * 10/2019 Johnson ..... B26B 21/446
2019/0299462 A1 * 10/2019 Washington ..... B26B 21/446
2019/0299464 A1 * 10/2019 Washington ..... B26B 21/446
2019/0299472 A1 * 10/2019 Johnson ..... B26B 21/4043

* cited by examiner

SHAVING RAZOR CARTRIDGE

REFERENCE TO RELATED APPLICATION

This application claims priority of U.S. provisional patent application Ser. No. 62/650,663, entitled Shaving Razor Cartridge, filed Mar. 30, 2018, and hereby incorporates this provisional patent application by reference herein in its entirety.

TECHNICAL FIELD

The systems described below generally relate to shaving and include a handle and a razor cartridge.

BACKGROUND

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge can be mounted detachably on the handle to enable the cartridge to be replaced by a fresh cartridge when the blade sharpness has diminished to an unsatisfactory level, or it can be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard can aid in establishing the so-called "shaving geometry,", i.e., the parameters which determine the blade orientation and position relative to the skin during shaving, which in turn have a strong influence on the shaving performance and efficacy of the razor. The cap can comprise a water leachable shaving aid to reduce drag and improve comfort. The guard can be generally rigid, for example formed integrally with a frame or platform structure which provides a support for the blades. Guards can also comprise softer elastomeric materials to improve skin stretching.

Shaving systems often consist of a handle and a replaceable cartridge in which one or more blades are mounted in a plastic housing. After the blades in a cartridge have become dull from use, the cartridge is discarded, and replaced on the handle with a new cartridge. These types of shaving systems that utilize a variety of connection schemes to affix the cartridge to the handle have become popular. The connection scheme allows the consumer to easily, repeatedly, efficiently and intuitively load and remove the new and used cartridges from the handle and provides the necessary retention forces to maintain the integrity of the handle-to-cartridge attachment during shaving.

The connection scheme must be robust enough to provide the necessary retention forces to maintain the integrity of the handle-to-cartridge attachment during shaving. The attachment of a razor cartridge to razor handle can provide sufficient retaining force to secure the razor cartridge to the razor handle over a wide variety of shaving conditions. Some shavers use very high forces when shaving and some razors have a hair trimming system mounted on the side or back of the razor cartridge. In contrast, razors that use razor cartridges that are releasably connected can provide low attachment and release forces to facilitate easy changing of cartridges by a shaver.

The razor cartridge of many razors can also be in pivotal relationship with the razor handle. Most existing razors typically provide the mechanism that enables this pivot relationship on the razor cartridge or at the interface of the razor cartridge and razor handle. These pivot mechanisms can be expensive to manufacture and can represent a significant fraction of the total manufactured cost of a razor cartridge. Accordingly, there is a need for a simpler, less expensive, more intuitive and reliable shaving handle-to-cartridge connection.

SUMMARY

In accordance with one embodiment, a shaving razor cartridge comprises a housing and at least one razor blade. The housing extends between a front end and a rear end and defines an overall width. The housing comprises a blade support portion and a housing portion. The blade support portion is positioned between the front end and the rear end and comprises a cap and a guard spaced from the cap and cooperating with the cap to define a shaving plane. The handle interface portion is positioned between the front end and the rear end and comprises a front wall and a rear wall. The front wall comprises a lower surface and an interior surface. The rear wall comprises a lower surface, a central portion, a first distal portion, and a second distal portion. The at least one razor blade is disposed in the blade support portion between the cap and the guard. The at least one razor blade extends laterally between opposing sides of the blade support portion. Each of the first distal portion and the second distal portion extends from the central portion. The central portion, the first distal portion, and the second distal portion comprise respective interior surfaces. The lower surfaces cooperate to define a lower opening. The front wall and the rear wall are spaced from each other such that the interior surfaces cooperate to at least partially define a handle receptacle that extends to the lower opening. The interior surface of the central portion is spaced horizontally from the front wall by a first distance. The interior surface of the first distal portion is spaced horizontally from the front wall by a second distance. The first distance is less than the second distance.

In accordance with another embodiment, a shaving razor cartridge comprises a housing and at least one razor blade. The housing extends between a front end and a rear end and defines an overall width. The housing comprises a blade support portion and a housing portion. The blade support portion is positioned between the front end and the rear end and comprises a cap and a guard spaced from the cap and cooperating with the cap to define a shaving plane. The handle interface portion is positioned between the front end and the rear end and comprises a front wall and a rear wall. The front wall comprises a lower surface and an interior surface. The rear wall comprises a lower surface, a central portion, a first distal portion, and a second distal portion. The at least one razor blade is disposed in the blade support portion between the cap and the guard. Each of the first distal portion and the second distal portion extends from the central portion. The central portion and each of the first distal portion and the second distal portion comprise respective interior surfaces. The lower surfaces cooperate to define a lower opening. The front wall and the rear wall are spaced from each other such that the interior surfaces cooperate to at least partially define a handle receptacle that extends to the lower opening. The central portion of the rear wall comprises a first thickness. The first distal portion of the rear wall comprises a second thickness. The first thickness is greater than the second thickness.

In accordance with another embodiment, a shaving razor cartridge comprises a housing and at least one razor blade. The housing extends between a front end and a rear end and defines an overall width. The housing comprises a blade support portion and a housing portion. The blade support portion is positioned between the front end and the rear end and comprises a cap and a guard spaced from the cap and cooperating with the cap to define a shaving plane. The handle interface portion is positioned between the front end and the rear end and comprises a front wall and a rear wall. The front wall comprises a lower surface and an interior surface. The rear wall comprises a lower surface, a central portion, a first distal portion, and a second distal portion. The central portion, the first distal portion and the second distal portion each comprise respective interior surfaces. The at least one razor blade is disposed in the blade support portion between the cap and the guard. Each of the first distal portion and the second distal portion extends from the central portion. Each of the first distal portion and the second distal portion defines a notch that is configured to receive a portion of a handle.

BRIEF DESCRIPTION OF THE DRAWINGS

It is believed that certain embodiments will be better understood from the following description taken in conjunction with the accompanying drawings in which.

DETAILED DESCRIPTION

Figure 1:
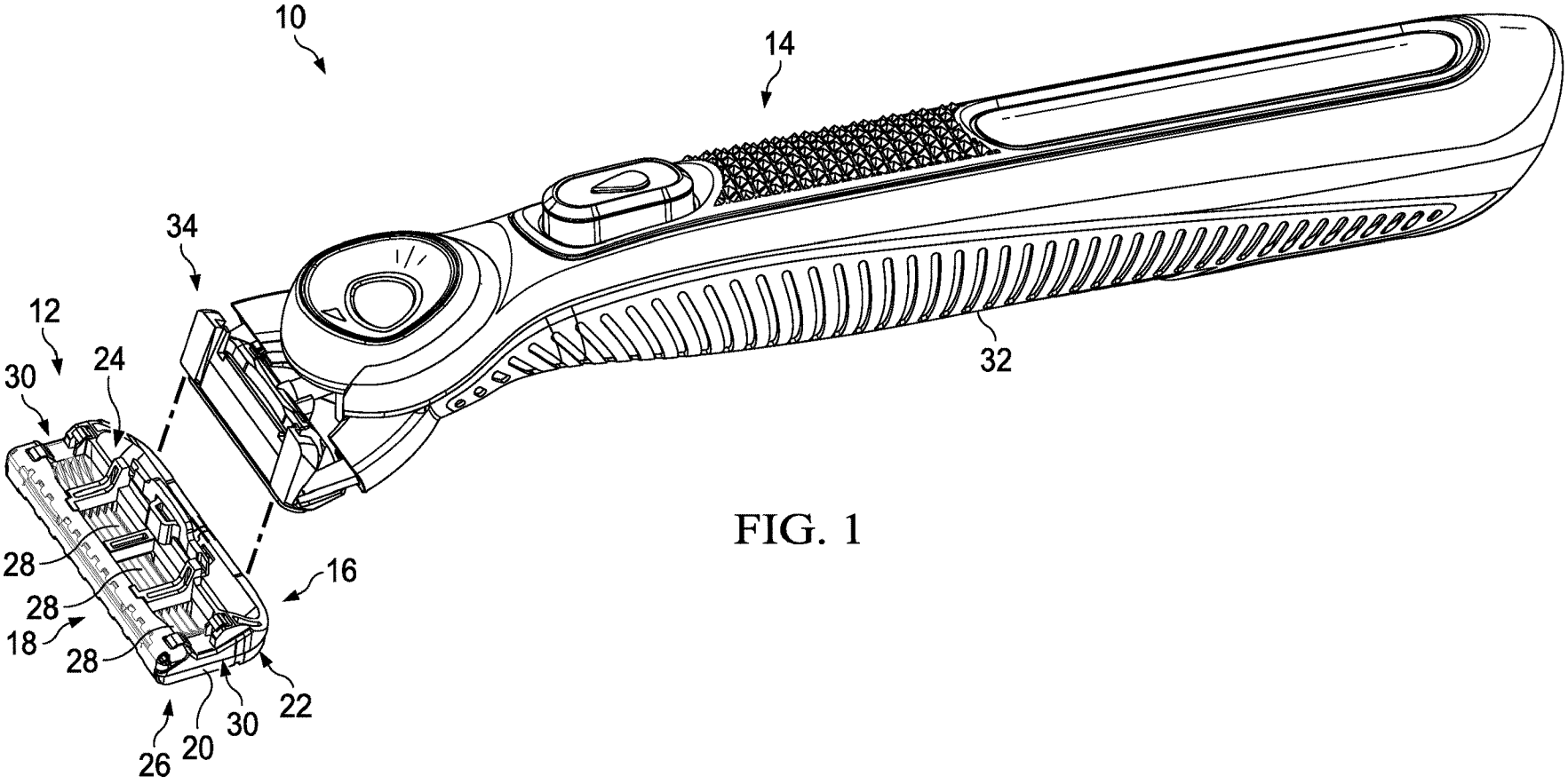
FIG. 1 is a partially exploded isometric view depicting a shaving system having a handle and a cartridge, in accordance with one embodiment.

In connection with the views and examples of FIGS. 1-39, wherein like numbers indicate the same or corresponding elements throughout the views, a shaving system 10 is shown in FIG. 1 to include a cartridge 12 and a handle 14 that can cooperate to facilitate shaving of a user's skin. The cartridge 12 can extend between a front end 16 and a rear end 18 and can include a housing 20. The housing 20 can include a handle interface portion 22 that is disposed at the front end 16 and defines a handle receptacle 24 that facilitates attachment of the handle 14 to the cartridge 12. The housing 20 can also include a blade support portion 26 that is disposed at the rear end 18. In one embodiment, the housing 20 can be formed of a thermoplastic material such as polyphenylene oxide. It is to be appreciated, however, that the housing 20 can be formed of any of a variety of suitable additional or alternative materials.

A plurality of razor blades 28 can be disposed in the blade support portion 26 and can extend laterally between opposing sides 30 of the blade support portion 26. In one embodiment, the razor blades 28 can be formed of stainless steel but can additionally or alternatively be formed of any of a variety of suitable materials (e.g., metals or non-metals). It is to be appreciated that although the razor blades 28 are shown to be straight razors, any of a variety of suitable alternative razor blades can be used, such as an array of rounded blades. The cartridge 12 can also have any number of blades depending on the desired performance and cost of the cartridge 12. The cartridge 12 can have, for example, one razor blade, two razor blades, three razor blades, four razor blades, five razor blades, six razor blades, seven razor blades, or even more razor blades.

The handle 14 can include a main body 32 and a pivoting head 34 pivotally coupled with the main body 32. The pivoting head 34 can be selectively inserted into the handle receptacle 24 to facilitate coupling of the cartridge 12 and the handle 14 together. When the cartridge 12 and the handle 14 are coupled together, a user can grasp the main body 32 of the handle 14 to facilitate shaving of the user's skin with the cartridge 12. The cartridge 12 can be a disposable-type cartridge that can be selectively removed from the handle 14 for replacement. Once the razor blades 28 have become dulled (or damaged) the consumer can disengage the cartridge 12 from the pivoting head 34 and replace the cartridge 12 with a new cartridge.

The main body 32 can be provided with any of a variety of suitable gripping features, such as a patterned elastomeric coating, that provides for effective gripping of the main body 32 with the user's hand. It is to be appreciated that the handle 14 can be of any suitable shape. The handle 14, for example, can be an elongated barrel shape or can be a contoured shape. The handle 14 can be made from any suitable material. The handle 14 can be made, for example, from a metal, a polymer, an elastomer, a plastic, a thermoplastic, a rubber, any other suitable material, or any combination thereof. The handle 14 can be made by any suitable process. The handle 14 can be made, for example, by molding, injection molding, insert injection molding, casting, die-casting, extruding, any other suitable method, or any combination thereof. The handle 14 described herein can additionally or alternatively include one or more features of the various embodiments of handles disclosed in co-owned, co-pending U.S. applications which are being filed concurrently herewith and which are hereby incorporated herein by reference.

Figure 2:
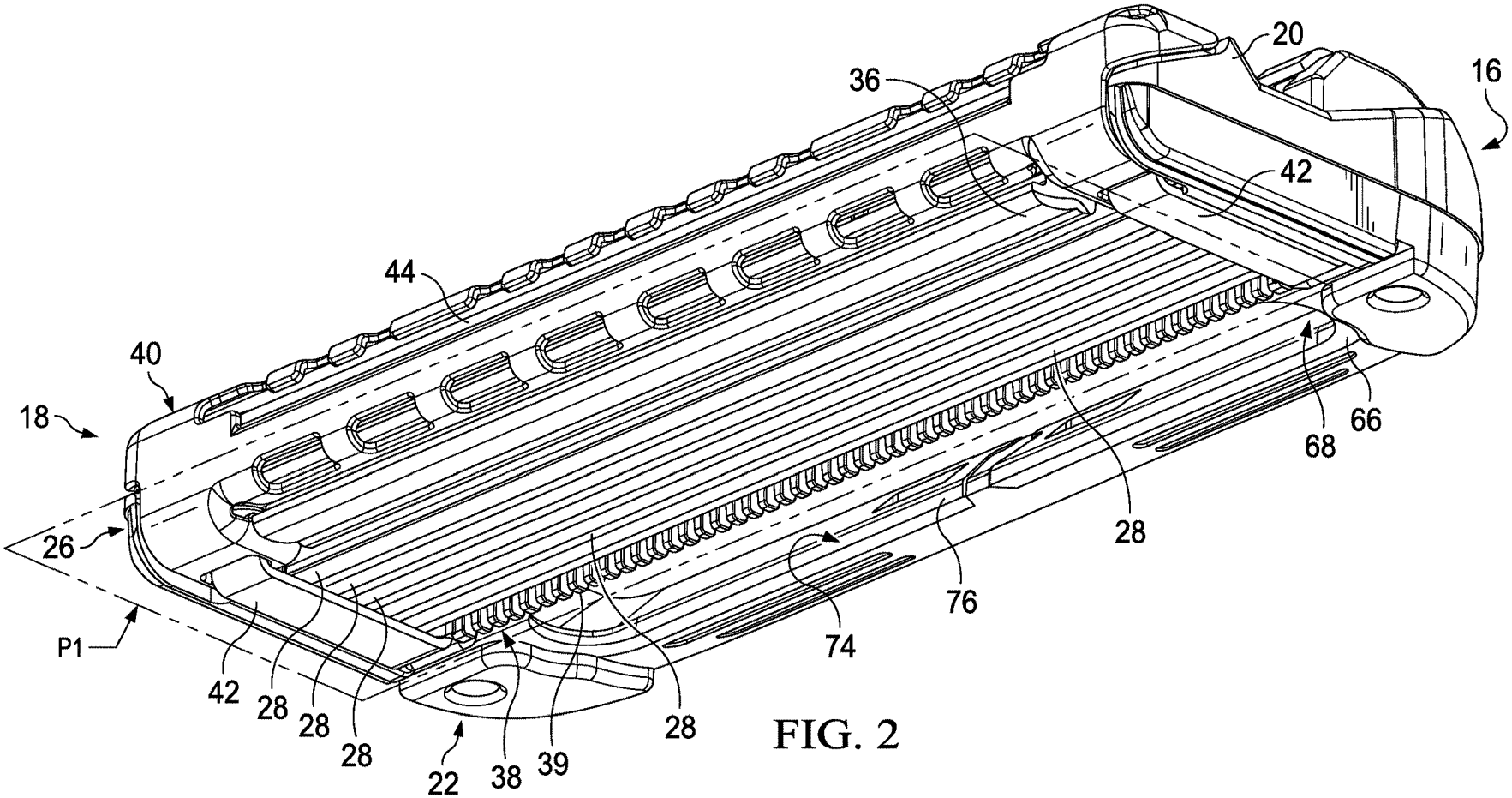
FIG. 2 is an upper rear isometric view depicting the cartridge of FIG. 1.

Referring now to FIG. 2, the blade support portion 26 can comprise a cap 36 and a guard 38. The cap 36 can be positioned behind the razor blades 28 (e.g., at the rear end 18) and the guard 38 can be positioned in front of the razor blades 28 (e.g., between the razor blades 28 and the handle interface portion 22) such that the razor blades 28 are disposed between the cap 36 and the guard 38. The cap 36 and the guard 38 can cooperate to define a shaving plane P1 that is tangent to the cap 36 and the guard 38. During shaving, a user's skin can be positioned against the cap 36 and guard 38 such that the user's skin extends along or into the shaving plane P1 for engagement by the razor blades 28 to facilitate shaving of the user's skin.

The cap 36 can be a separate molded or extruded component that is mounted to the housing 20. The cap 36 can be, for example, a shaving aid filled reservoir, an extruded lubrication strip, and/or a plastic or metal bar to support the skin and further define the shaving plane P1. The cap 36 can be molded or extruded from the same material as the housing 20 or can be molded or extruded from a more lubricious shaving aid composite that has one or more water-leachable shaving aid materials to provide increased comfort during a shave stroke.

The guard 38 can extend generally parallel to the razor blades 28 and can comprise a skin-engaging member 39 for stretching the skin during a shaving stroke. The skin-engaging member 39 is shown to be a segmented bar (e.g., that defines a plurality of fins) but can alternatively be a solid (e.g., smooth) bar. The skin-engaging member 39 can be, for example, insert injection molded or co-injection molded to the housing. Other known assembly methods can also be used such as adhering, bonding, attaching, ultrasonic welding, or mechanical fastening. The skin-engaging member 39 can be formed of a softer material (i.e., lower durometer hardness) than the housing 20. For example, the skin-engaging member 39 can be formed of a material having a Shore A hardness of between about 20-70. The skin-engaging member 39 can be formed of thermoplastic elastomers (TPEs) or rubbers, some examples of which can include, but are not limited to, silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, the skin-engaging member 39 can comprise Kraiburg HTC 1028/96, HTC 8802/37, HTC 8802/34, or HTC 8802/11 (KRAIBURG TPE GmbH & Co. KG of Waldkraiburg, Germany). A softer material for the skin-engaging member 39 can enhance skin stretching, as well as provide a more pleasant tactile feel against the skin of the user during a shaving stroke. A softer material can also aid in masking the less pleasant feel of the harder material of the housing 20 and/or the razor blades 28 against the skin of the user during a shaving stroke.

A trimmer assembly 40 can be provided on the rear end 18 of the cartridge 12 and held in place by a pair of clips 42. The trimmer assembly 40 can include a blade 44 that extends away from the shaving plane P1 and can be used for precise trimming of a user's hair (e.g., sideburns). The clips 42 can additionally facilitate retention of the razor blades 28 to the housing 20. Other assembly methods known to those skilled in the art can additionally or alternatively be used to secure and/or mount a trimmer assembly (e.g., 40) and/or razor blades (e.g., 28) to the housing 20 including, but not limited to, wire wrapping, cold forming, hot staking, insert molding, ultrasonic welding, and adhering. The clips 42 can be formed of a metal, such as aluminum, for example, which can facilitate conduction of heat and/or can serve as a sacrificial anode to help prevent corrosion of the razor blades 28.

Figure 3:
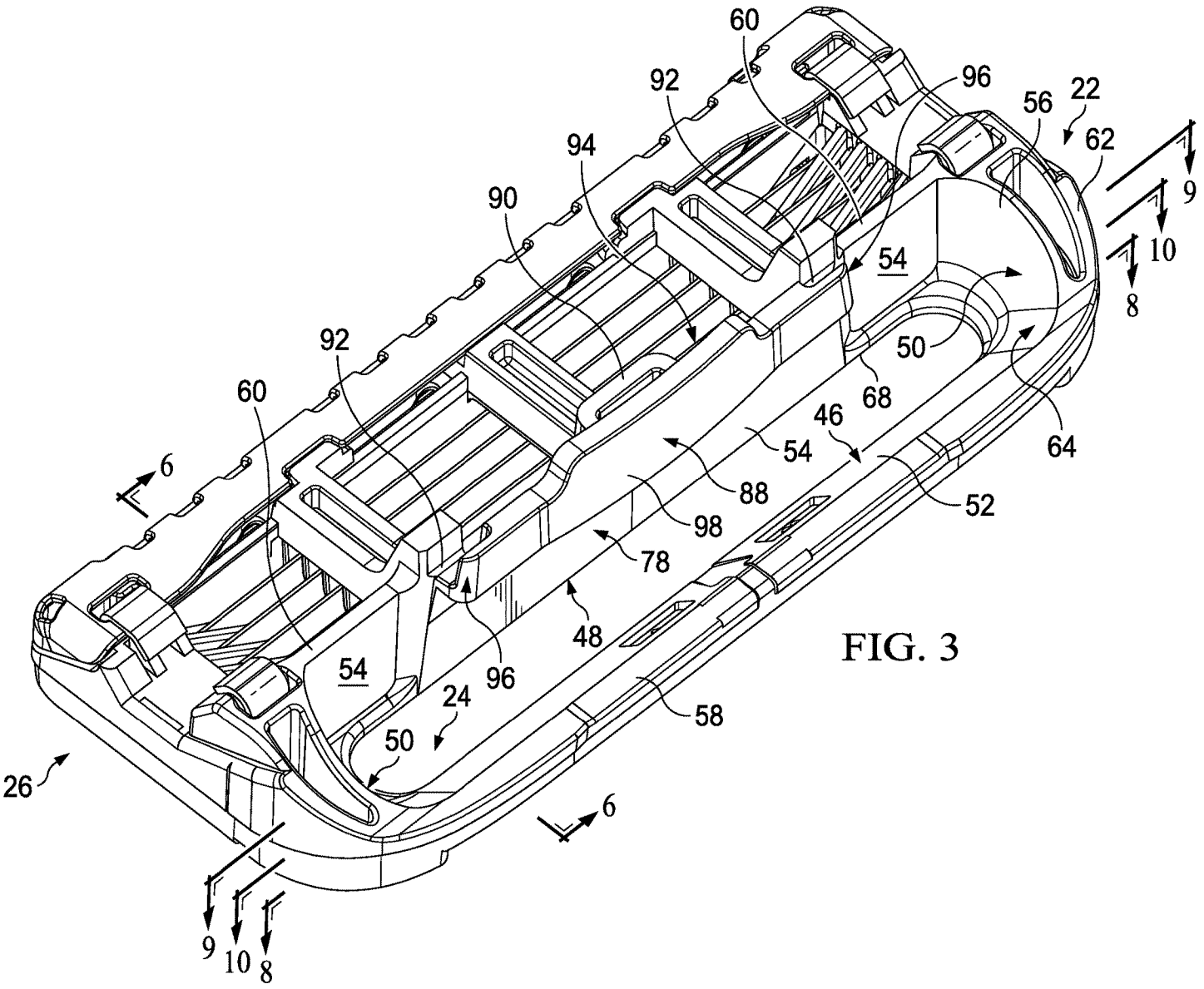
FIG. 3 is a lower front isometric view depicting the cartridge of FIG. 1.
Figure 4:
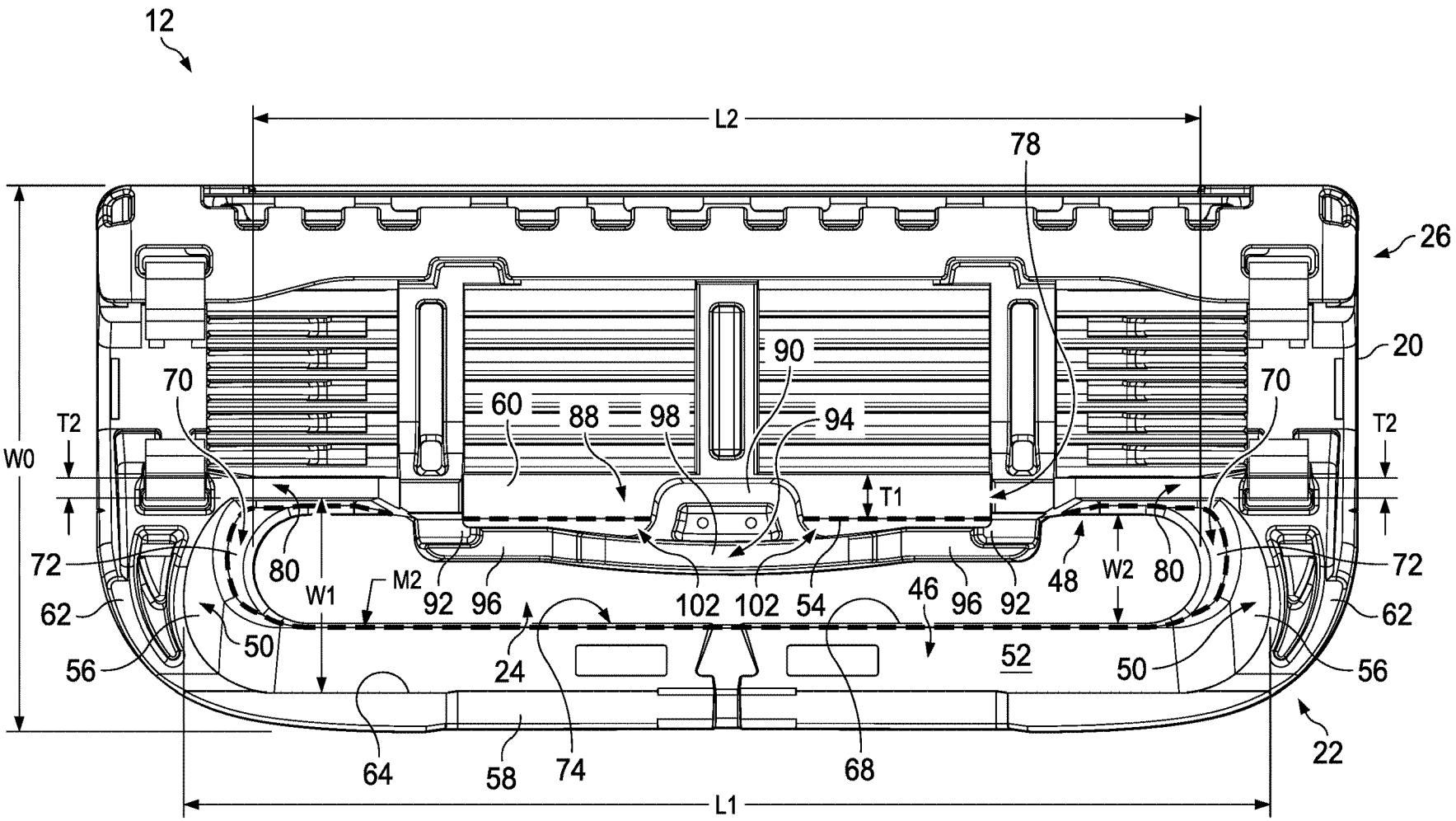
FIG. 4 is a lower plan view depicting the cartridge of FIG. 1.

Referring now to FIGS. 3 and 4, the handle interface portion 22 can include a front wall 46, a rear wall 48, and a pair of sidewalls 50. The rear wall 48 can be more proximate to the blade support portion 26 than the front wall 46. In one embodiment, the rear wall 48 can be interposed between the handle interface portion 22 and the blade support portion 26 such that the rear wall 48 defines a portion of the blade support portion 26 (e.g., the handle interface portion 22 and the blade support portion 26 are immediately adjacent one another).

The front wall 46 can include a front interior surface 52, the rear wall 48 can include a rear interior surface 54, and each of the sidewalls 50 can include a respective side interior surface 56 (FIG. 4). The front wall 46 can be spaced from the rear wall 48, and the sidewalls 50 can extend between the front wall 46 and the rear wall 48 and can be spaced from each other such that the front interior surface 52, the rear interior surface 54, and the side interior surfaces 56 cooperate to define a portion of the handle receptacle 24.

Each of the front wall 46, the rear wall 48, and the sidewalls 50 can include respective lower surfaces 58, 60, 62. The lower surfaces 58, 60, 62 can cooperate to define a lower opening 64. The handle receptacle 24 can extend to the lower opening 64 and the lower opening 64 can be configured to allow for insertion of the pivoting head 34 of the handle 14 into the handle receptacle 24.

Figure 5:
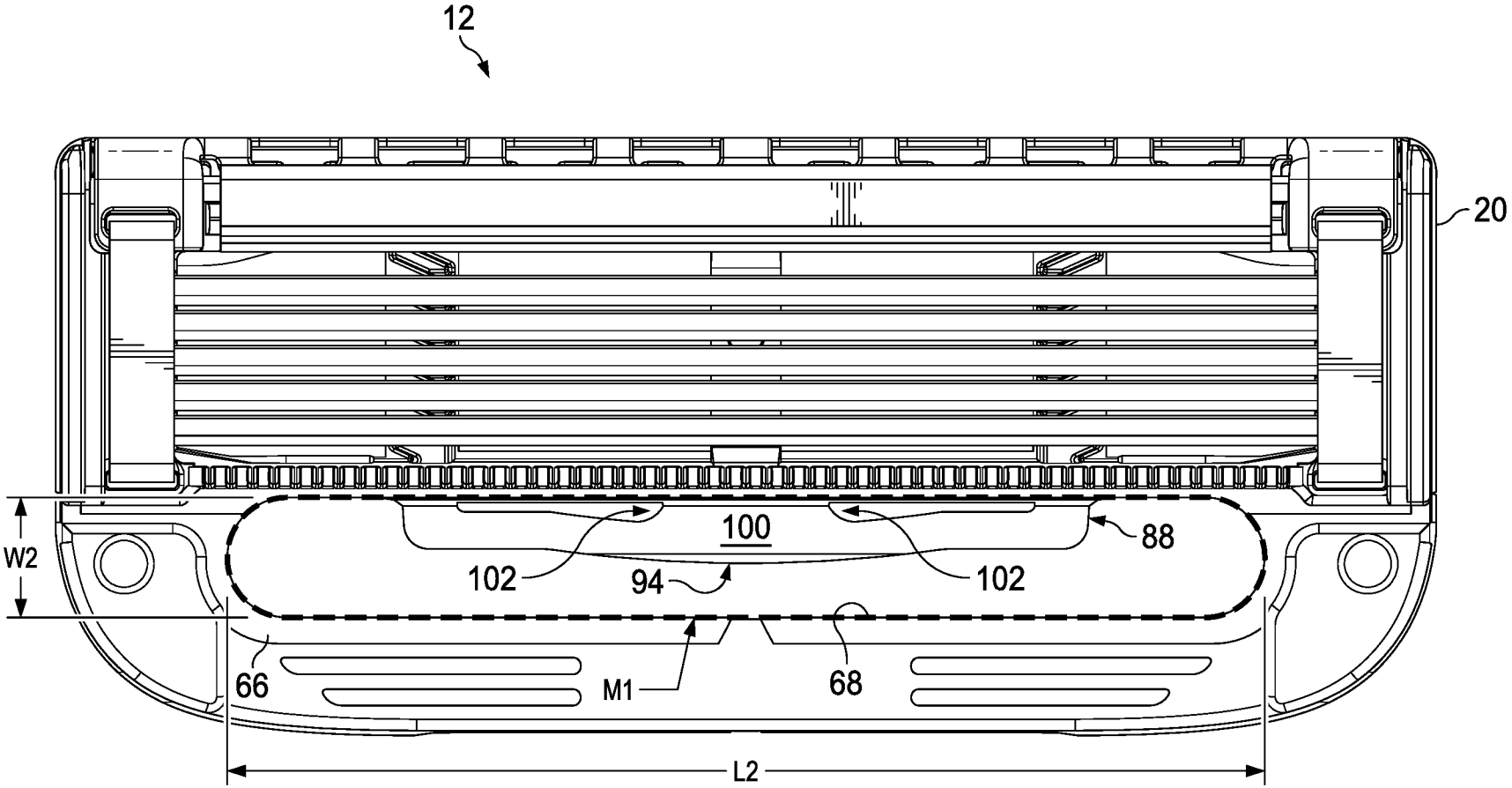
FIG. 5 is an upper plan view depicting the cartridge of FIG. 1.

Referring now to FIG. 5, the handle interface portion 22 can include an upper surface 66 that is located on an opposite side of the cartridge 12 as the lower surfaces 58, 60, 62. The upper surface 66 can define an upper opening 68 that is more proximate the shaving plane P1 than the lower opening 64. The upper opening 68 can define a perimeter M1. In one embodiment, the perimeter M1 can be between about 45 mm and about 90 mm and preferably about 66.5 mm. The handle receptacle 24 can extend to the upper opening 68 and can be configured to allow for a portion of the pivoting head 34 of the handle 14 to project through the upper surface 66, as will be described in more detail below. It is to be appreciated that although the upper opening 68 is shown as an individual opening, the upper surface 66 can define any quantity of upper openings, such as, for example, a pair of upper openings.

Referring now to FIGS. 4 and 5, the lower opening 64 can have a length L1 that extends laterally along the handle interface portion 22 between the opposing sides 30 of the handle interface portion 22. It is to be appreciated that extending laterally can be understood to mean that the length L1 is measured in a direction that is perpendicular to the shaving direction of the cartridge 12 (e.g., the direction in which the cartridge 12 is pulled along the user's skin to facilitate shaving). The lower opening 64 can also have a width W1 that extends longitudinally along the handle interface portion 22 (e.g., between the front wall 46 and the rear wall 48). It is to be appreciated that extending longitudinally can be understood to mean that the width W1 is measured in a direction that is substantially parallel to the shaving direction of the cartridge 12. The upper opening 68 can have a length L2 that extends laterally along the handle interface portion 22 (e.g., between the shoulder portions 70 shown in FIG. 4). The upper opening 68 can have a width W2 that extends longitudinally along the handle interface portion 22.

The lower opening 64 can generally be larger than the upper opening 68. In particular, the length L1 and width W1 of the lower opening 64 can be longer and wider, respectively, than the L2 and width W2 of the upper opening 68. In one embodiment, the length L1 of the lower opening 64 can be between about 29 mm and about 39 mm, and preferably about 34 mm, and the length L2 of the upper opening 68 can be between about 26 mm and about 36 mm, and preferably about 31 mm. In one embodiment, the width W1 of the lower opening 64 can be between about 3 mm and about 8 mm, and preferably about 6.5 mm and the width W2 of the upper opening 68 can be between about 1.5 mm and about 5 mm, and preferably about 3.6 mm. The relative size between the lower opening 64 and the upper opening 68 can provide an intuitive pathway for installation of the pivoting head 34 into the handle receptacle 24 and can also guide the pivoting head 34 into a fully installed position within the handle receptacle 24.

As illustrated in FIG. 4, the housing 20 of the cartridge 12 can define an overall width W0 that is measured longitudinally between the front end 16 and the rear end 18. The ratio of the overall width W0 of the housing 20 to the width W2 of the upper opening 68 can be between about 3:1 and about 2:1. In one embodiment, the overall width W0 of the housing 20 can be between about 10 mm and about 11 mm.

Figure 6:
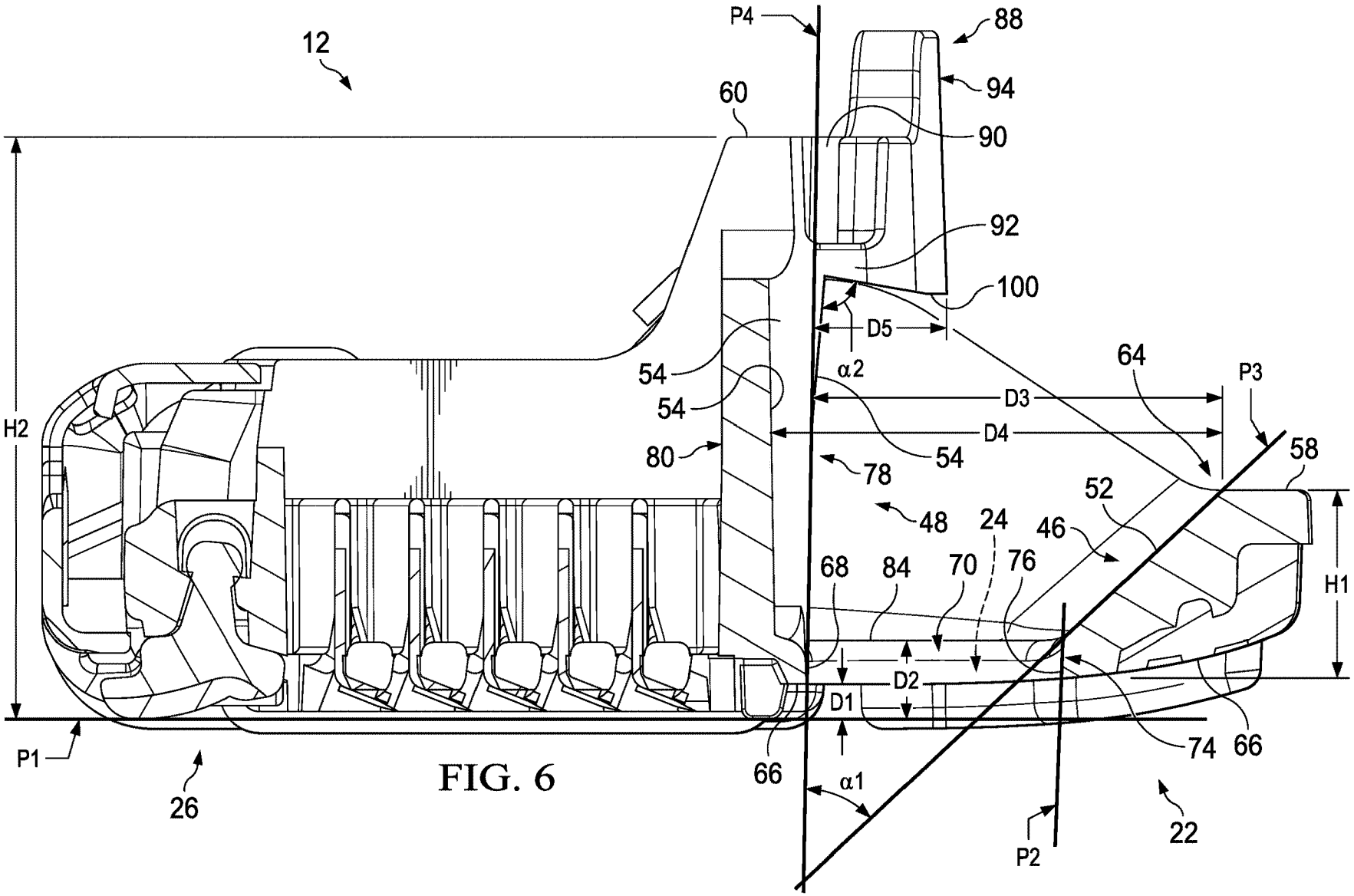
FIG. 6 is a cross-sectional view taken along the line 6-6 of FIG. 3.

Referring now to FIG. 6, the front wall 46 can be shorter than the rear wall 48. In particular, the front wall 46 can have a vertical height H1 that is measured between the lower surface 58 of the front wall 46 (at the highest point) and the upper surface 66. The rear wall 48 can have a vertical height H2 that is measured between the lower surface 60 of the rear wall 48 (at the highest point) and the upper surface 66. The vertical height H1 can be less than the vertical height H2. In one embodiment, the vertical height H1 can be between about 1.5 mm and about 7.5 mm, and preferably about 2.5 mm, and the vertical height H2 can be between about 7.5 mm and about 12 mm, and preferably about 9 mm. The vertical height H1 of the front wall 46 relative to the vertical height H2 of the rear wall 48 can provide sufficient clearance for the pivoting head 34 to be installed from the front end 16 of the cartridge 12 as will be described in further detail below. It is also to be appreciated that a vertical dimension (e.g., a vertical distance or vertical height) can be understood to mean a dimension that is measured in a direction that is perpendicular to the shaving plane P1.

The upper surface 66 can be within a vertical distance D1 of the shaving plane P1, which in some embodiments can be between about 0 mm (e.g., extending along the shave plane P1) and 1 mm, and preferably about 0.25 mm to 0.5 mm. In one embodiment, as illustrated in FIG. 6, the upper surface 66 can be spaced from the shaving plane P1. In other embodiments, the upper surface 66 can define the shaving plane P1 such that the vertical distance D1 is substantially zero. The proximity of the upper surface 66 to the shave plane P1 can allow the pivoting head 34 of the handle 14 to effectively contact a user's skin during shaving to provide a benefit (e.g., lubricant or heat) thereto, as will be described in further detail below.

Referring again to FIGS. 4 and 6, the handle interface portion 22 can include a pair of shoulder portions 70 that each extend to the upper surface 66 and cooperate with the upper surface 66 to at least partially define the upper opening 68. Each of the shoulder portions 70 comprise a shoulder surface 72 that interfaces with the front interior surface 52, the rear interior surface 54, and one of the side interior surfaces 56. The front wall 46, the rear wall 48, and each of the sidewalls 50 cooperate to define a perimeter M2 (FIG. 4) that extends along the interface between the shoulder surface 72 and each of the front interior surface 52, the rear interior surface 54, and the side interior surfaces 56. Each shoulder portion 70 can extend laterally inwardly from the front wall 46, the rear wall 48, and one of the sidewalls 50 such that the perimeter M1 of the upper opening 68 is greater than the perimeter M2. In one embodiment, the perimeter M2 can be between about 40 mm and about 100 mm and preferably between about 60 mm and about 80 mm.

The location of the shoulder portions 70 at the sidewalls 50 can advantageously result in an overall size of the cartridge 12 that is longitudinally smaller than some conventional cartridge arrangements. All things being equal, consumers typically prefer razor cartridges that are longitudinally compact. By extending the shoulder portions 70 partially around the handle receptacle 24, the perimeter M1 of the upper opening 68 can be maximized which can enhance the contact of the pivoting head 34 with a user's skin, as will be appreciated from the additional discussion below.

As illustrated in FIG. 6, the shoulder surface 72 of one of the shoulder portions 70 is shown to be spaced from the shaving plane P1 by a vertical distance D2. In one embodiment, the vertical distance D2 can be between about 0.5 mm and about 3 mm, and preferably about 1 mm. The vertical distance D2 can affect the control of the shaving geometry of the shaving system 10 and can influence the performance of the pivoting head 34 to provide benefit (e.g., heat or lubrication) to the skin through the upper opening 68, as will be described in further detail below. It is to be appreciated that although only one of the shoulder portions 70 is shown in FIG. 6, the shoulder surface 72 of the other of the shoulder portions 70 (shown in FIG. 4) can be similarly spaced from the shaving plane P1. However, it is contemplated that the shoulder surfaces 72 might be spaced differently from the shaving plane P1.

Referring now to FIGS. 2, 4, and 6, the handle interface portion 22 can include a front lip portion 74 that extends between the front wall 46 and the upper surface 66 and between the shoulder portions 70. The front lip portion 74 can include a lip surface 76 (FIGS. 2 and 6) that extends between the front interior surface 52 and the upper surface 66. The lip surface 76 can be non-coplanar with the front interior surface 52 of the front wall 46. For example, in one embodiment, as illustrated in FIG. 6, the lip surface 76 can extend along a plane P2 and the front interior surface 52 can extend along a plane P3 that is non-coplanar (e.g., angled) with respect to the plane P2. In one embodiment, the lip surface 76 can be arranged such that the plane P2 is substantially perpendicular to the shaving plane P1. As will be described in further detail below, the front lip portion 74 can be configured to engage the pivoting head 34 of the handle 14.

Figure 7:
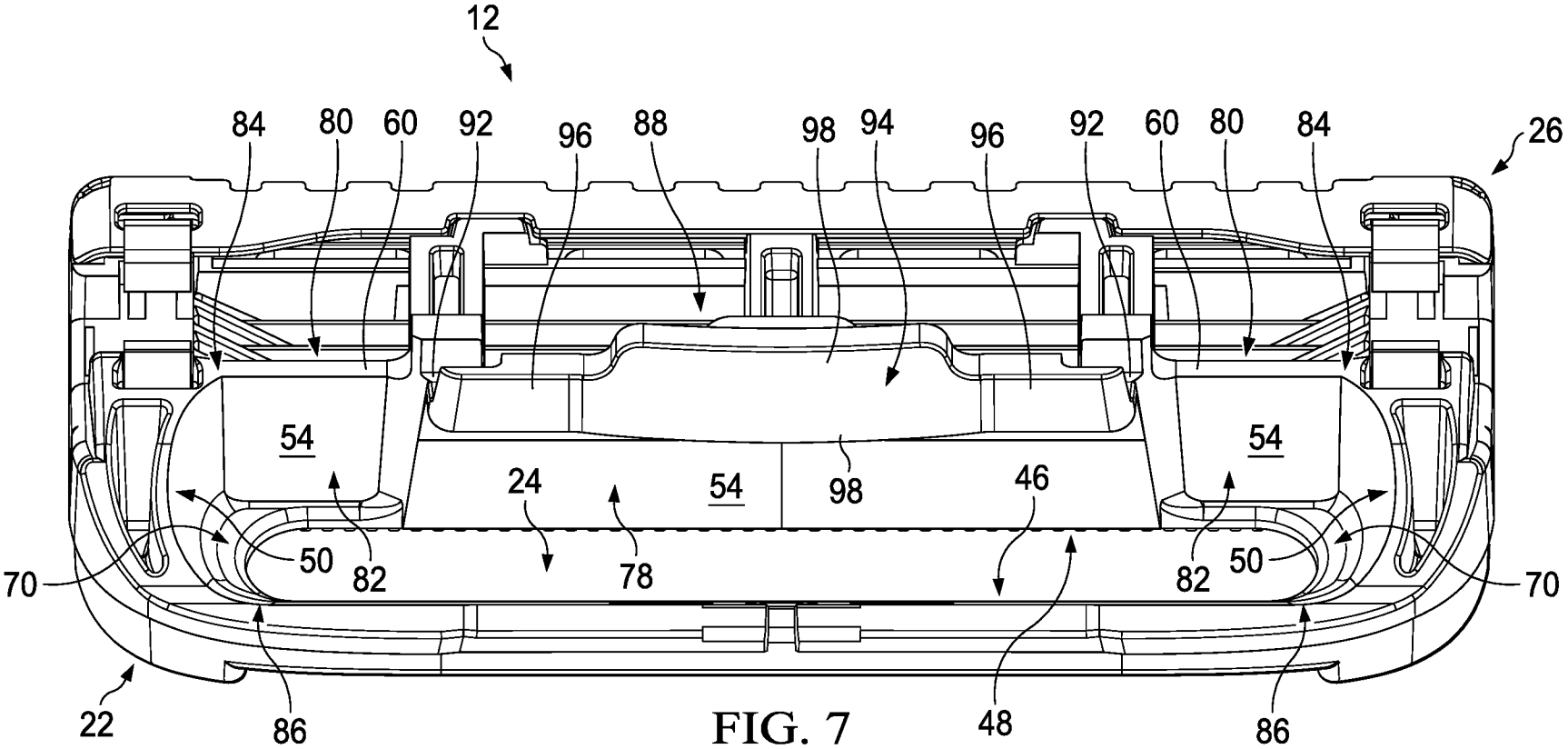
FIG. 7 is a lower front isometric view depicting the cartridge of FIG. 1.

Referring now to FIGS. 4 and 7, the rear wall 48 can include a central portion 78 and a pair of distal portions 80 (FIG. 7) that each extend from the central portion 78 to one of the sidewalls 50. The rear wall 48 can be thinner at the distal portions 80 than at the central portion 78 such that each of the distal portions 80 defines a notch 82. For example, as illustrated in FIG. 4, the central portion 78 can have a thickness T1 and each of the distal portions 80 can have a thickness T2. The thickness T1 of the central portion 78 can be greater than the thickness T2 of the distal portions 80. The ratio of the first thickness T1 to the second thickness T2 can be about 3:1 to about 3:2. In one embodiment, the thickness T1 can be between about 0.75 mm and about 3 mm, and preferably between about 1 mm and 2 mm, and the thickness T2 can be between about 0.5 mm and about 1 mm, and preferably between about 0.6 mm to 0.8 mm.

The relative thicknesses T1, T2 of each of the central portion 78 and the distal portions 80 can result in the rear interior surface 54 of the rear wall 48 at the distal portions 80 being spaced further from the front interior surface 52 of the front wall 46 than the rear interior surface 54 at the central portion 78 of the rear wall 48. For example, as illustrated in FIG. 6, the rear interior surface 54 at the central portion 78 of the rear wall 48 can be spaced from the front interior surface 52 by a horizontal distance D3. The rear interior surface 54 at the distal portion 80 can be spaced from the front interior surface 52 by a horizontal distance D4 that is greater than the horizontal distance D3. It is to be appreciated that a horizontal distance can be understood to mean that a distance that is measured in a direction that is parallel to the shaving plane P1.

Referring now to FIGS. 6 and 7, the rear interior surface 54 of the rear wall 48 that is located at each of the distal portions 80 is shown to be substantially planar and to extend between the lower surface 60 of the rear wall 48 and the shoulder portions 70 such that each notch 82 extends entirely vertically between the lower surface 60 and one of the shoulder portions 70. However, it is to be appreciated that other notch configurations are contemplated. For example, each of the distal portions 80 might define an alternative notch (not shown) that only extends partially between the lower surface 60 and one of the shoulder portions 70 such that the notches are configured as recesses. It is also to be appreciated that while the notches 82 are described as being similar to each other, it is contemplated that the notches can alternatively be configured differently from each other.

The rear interior surface 54 located at the central portion 78 of the rear wall 48 can extend to the upper surface 66 (FIG. 6) and between the shoulder portions 70 and can be spaced from the lip surface 76 (FIG. 6). As illustrated in FIG. 6, the rear interior surface 54 can extend along a plane P4. In one embodiment, the plane P4 can be substantially perpendicular to the shaving plane P1.

Referring now to FIG. 7, the front wall 46 is shown to intersect each of the sidewalls 50 at respective front corners 84, and the rear wall 48 is shown to intersect each of the sidewalls 50 at respective rear corners 86. When the pivoting head 34 of the handle 14 is installed into, or removed from, the handle receptacle 24, each of the front corners 84 can be configured to selectively flex relative to adjacent portions of the front wall 46 and the sidewalls 50, and each of the rear corners 86 can be configured to selectively flex relative to adjacent portions of the rear wall 48 and the sidewalls 50. To facilitate such flexing, each of the front corners 84 can have a moment of inertia that is less than the moment of inertia of the adjacent portions of the front wall 46 and the sidewalls 50, and each of the rear corners 86 can have a moment of inertia that is less than the moment of inertia of the adjacent portions of the rear wall 48 and the sidewalls 50. In one embodiment, each of the front corners 84 and the rear corners 86 can have a moment of inertia that is less than about 2 $mm^4$. It is to be appreciated that the higher flexibility of the front and rear corners 84, 86 can allow the front and rear corners 84, 86 to effectively serve as frangible areas for when the cartridge 12 undergoes significant impact, such as when the shaving system 10 is dropped. In particular, the front and rear corners 84, 86 can be configured to break first when the cartridge 12 undergoes significant impact to prevent the blade support portion 26 from breaking and allowing the razor blades 28 to separate from the cartridge 12. It is to be appreciated that, although each of the front and rear corners 84, 86 are described as having higher flexibility, any quantity (e.g., one, two, or three) and/or combination of the front and rear corners 84, 86 are contemplated to have a higher flexibility.

Referring now to FIGS. 4 and 6, the overall shape of the handle receptacle 24 will now be discussed with respect to the various components described above. The front interior surface 52 of the front wall 46 and the rear interior surface 54 of the central portion 78 of the rear wall 48 can be tapered inwardly towards the upper opening 68 such that the handle receptacle 24 is generally funnel-shaped below the shoulder portions 70. In particular, the front interior surface 52 and the rear interior surface 54 of the central portion 78 of the rear wall 48 can be angled relative to each other such that the planes P3, P4 intersect at an included angle α1 (any angle that is less than 180 degrees) to define the funnel-shape of the handle receptacle 24. In one embodiment, the included angle α1 can be between about 30 degrees and 70 degrees, and preferably between about 45 degrees and about 48 degrees. The included angle α1 can provide the front wall 46 and the rear wall 48 at an angle that narrows the handle receptacle 24 in the direction of the upper opening 68 to provide an intuitive pathway for installation of the pivoting head 34 through the lower opening 64 and can also guide the pivoting head 34 into a fully installed position within the handle receptacle 24.

In one embodiment, the front interior surface 52 of the front wall 46 and the rear interior surface 54 of the central portion 78 of the rear wall 48 can be generally planar such that the front interior surface 52 of the front wall 46 and the rear interior surface 54 of the central portion 78 of the rear wall 48 reside substantially entirely in the front and rear planes P3, P4, respectively. It is to be appreciated, however, that alternative non-planar surfaces are contemplated, such as, for example, surfaces that have at least one contoured area. For these non-planar surfaces, the term extending in a plane can be understood to mean that the surface has at least two points that reside in the plane. It is also to be appreciated that although the rear interior surface 54 of the central portion 78 of the rear wall 48 is discussed, any other portion of the rear interior surface 54 is also contemplated as defining the funnel shape of the handle receptacle 24.

Figure 8:
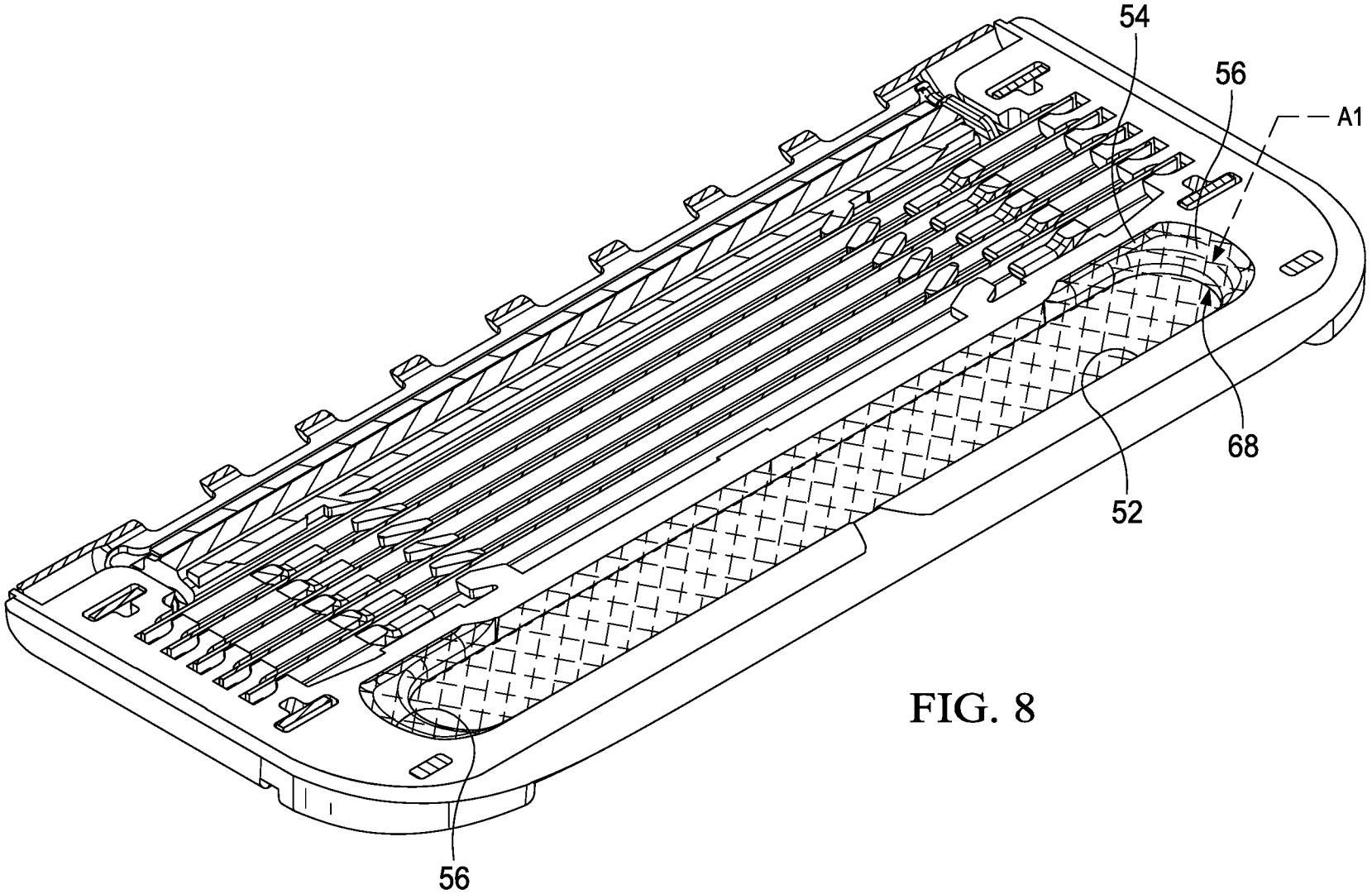
FIG. 8 is a cross-sectional view taken along the line 8-8 of FIG. 3.
Figure 9:
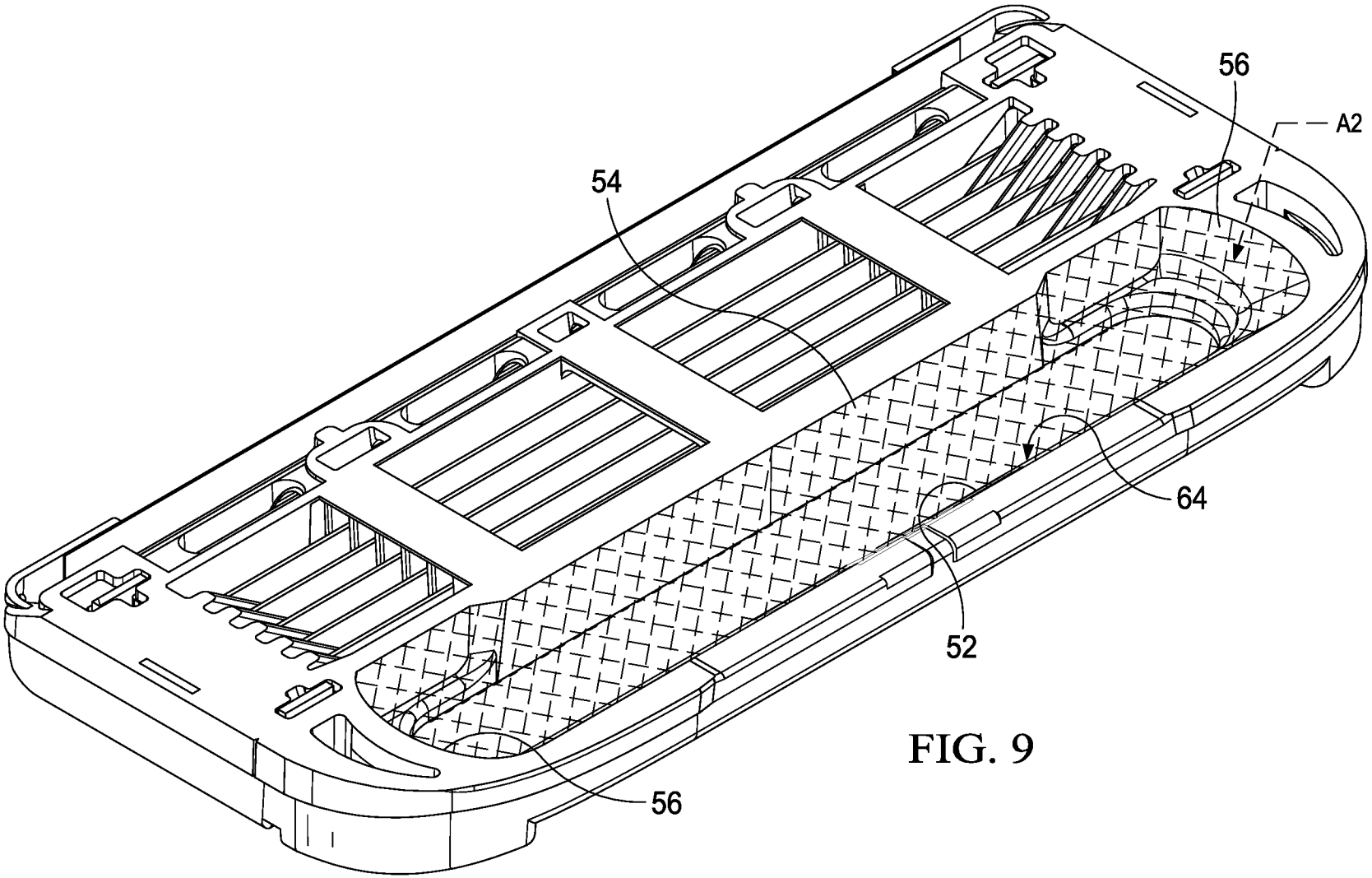
FIG. 9 is a cross-sectional view taken along the line 9-9 of FIG. 3.
Figure 10:
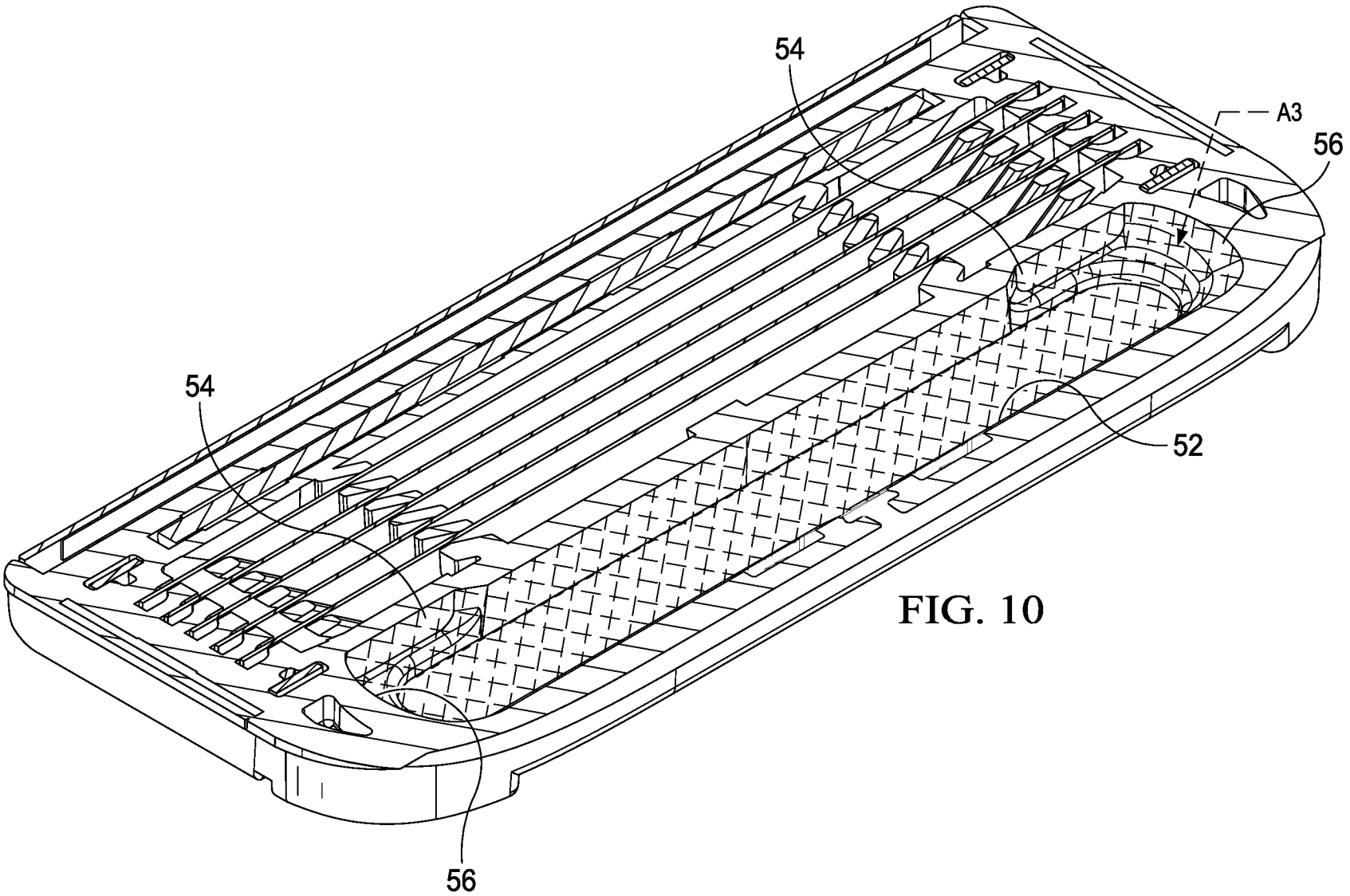
FIG. 10 is a cross-sectional view taken along the line 10-10 of FIG. 3.

The funnel-shape of the handle receptacle 24 can result in the cross-sectional surface area of the handle receptacle 24 being larger proximate the lower opening 64 than proximate the upper opening 68. For example, as illustrated in FIG. 8, an upper cross-sectional area A1 can be defined by each of the front interior surface 52, the rear interior surface 54, and the side interior surfaces 56 proximate the upper opening 68. As illustrated in FIG. 9, a lower cross-sectional area A2 can be defined by each of the front interior surface 52, the rear interior surface 54, and the side interior surfaces 56 at the lower opening 64. The upper cross-sectional area A1 can be more proximate the upper opening 68 than the lower cross-sectional area A2. In one embodiment, the upper cross-sectional area A1 can be taken at a vertical distance of about 1 mm from the shaving plane P1. As illustrated in FIG. 10, an intermediate cross-sectional area A3 can be defined by each of the front interior surface 52, the rear interior surface 54, and the side interior surfaces 56 and can be disposed between the upper cross-sectional area A1 and the lower cross-sectional area A2. The lower cross-sectional area A2 can be greater than the upper cross-sectional area A1. The intermediate cross-sectional area A3 can be less than the lower cross-sectional area A2 and greater than the upper cross-sectional area A1. In one embodiment, the lower cross-sectional area A1 can be between about 60 $mm^2$ and about 250 $mm^2$, and preferably about 155 $mm^2$ and the upper cross-sectional area A2 can be between about 40 $mm^2$ and about 120 $mm^2$, preferably about 80 $mm^2$. It is to be appreciated that the upper cross-sectional area A1 can be understood to mean the smallest cross-sectional area that can be defined by each of the front interior surface 52, the rear interior surface 54, and the side interior surfaces 56 that is taken at a cross-section that is parallel to the shaving plane P1. It is also to be appreciated that the lower cross-sectional area A2 can be understood to mean the largest cross-sectional area that can be defined by each of the front interior surface 52, the rear interior surface 54, and the side interior surfaces 56 that is taken at a cross-section that is parallel to the shaving plane P1.

Referring again to FIGS. 3 and 4, the handle interface portion 22 can include a locking member 88 that is configured to facilitate selective retention of the pivoting head 34 (FIG. 1) of the handle 14 within the handle receptacle 24. The locking member 88 can comprise a central member 90, a pair of support arms 92 and a deflection member 94. Each of the central member 90 and the support arms 92 can be coupled with the central portion 78 of the rear wall 48 and can extend from the rear wall 48. The deflection member 94 can comprise a pair of distal members 96 and a central portion 98 that is interposed between the distal members 96. The central member 90 can be coupled with the central portion 98 and each of the distal members 96 can be coupled with one of the support arms 92.

Referring now to FIG. 6, each of the central member 90 and the support arms 92 can extend from the rear wall 48 such that the deflection member 94 is interposed between the front wall 46 and the plane P4 of the rear interior surface 54 of the rear wall 48. The locking member 88 can accordingly extend from the rear interior surface 54 of the central portion 78 of the rear wall 48 towards the front wall 46 such that the locking member 88 overhangs the rear wall 48. In one embodiment, the locking member 88 can extend from the rear interior surface 54 at the central portion 78 of the rear wall 48 and towards the front wall 46 by a horizontal distance D5 that is between about 1 mm and 3 mm, and preferably between about 1.5 mm and 2.5 mm. As will be described in further detail below, when the pivoting head 34 (FIG. 1) of the handle 14 is inserted into the handle receptacle 24, the locking member 88 can engage the pivoting head 34 to facilitate retention of the pivoting head 34 in the handle receptacle 24.

The deflection member 94 can include an upper surface 100 (FIGS. 5 and 6) that is spaced from the lower surface 60 of the rear wall 48 such that the central member 90, the support arms 92, the upper surface 100 and the lower surface 60 cooperate to define a pair of slots 102 (FIGS. 4 and 5) that extend between the rear wall 48 and the deflection member 94. In one embodiment, the upper surface 100 of the deflection member 94 and the rear interior surface 54 at the central portion 78 of the rear wall 48 (e.g., the plane P4) can be angled with respect to each other by an angle α2 of less than 90 degrees and more preferably by between about 75 degrees and 85 degrees.

The cartridge 12 disclosed herein can additionally or alternatively include one or more features of the various embodiments of the cartridges disclosed in co-owned, co-pending U.S. applications which are being filed concurrently herewith and which are hereby incorporated herein by reference.

Figure 11:
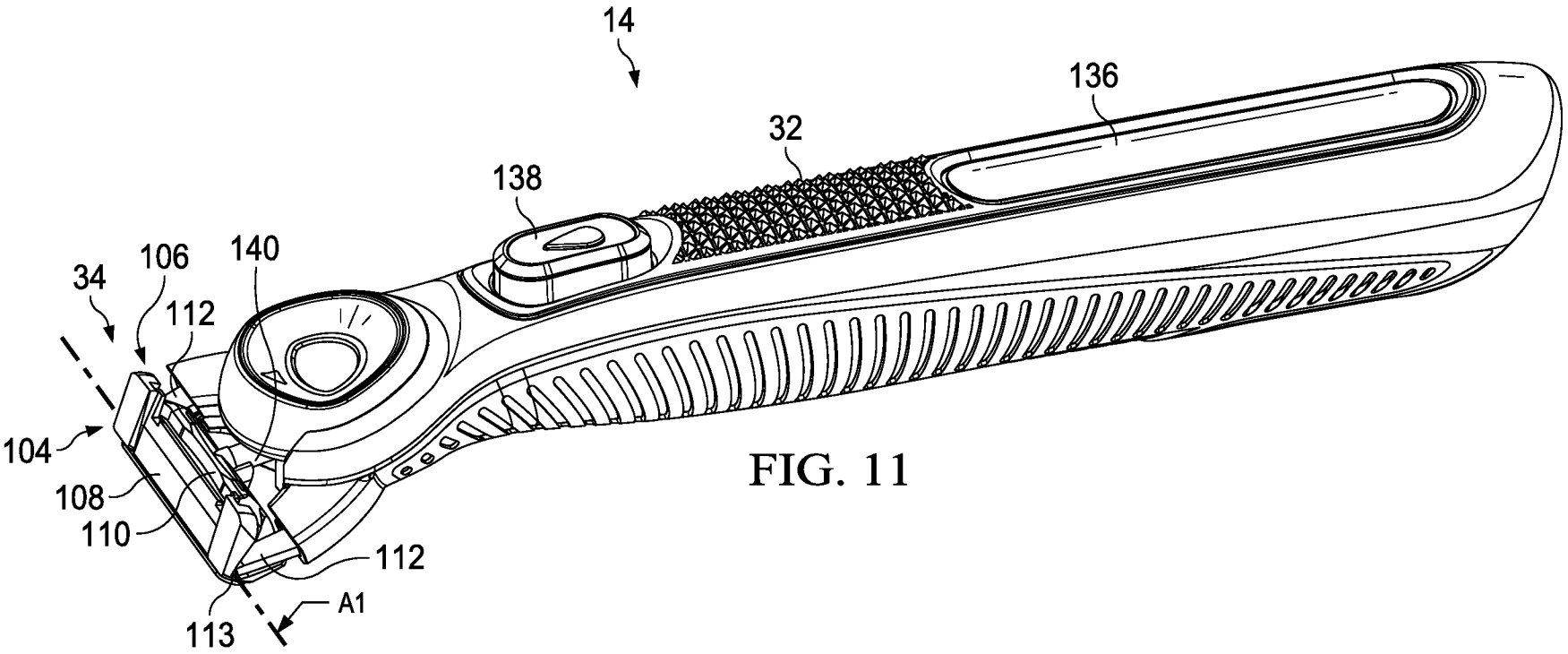
FIG. 11 is a lower front isometric view depicting the handle of FIG. 1.

Referring now to FIGS. 11-16, the configuration of the handle 14 will now be discussed. The pivoting head 34 of the handle 14 can be configured for insertion into the handle receptacle 24 (FIG. 1) to facilitate releasable attachment of the handle 14 with the cartridge 12. Referring now to FIG. 11, the pivoting head 34 can extend between an upper end 104 and a lower end 106. The pivoting head 34 can comprise a base member 108 and a cover member 110 that is coupled with the base member 108. The handle 14 can comprise a pair of arms 112 that are each spaced from one another and extend from the main body 32 and to the lower end 106 of the pivoting head 34. Each of the arms 112 can be rigidly coupled with the main body 32 of the handle 14.

Figure 14:
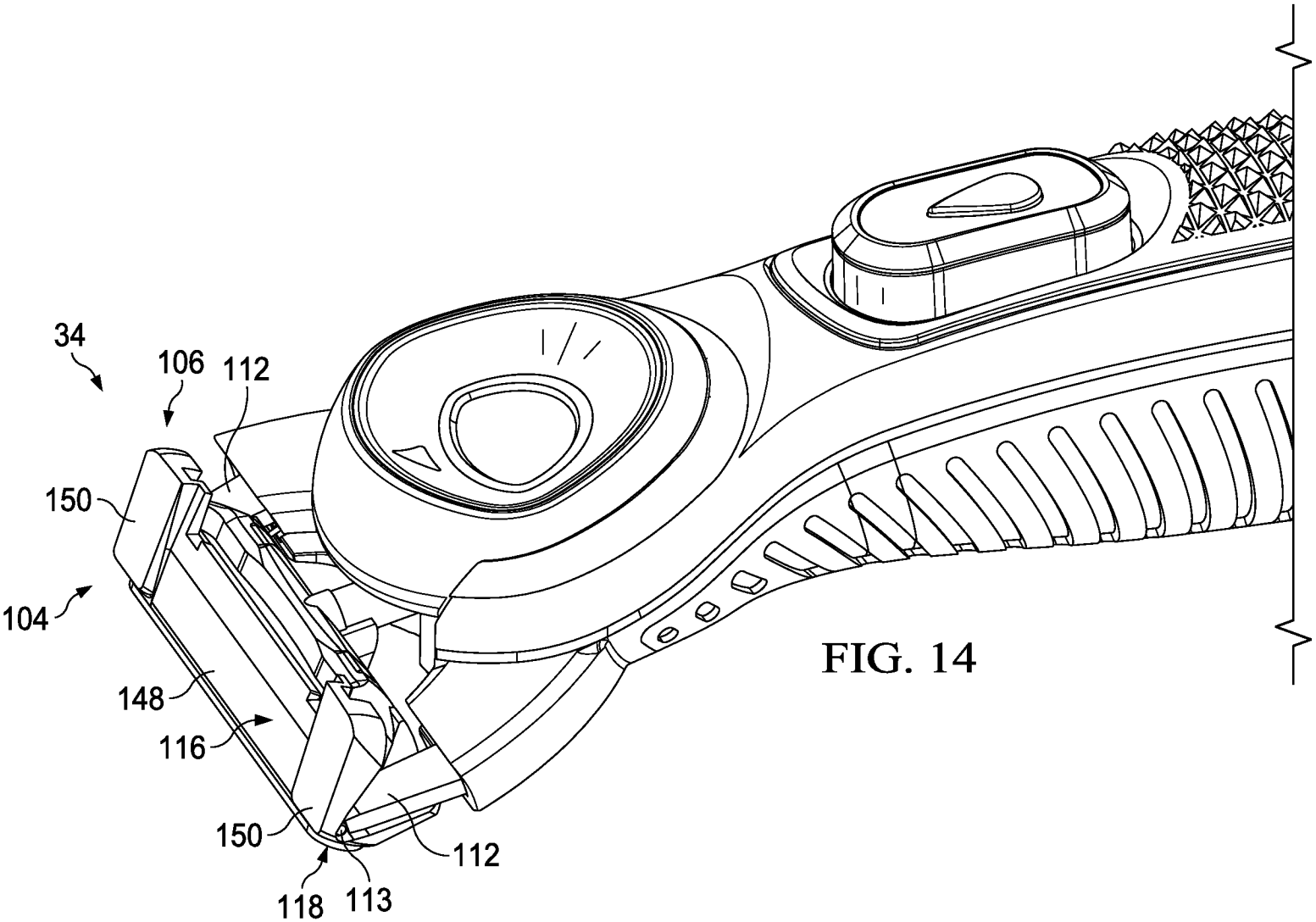
FIG. 14 is an exploded front side isometric view depicting the handle of FIG. 1.
Figure 34:
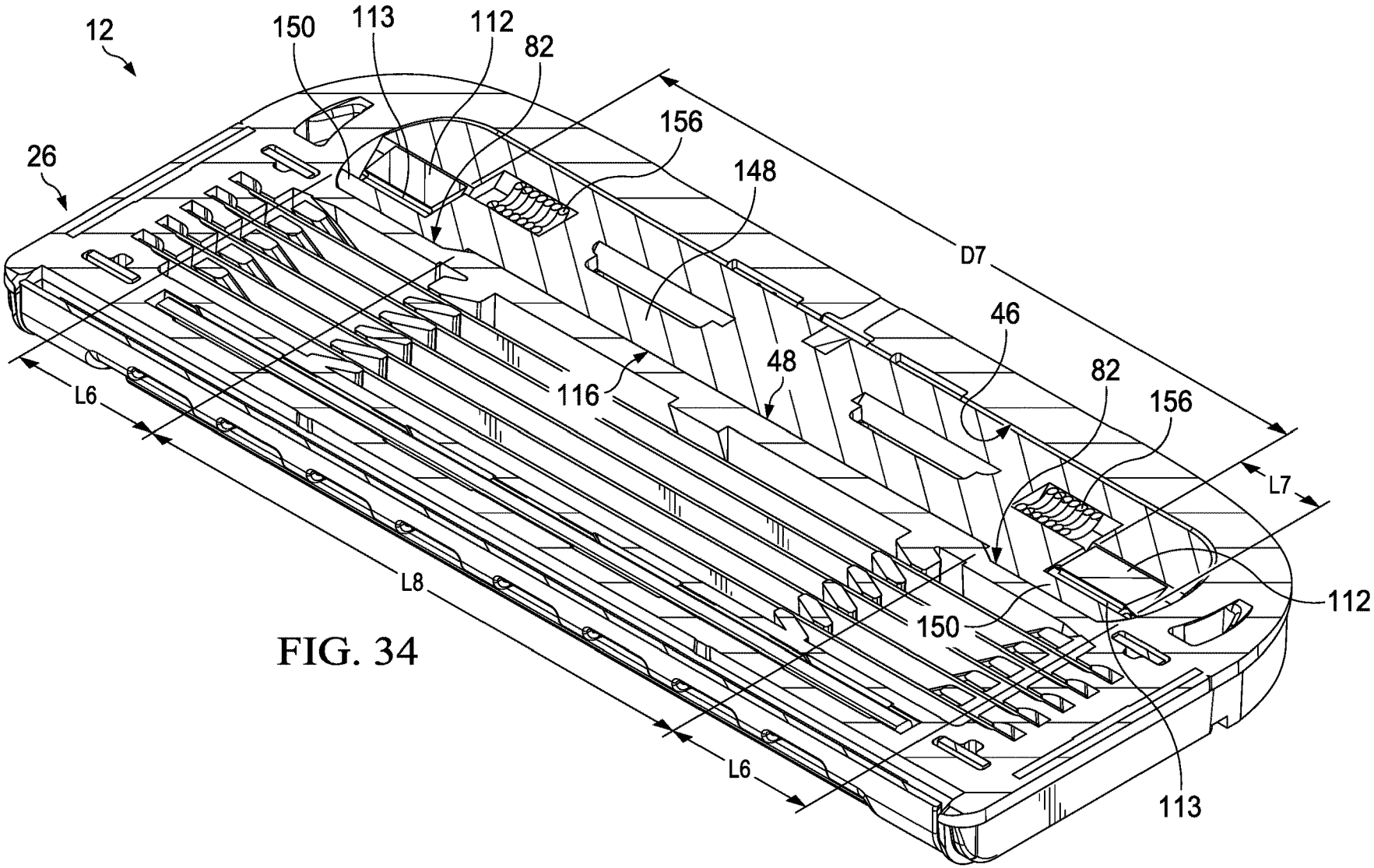
FIG. 34 is a cross-sectional view taken along the line 34-34 of FIG. 31 with certain components removed for clarity of illustration.

Each of the arms 112 can comprise a pin member 113 (also shown in FIGS. 14 and 34). Each of the pin members 113 can be pivotally coupled with the base member 108 such that the pivoting head 34 is pivotable about a pivot axis A1 defined by the pin members 113. A spring (e.g., 156 in FIG. 34) can be operably coupled with each of the pivoting head 34 and the main body 32 to facilitate biasing of the pivoting head 34 relative to the main body 32 of the handle 14. It is to be appreciated that the handle 14 can provide one or more pivot motions for the pivoting head 34. In the embodiment illustrated in FIG. 11, the pivot axis A1 can be generally transverse to the handle 14. Although the handle 14 is shown to include a pair of arms 112, it is to be appreciated that a handle can be provided with any other quantity of arms such as one arm or more than two arms.

Figure 12:
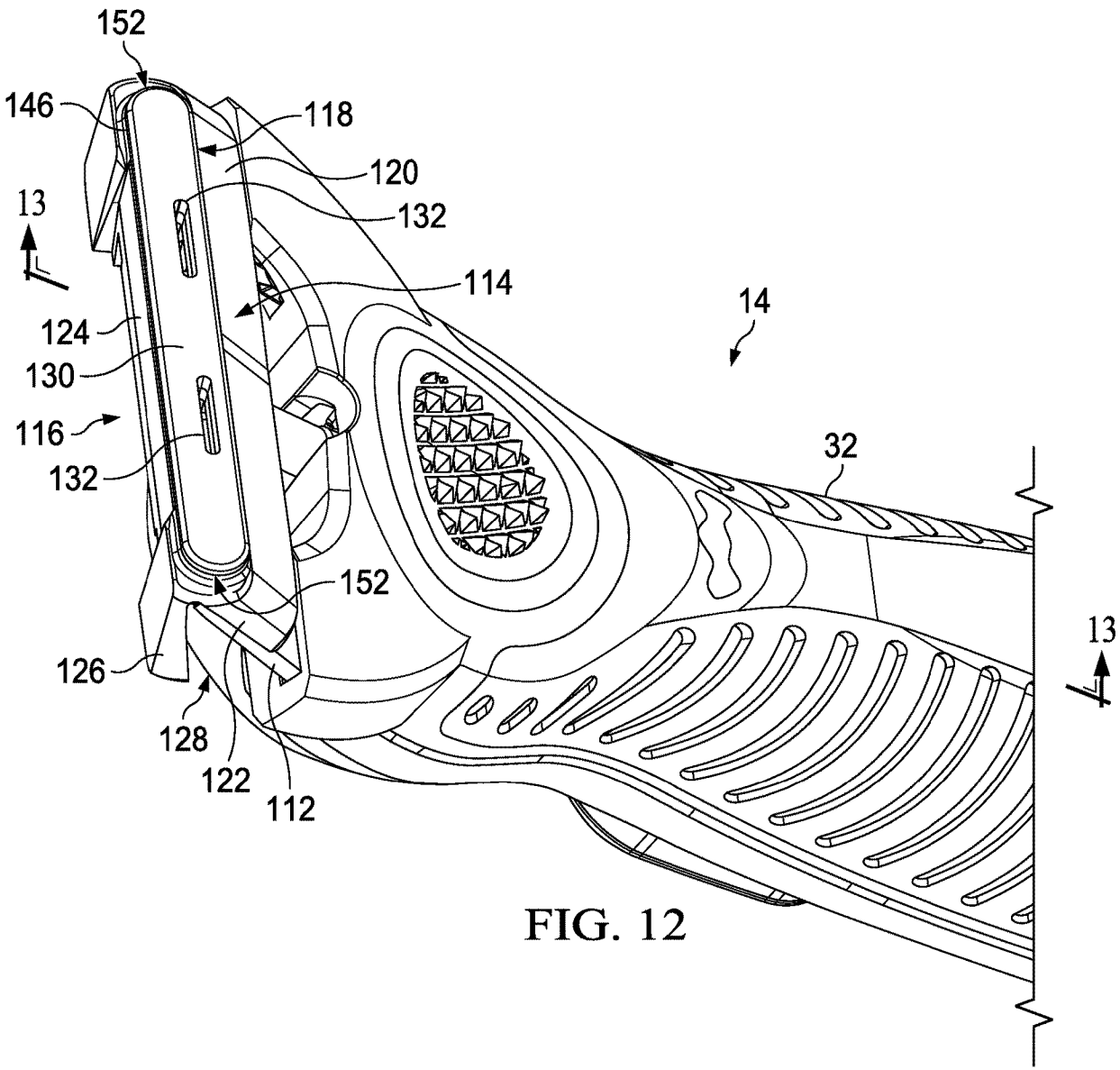
FIG. 12 is an exploded upper isometric view depicting the handle of FIG. 1.

Referring now to FIG. 12, the base member 108 can include a front wall 114, a rear wall 116, and a head portion 118 that extends upwardly from the front and rear walls 114, 116 such that the front wall 114, the rear wall 116, and the head portion 118 cooperate to define a trapezoidal prism-shape. The front wall 114 can include a front exterior surface 120 and a pair of side exterior surfaces 122 (one shown) that extend from the front exterior surface 120 and towards the rear wall 116. The rear wall 116 can include a rear exterior surface 124 and a pair of side exterior surfaces 126 (one shown) that extend from the rear exterior surface 124 and towards the front wall 114.

The front wall 114 and the rear wall 116 are angled with respect to each other and cooperate with each other define a pair of V-shaped grooves 128 (one shown) at the side exterior surfaces 122, 126. As illustrated in FIGS. 11 and 12, the arms 112 can extend along the V-shaped grooves 128 and can be configured to travel within the V-shaped grooves 128 when the pivoting head 34 is pivoted.

The head portion 118 can comprise a face surface 130 that defines a pair of apertures 132. The apertures 132 can be in fluid communication with a fluid distribution system that facilitates dispensation of shaving fluid, such as, for example, shaving cream or shaving lotion. As illustrated in FIG. 11, the fluid distribution system can comprise a reservoir 136, a dispensing button 138, and a fluid delivery member 140. The reservoir 136 can be in fluid communication with the fluid delivery member 140 which can be in fluid communication with the apertures 132 (FIG. 12) of the head portion 118. The dispensing button 138 can be fluidly interposed between the reservoir 136 and the fluid delivery member 140 and can be configured to facilitate selective dispensation of the shaving fluid stored in the reservoir 136 through the apertures 132 (FIG. 12). In particular, a user can depress the dispensing button 138 while shaving to dispense the shaving fluid to the user's skin.

The shaving fluid can comprise a water-insoluble polymer and a skin-lubricating water-soluble polymer. Suitable water-insoluble polymers which can be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend and can have a high impact polystyrene (i.e., Polystyrene-butadiene), such as Mobil 4324 (Mobil Corporation). Suitable skin lubricating water-soluble polymers can include polyethylene oxide, polyvinyl pyrrolidone, polyacrylamide, hydroxypropyl cellulose, polyvinyl imidazoline, and polyhydroxyethylmethacrylate. Other water-soluble polymers can include the polyethylene oxides generally known as POLYOX (available from Union Carbide Corporation) or ALKOX (available from Meisei Chemical Works, Kyota, Japan). These polyethylene oxides can have molecular weights of about 100,000 to 6 million, for example, about 300,000 to 5 million. The polyethylene oxide can comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend can also contain up to about 10% by weight of a low molecular weight (i.e., molecular weight of less than about 10,000) polyethylene glycol such as PEG-100.

The shaving fluid can also include a complex of a skin-soothing agent with a cylcodextrin, low molecular weight water-soluble release enhancing agent such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, and the like.

Figure 13:
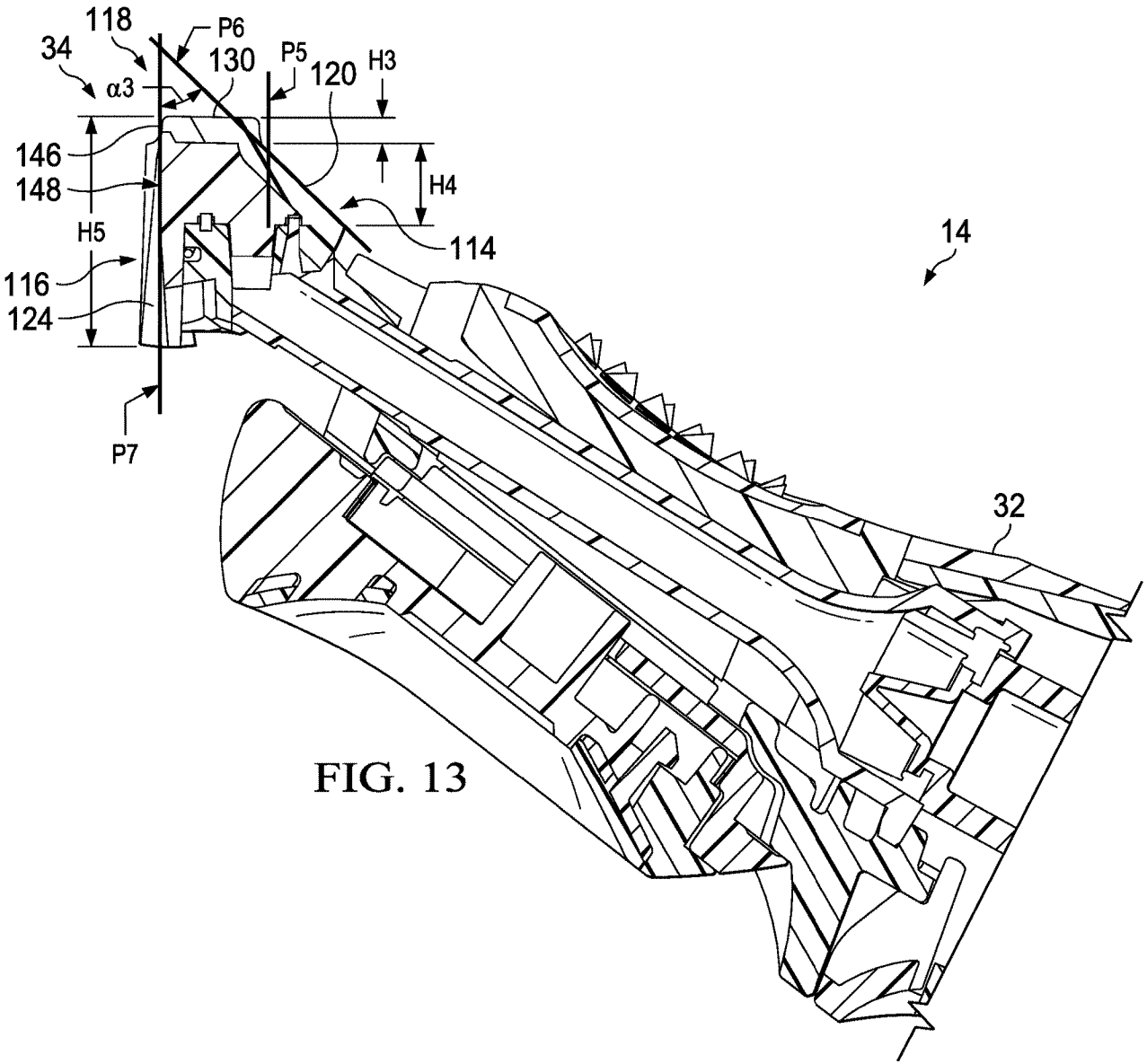
FIG. 13 is a cross-sectional view taken along the line 13-13 of FIG. 12.

Referring now to FIG. 13, the head portion 118 can comprise an exterior lip surface 146 that extends between the front and rear walls 114, 116 and the face surface 130. The front wall 114 and the head portion 118 can be angled with respect to each other such that the front exterior surface 120 and the exterior lip surface 146 are non-coplanar. In particular, the exterior lip surface 146 can extend along a plane P5, and the front exterior surface 120 of the front wall 114 can extend along a plane P6 that is non-coplanar with the plane P5. Each of the exterior lip surface 146 and the front exterior surface 120 can be generally planar such that the exterior lip surface 146 and the front exterior surface 120 reside substantially entirely in the plane P6. It is to be appreciated, however, that alternative non-planar surfaces are contemplated, such as, for example, surfaces that have at least one contoured area. The angle of the front exterior surface 120 and the exterior lip surface 146 can generally correspond to the angle between the front wall 46 and the front lip portion 74 of the cartridge 12 (e.g., the angle between plane P2 and P3 shown in FIG. 6) to allow for proper insertion of the pivoting head 34 into the handle receptacle 24.

The head portion 118 can have a vertical height H3 that can be between about 0.5 mm and about 2 mm, and preferably between about 0.9 mm and about 1.0 mm. It is to be appreciated that a vertical dimension (e.g., height or distance) on the handle 14 can be understood to mean that the dimension is measured in a direction that is perpendicular to the shaving plane P1 when the pivoting head 34 is installed on the cartridge 12. The front wall 114 can have a vertical height H4 that can be between about 1.5 and about 5 mm, and preferably about 3.1 mm. The rear wall 116 can have a vertical height H5 that can be between about 5.5 mm and about 12 mm, and preferably between about 7 mm and about 9 mm.

Still referring to FIG. 13, the rear exterior surface 124 of the central portion 148 of the rear wall 116 can extend along a plane P7. The rear exterior surface 124 of the central portion 148 of the rear wall 116 can be generally planar such that the rear exterior surface 124 of the central portion 148 of the rear wall 116 resides substantially entirely in the plane P7. It is to be appreciated, however, that alternative non-planar surfaces are contemplated, such as, for example, surfaces that have at least one contoured area.

Figure 15:
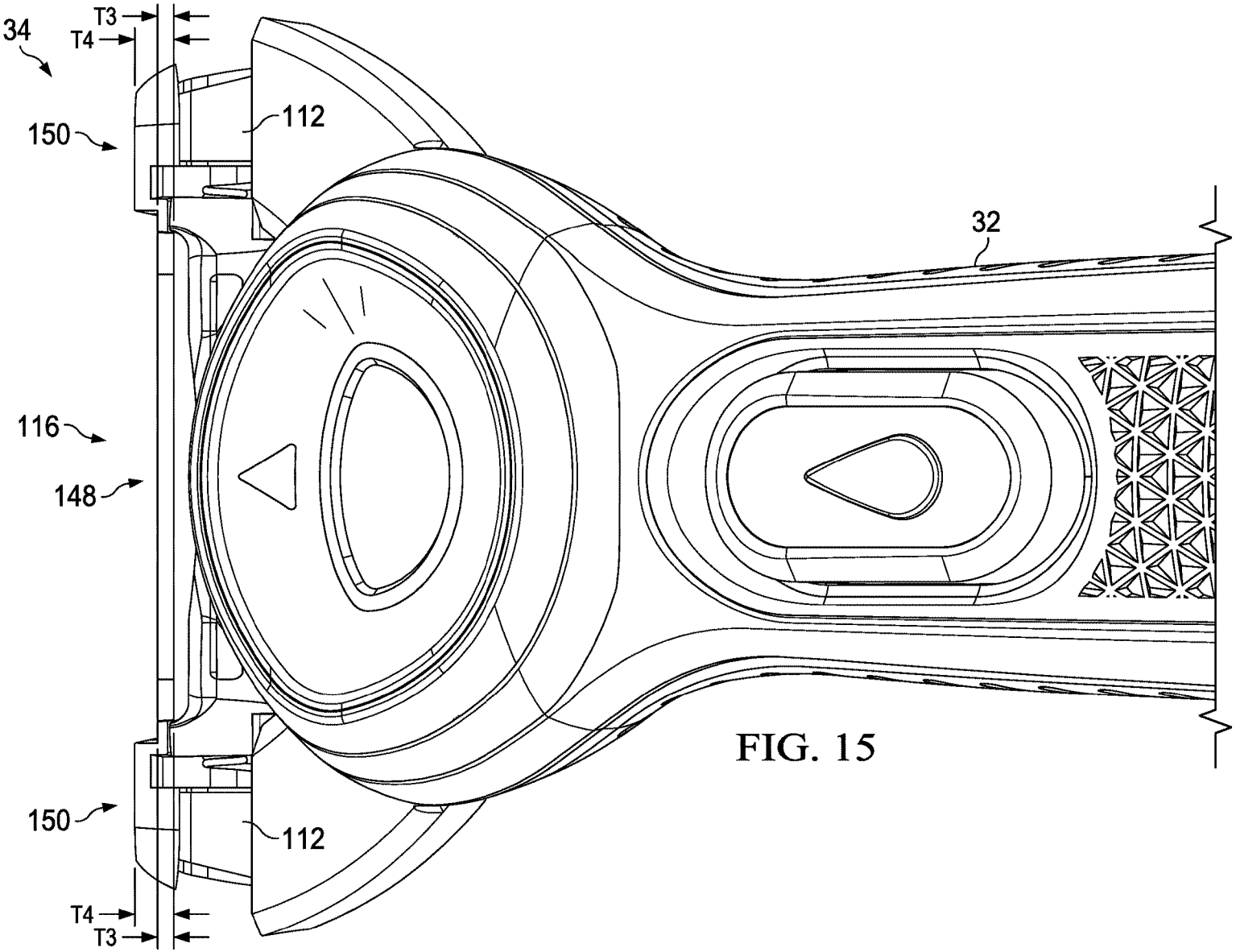
FIG. 15 is an exploded lower isometric view depicting the handle of FIG. 1.

Referring now to FIGS. 14 and 15, the rear wall 116 can include a central portion 148 and a pair of tab members 150 that are disposed at opposite ends of the central portion 148. The tab members 150 can be thicker than the central portion 148 such that the tab members 150 protrude longitudinally (e.g., rearwardly) relative to the central portion 148. For example, as illustrated in FIG. 15, the central portion 148 can have a thickness T3 and each of the tab members 150 can have a thickness T4 that is greater than the thickness T3 of the central portion 148. The ratio of the thickness T4 to the thickness T3 can be between about 3:1 and about 3:2. In one embodiment, the thickness T4 can be between about 0.75 mm and about 3 mm, and preferably about 0.9 mm to about 1.0 mm, and the thickness T3 can be between about 0.5 mm and about 1 mm, and preferably between about 0.8 mm to about 0.9 mm.

The tab members 150 are shown in FIG. 14 to extend substantially entirely between the lower end 106 of the pivoting head 34 and the head portion 118. However, it is to be appreciated that other tab member configurations are contemplated. For example, tab members might only extend partially between the lower end 106 of the pivoting head 34 and the head portion 118 such that they are spaced from one or more of the lower end 106 of the pivoting head 34 and the head portion 118. It is also to be appreciated that while the tab members 150 are described as being similar to each other, it is contemplated that tab members can alternatively be configured differently from each other.

Figure 16:
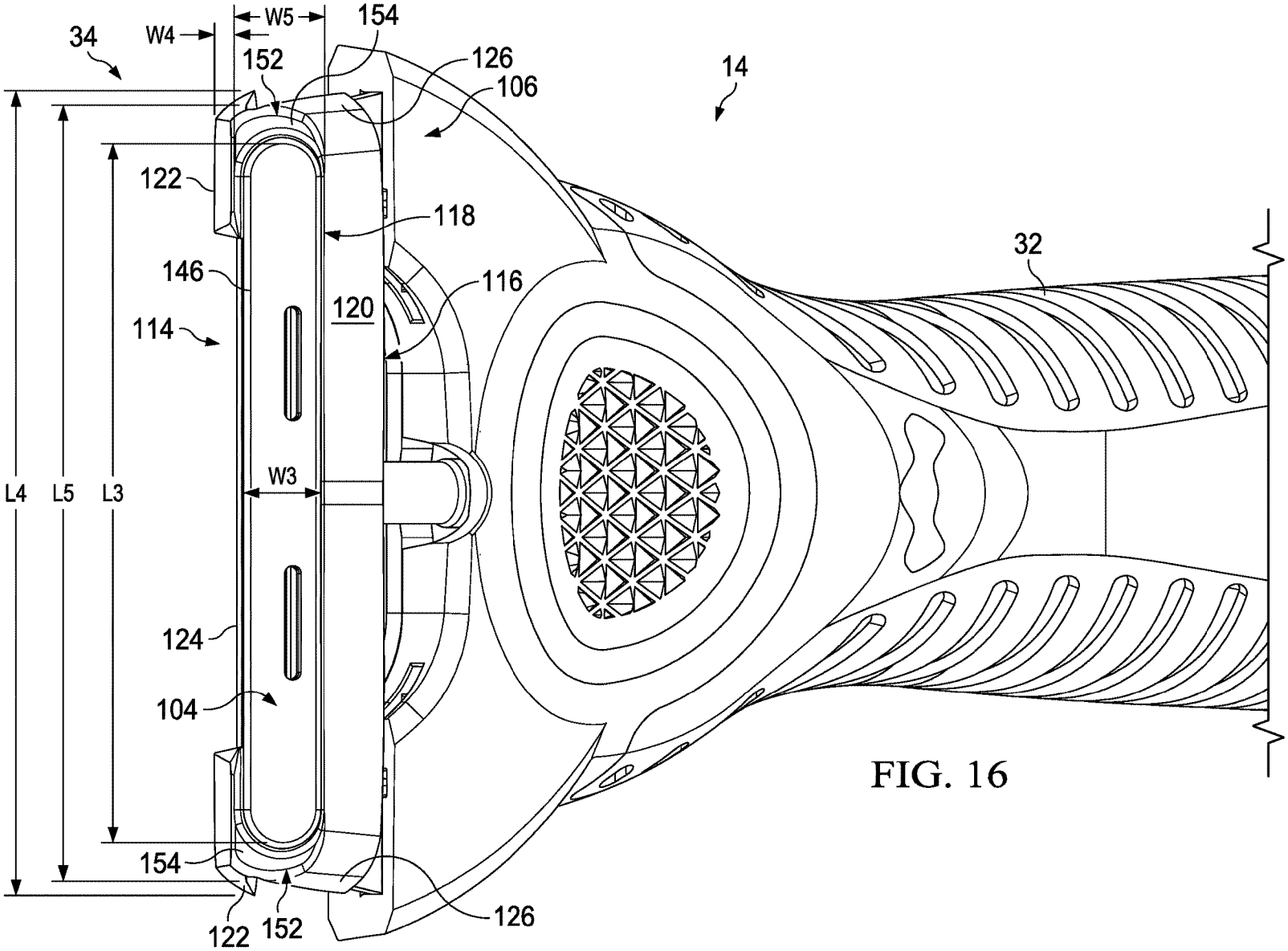
FIG. 16 is an exploded upper isometric view depicting the handle of FIG. 1.

Referring now to FIG. 16, the head portion 118 can have a length L3 that extends laterally along the pivoting head 34. The head portion 118 can also have a width W3 that extends longitudinally along the pivoting head 34. The length L3 and the width W3 of the head portion 118 can be slightly smaller than the length L2 and the width W2 of the upper opening 68 (FIG. 5) to allow the head portion 118 to fit within the upper opening 68 when the pivoting head 34 is installed in the handle receptacle 24.

Still referring to FIG. 16, the pivoting head 34 can comprise a pair of shoulder portions 152 that each extend laterally between the front wall 114, the rear wall 116, and the head portion 118 and are each disposed on opposite sides of the head portion 118. Each of the shoulder portions 152 comprise a shoulder surface 154 that interfaces with a portion of each of the front exterior surface 120, the side exterior surfaces 122, the rear exterior surface 124, the side exterior surfaces 126, and the exterior lip surface 146.

Referring now to FIGS. 12, 13 and 16, the overall shape of the pivoting head 34 will now be discussed. As illustrated in FIGS. 12 and 13, the front exterior surface 120 of the front wall 114 and the rear exterior surface 124 of the central portion 148 of the rear wall 116 can be tapered inwardly towards the head portion 118 such that the pivoting head 34 is generally funnel-shaped below the shoulder portions 152. In particular, as illustrated in FIG. 13, the front exterior surface 120 and the rear exterior surface 124 of the central portion 148 of the rear wall 116 can be angled relative to each other such that the planes P6, P7 intersect at an included angle $\alpha 3$ (any angle that is less than 180 degrees) to define the funnel-shape of the pivoting head 34. In one embodiment, the included angle $\alpha 2$ can be between about 30 degrees and 70 degrees, and preferably between about 45 degrees and about 48 degrees. The funnel-shape of the pivoting head 34 below the shoulder portions 152 can correspond to the funnel shape of the handle receptacle 24 such that the pivoting head 34 fits snugly in the handle receptacle 24 when the pivoting head 34 is inserted into the handle receptacle 24.

As illustrated in FIG. 16, the pivoting head 34 can have a lower length L4 at the lower end 106 that extends laterally and is defined by the front wall 114 and the rear wall 116. The pivoting head 34 can also have a lower width W4 at the lower end 106 that extends longitudinally and is defined by the front wall 114 and the rear wall 116. The pivoting head 34 can have an upper length L5 at the upper end 104 that extends laterally and is defined by the front wall 114 and the rear wall 116. The pivoting head 34 can also have an upper width W5 at the upper end 104 that extends longitudinally and is defined by the front wall 114 and the rear wall 116.

The lower end 106 of the pivoting head 34 can generally be larger than the upper end 104. In particular, the lower length L4 and the lower width W4 of the pivoting head 34 at the lower end 106 can be longer and wider, respectively, than the upper length L5 and the upper width W5 of the pivoting head 34 at the upper end 104. In one embodiment, the lower length L4 can be between about 25 mm and about 55 mm, and preferably about 35 mm, and the lower width W4 can be between about 3 mm and about 8 mm, and preferably about 3.9 mm. In one embodiment, the upper length L5 can be between about 20 mm and about 40 mm, and preferably about 30 mm, and the upper width W5 can be between about 1 mm and about 6 mm, and preferably about 3.4 mm.

Figure 17:
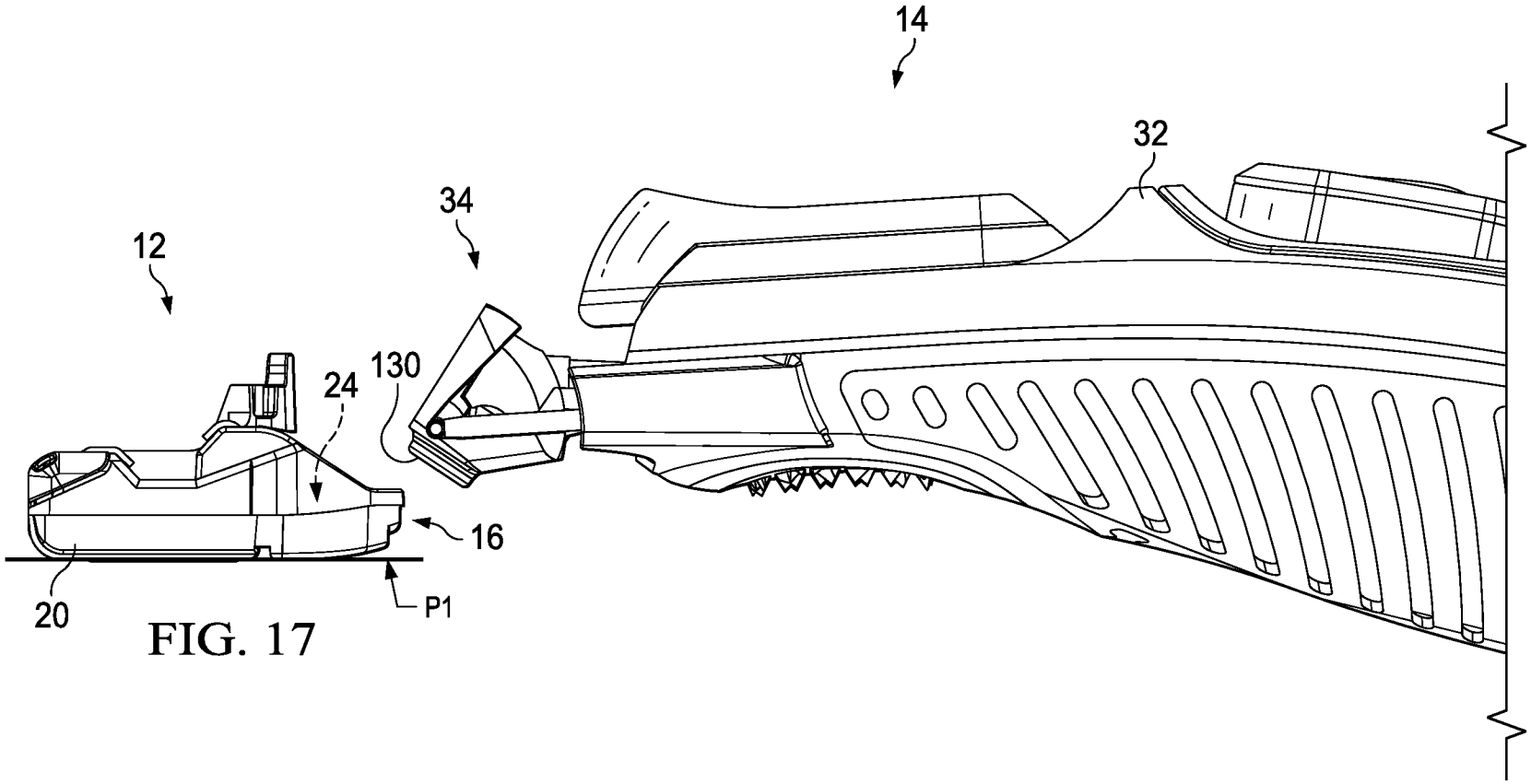
FIG. 17 is a partially exploded side view depicting the shaving system of FIG. 1 with a pivoting head of the handle and the cartridge spaced from each other.
Figure 18:
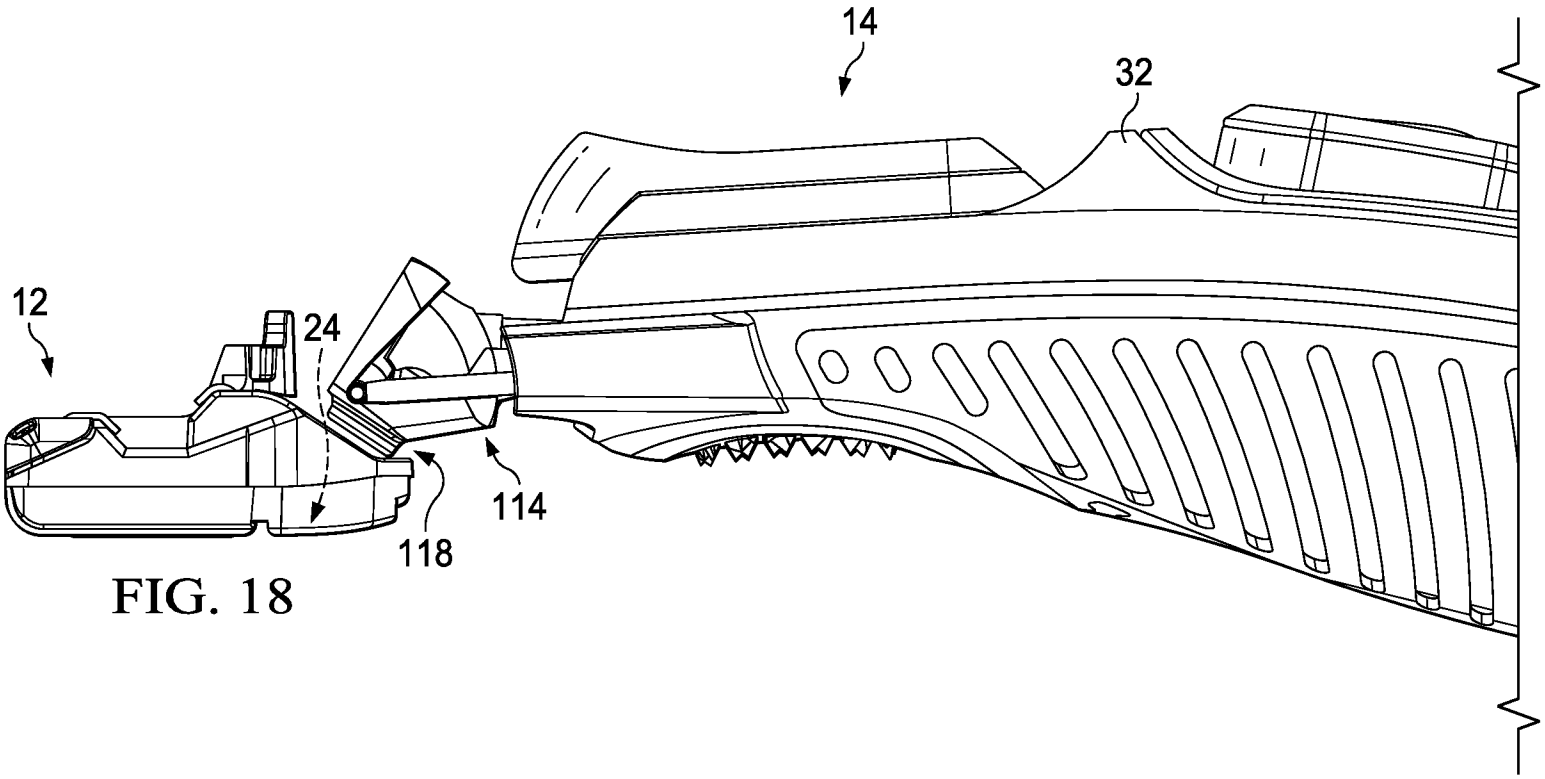
FIG. 18 is a partially exploded side view depicting the shaving system of FIG. 17 but with the pivoting head shown more proximate to the cartridge than in FIG. 17.
Figure 19:
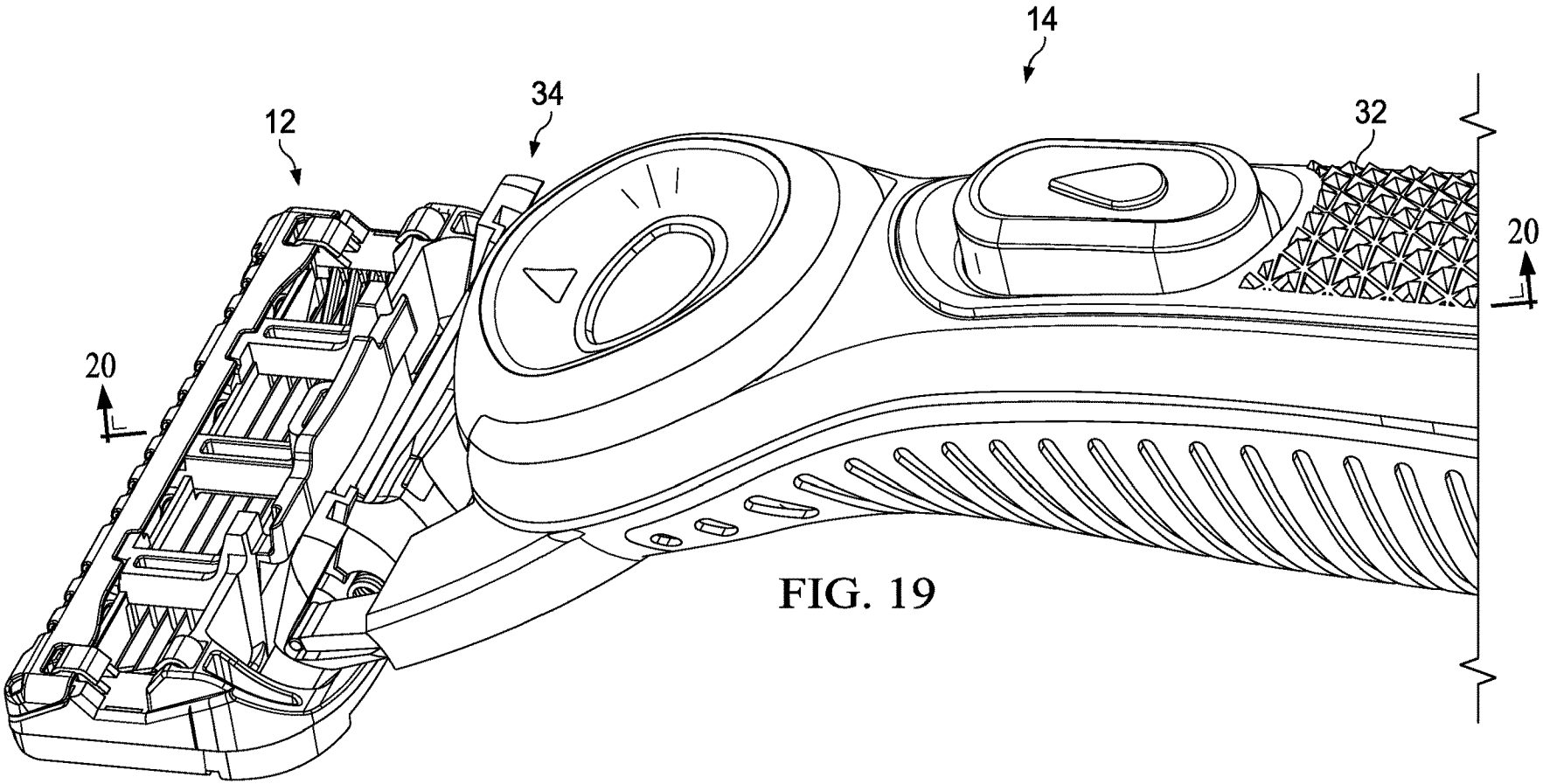
FIG. 19 is a lower side isometric view depicting the shaving system of FIG. 18.
Figure 20:
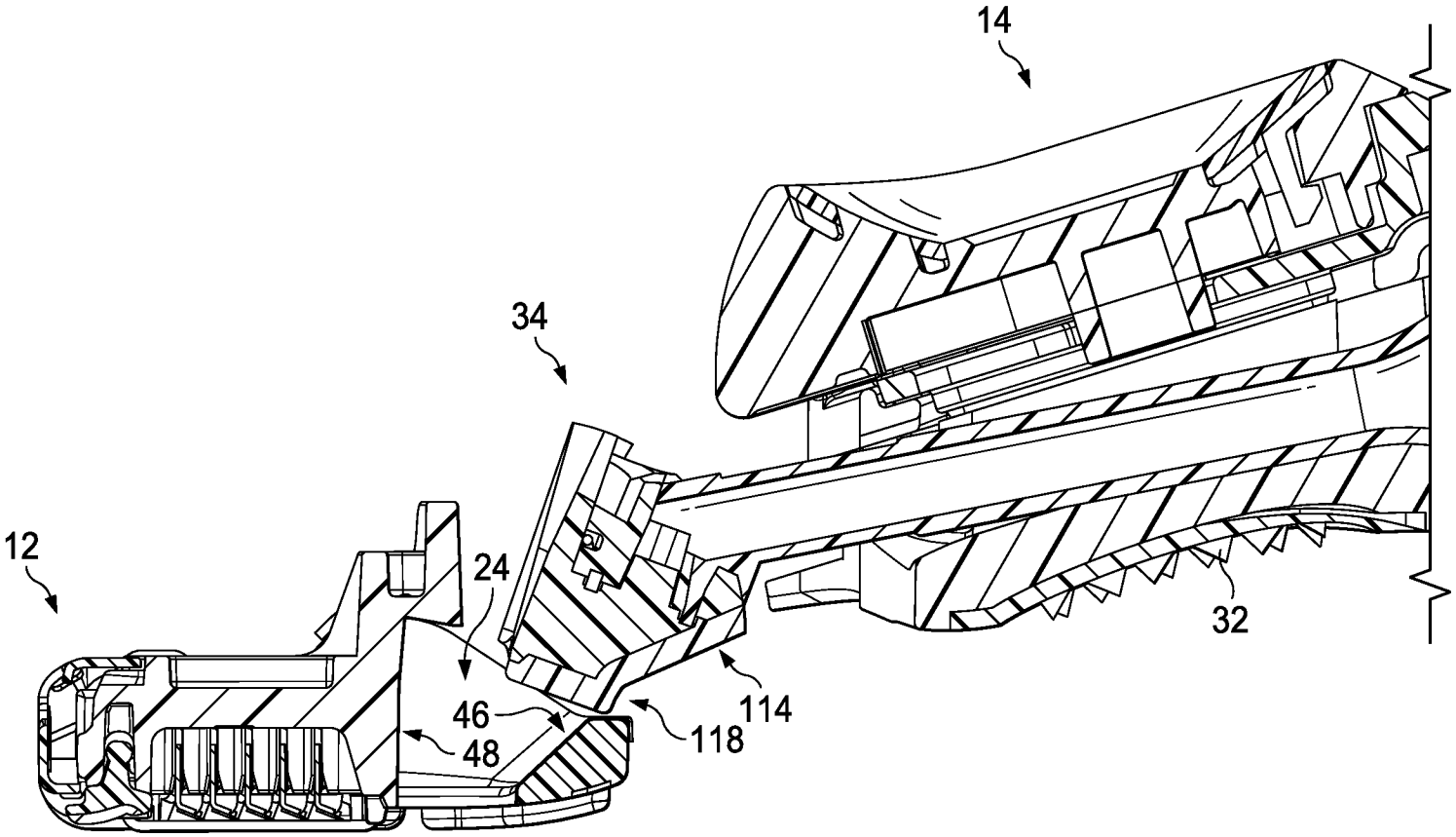
FIG. 20 is a cross-sectional view taken along the line 20-20 of FIG. 19.

Referring now to FIGS. 17-32, the process of inserting the pivoting head 34 into the handle receptacle 24 to facilitate coupling of the handle 14 to the cartridge 12 will now be discussed. As illustrated in FIG. 17, the handle 14 can be positioned with the pivoting head 34 adjacent to the front end 16 of the housing 20 and with the pivoting head 34 tilted downwardly such that the face surface 130 is angled relative to the shaving plane P1. In one embodiment, the main body 32 of the handle 14 can be laid substantially flat (e.g., substantially parallel to the shaving plane P1) to provide the pivoting head 34 in such a position. As illustrated in FIGS. 18-20, the handle 14 can then be moved towards the cartridge 12 proximate the handle receptacle 24. As described above with respect to FIG. 6, the vertical height H1 of the front wall 46 can be shorter than the vertical height H2 of the rear wall 48. As such, the front wall 46 can provide sufficient clearance for inserting the pivoting head 34 into the handle receptacle 24 from the front of the cartridge 12. For example, as illustrated in FIG. 20, the pivoting head 34 can pass over the front wall 46 and into the handle receptacle 24 while remaining spaced from the rest of the cartridge 12 (e.g., the locking member 88).

Figure 21:
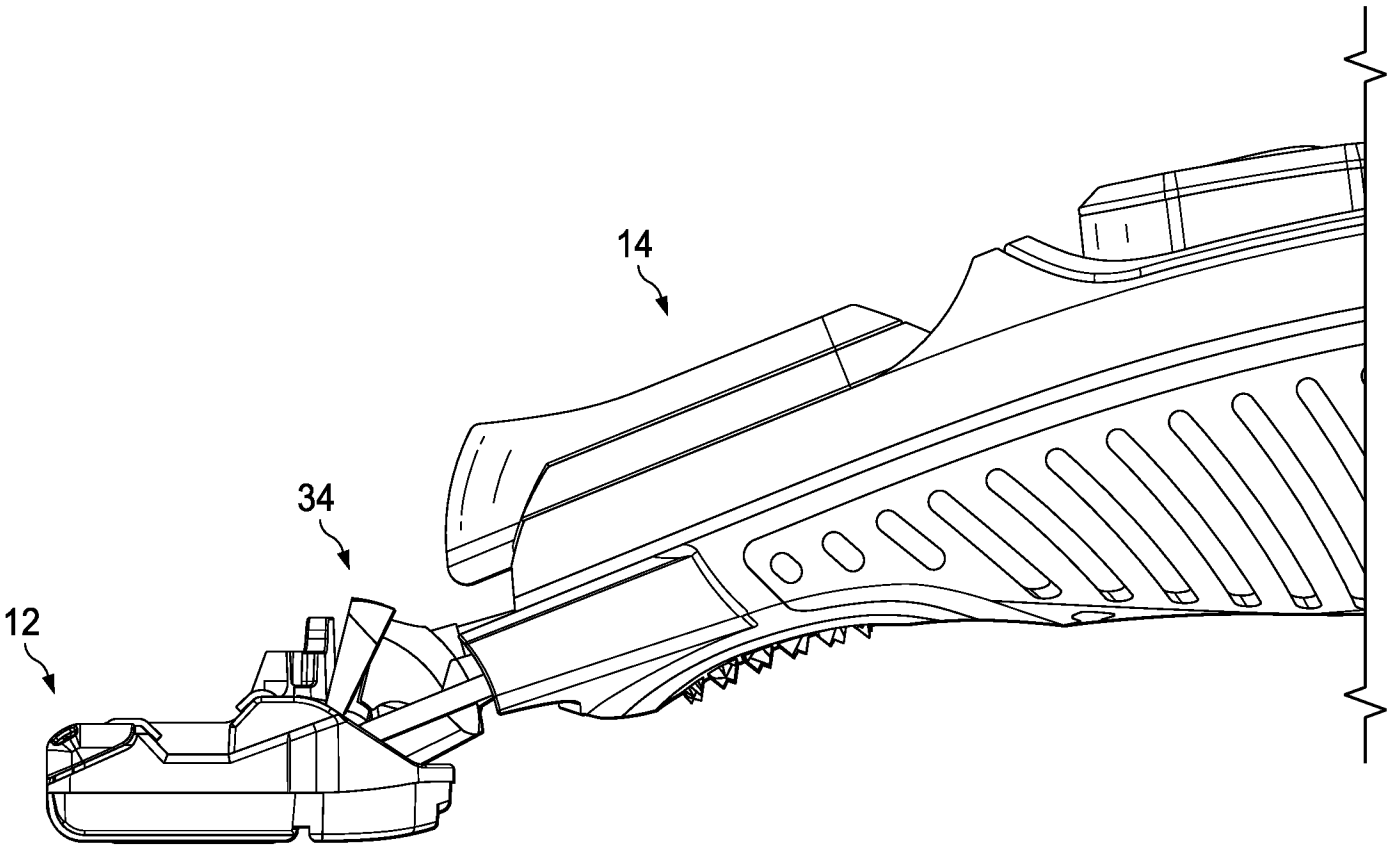
FIG. 21 is a partially exploded side view depicting the shaving system of FIG. 18 with the pivoting head shown being inserted into a handle receptacle of the cartridge.
Figure 22:
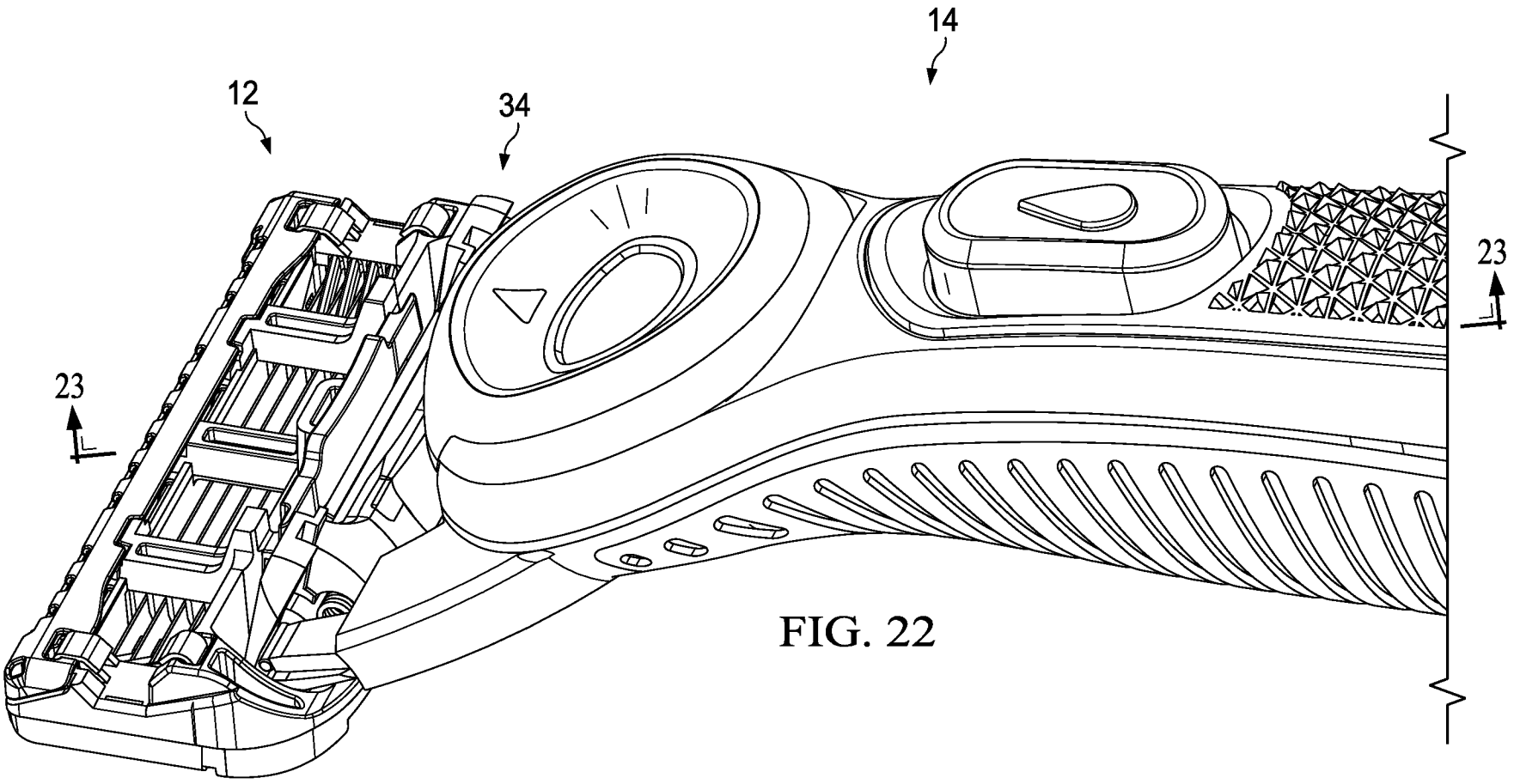
FIG. 22 is a lower side isometric view depicting the shaving system of FIG. 21.
Figure 23:
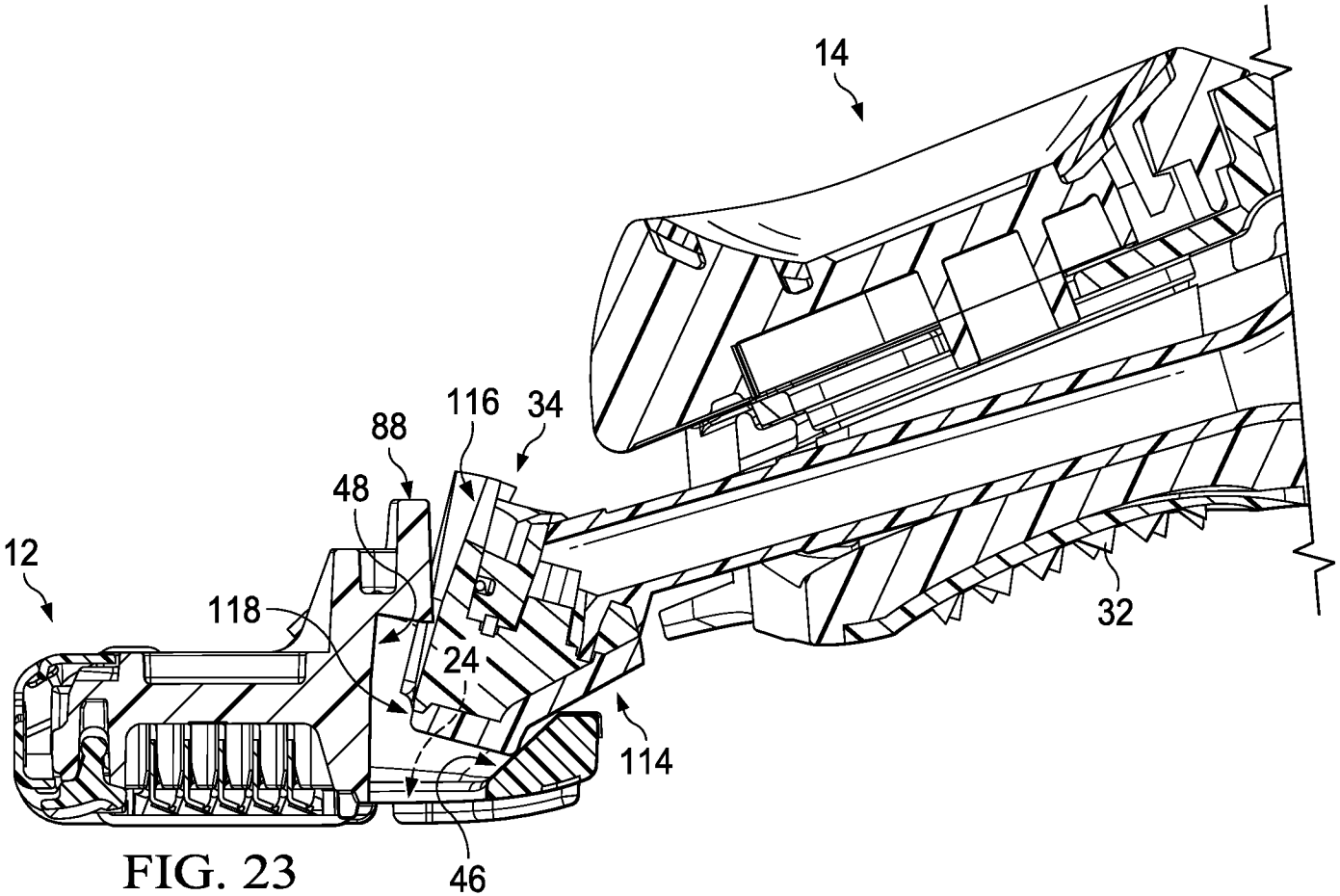
FIG. 23 is a cross-sectional view taken along the line 23-23 of FIG. 22.

As illustrated in FIGS. 21-23, the handle 14 can then be moved further towards the cartridge 12 and pivoted slightly upwardly to further insert the pivoting head 34 into the handle receptacle 24 (FIG. 23). The front wall 114 and the head portion 118 of the pivoting head 34 are shown in FIG. 23 to contact the front wall 46 to facilitate guiding of the pivoting head 34 into the handle receptacle 24. It is to be appreciated that the rear wall 116 can alternatively contact the locking member 88 to facilitate guidance of the pivoting head 34 into the handle receptacle 24. It is also to be appreciated that the side exterior surfaces 122, 126 of the front wall 114 and the rear wall 116 (shown in FIG. 16), respectively, can additionally contact the sidewalls 50 (FIG. 4) to facilitate further guidance of the pivoting head 34 into the handle receptacle 24. As the handle 14 continues to be moved further towards the cartridge 12 and pivoted slightly upwardly, the pivoting head 34 can eventually contact each of the front wall 46 and the rear wall 48, as illustrated in FIGS. 24-26.

Figure 24:
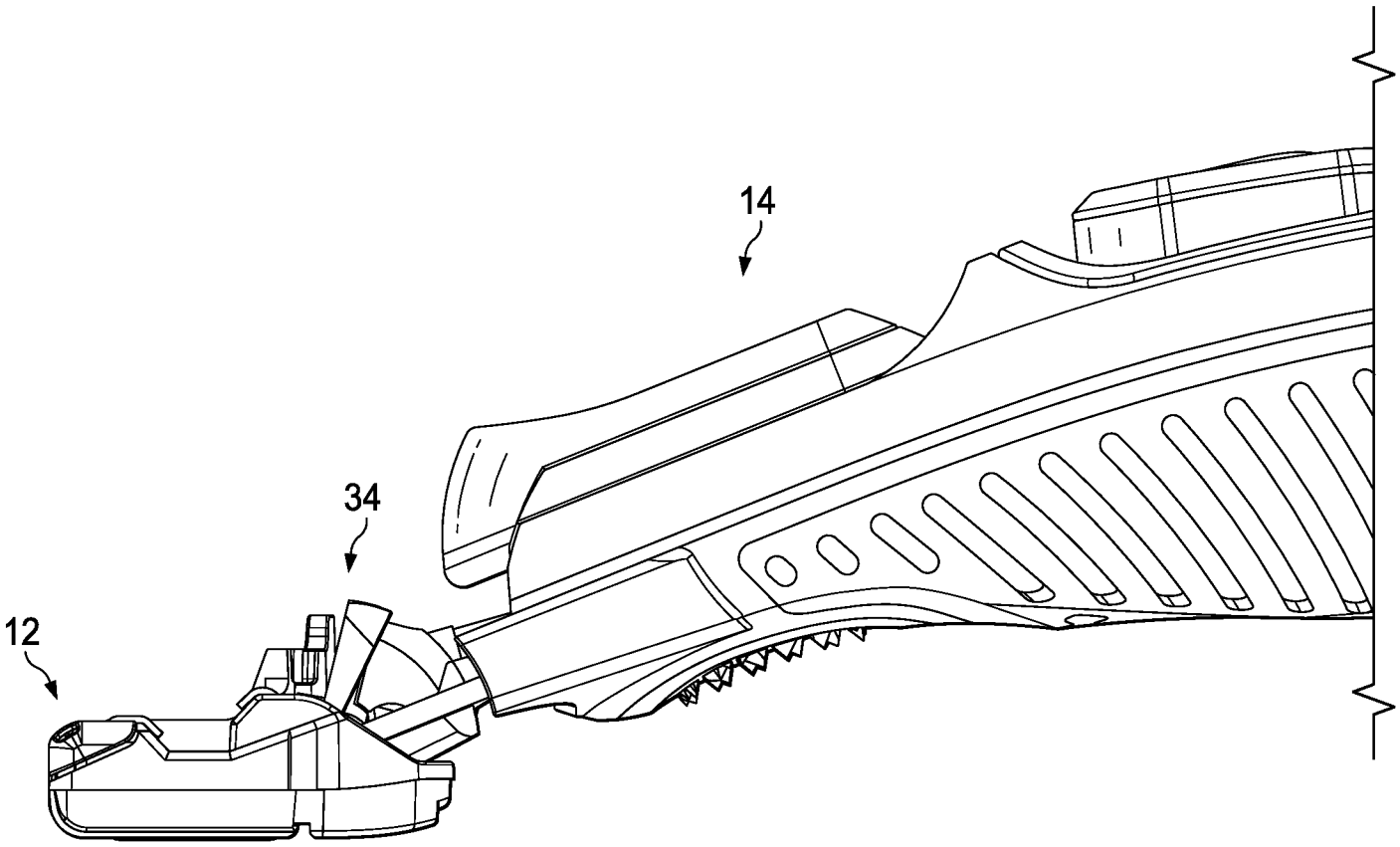
FIG. 24 is a partially exploded side view depicting the shaving system of FIG. 21 but with the pivoting head shown further inserted into the handle receptacle of the cartridge.
Figure 25:
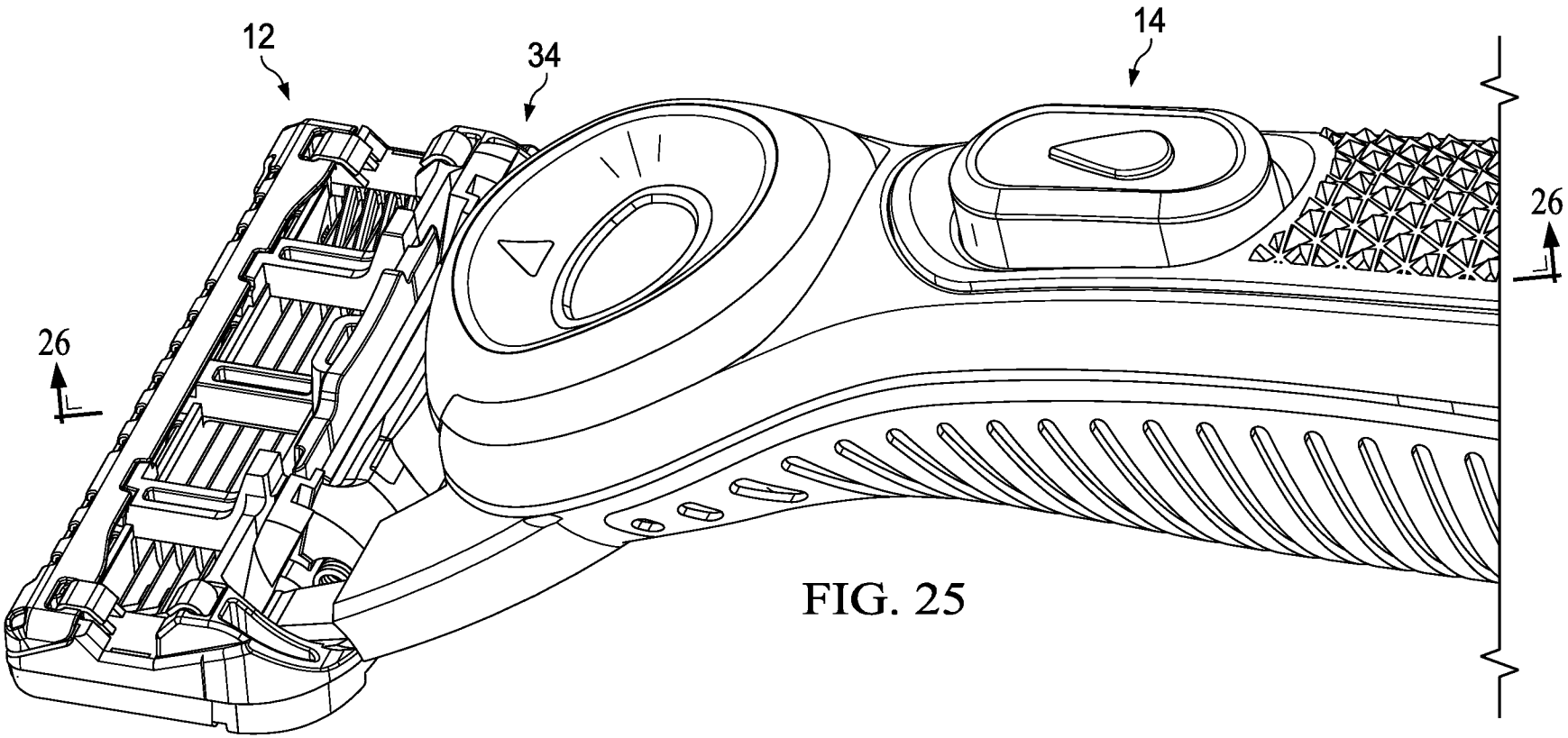
FIG. 25 is a lower side isometric view depicting the shaving system of FIG. 24.
Figure 26:
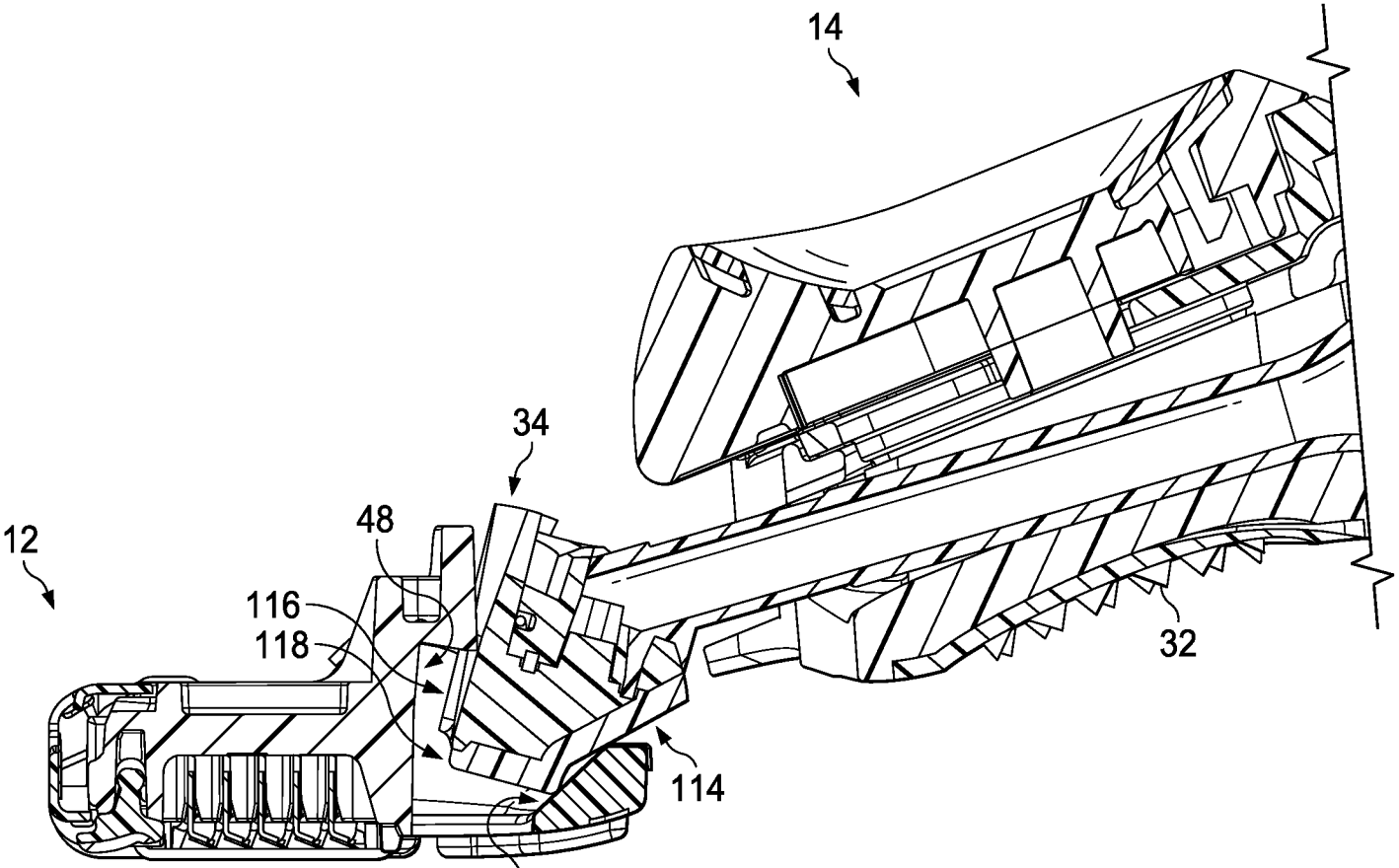
FIG. 26 is a cross-sectional view taken along the line 26-26 of FIG. 25.
Figure 27:
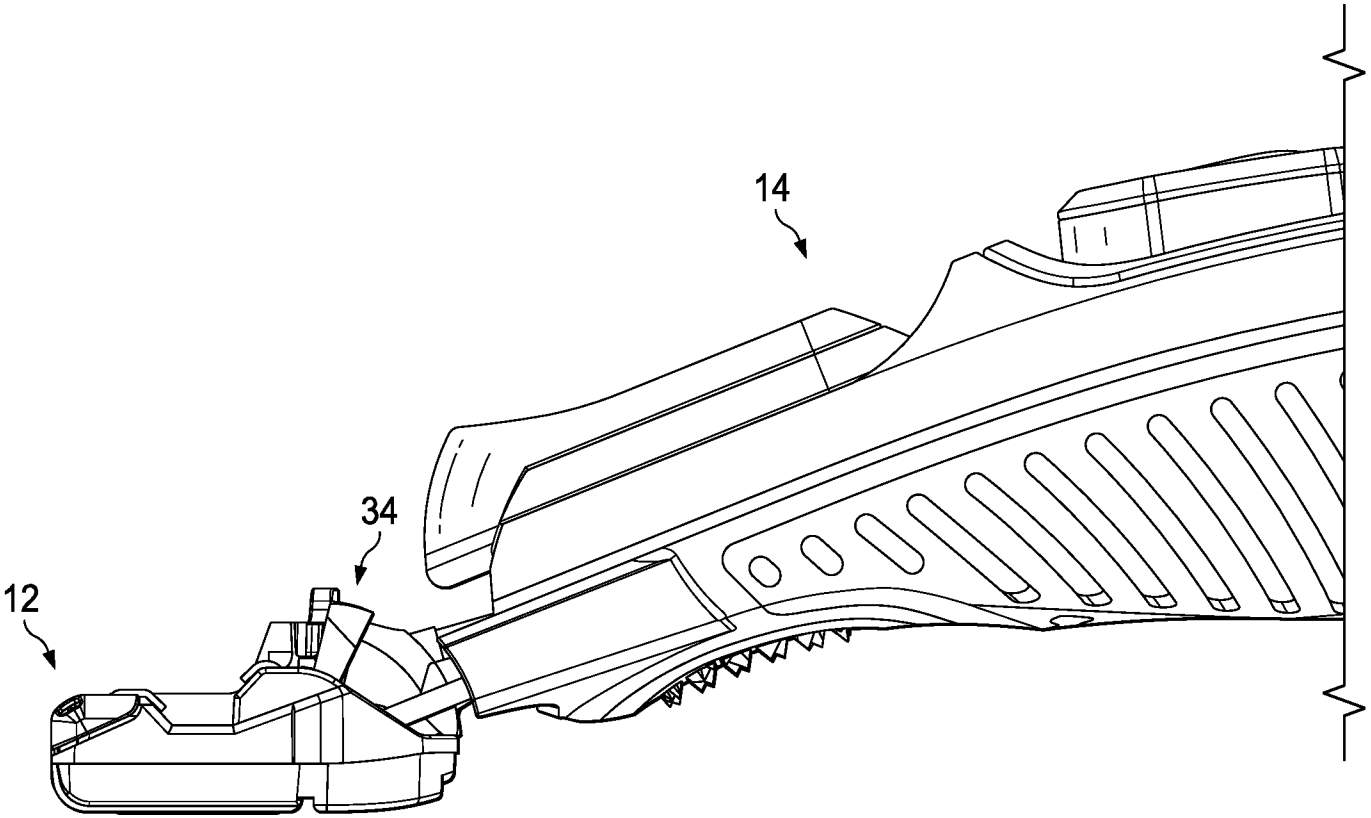
FIG. 27 is a partially exploded side view depicting the shaving system of FIG. 26 but with the pivoting head shown further inserted into the handle receptacle of the cartridge.
Figure 28:
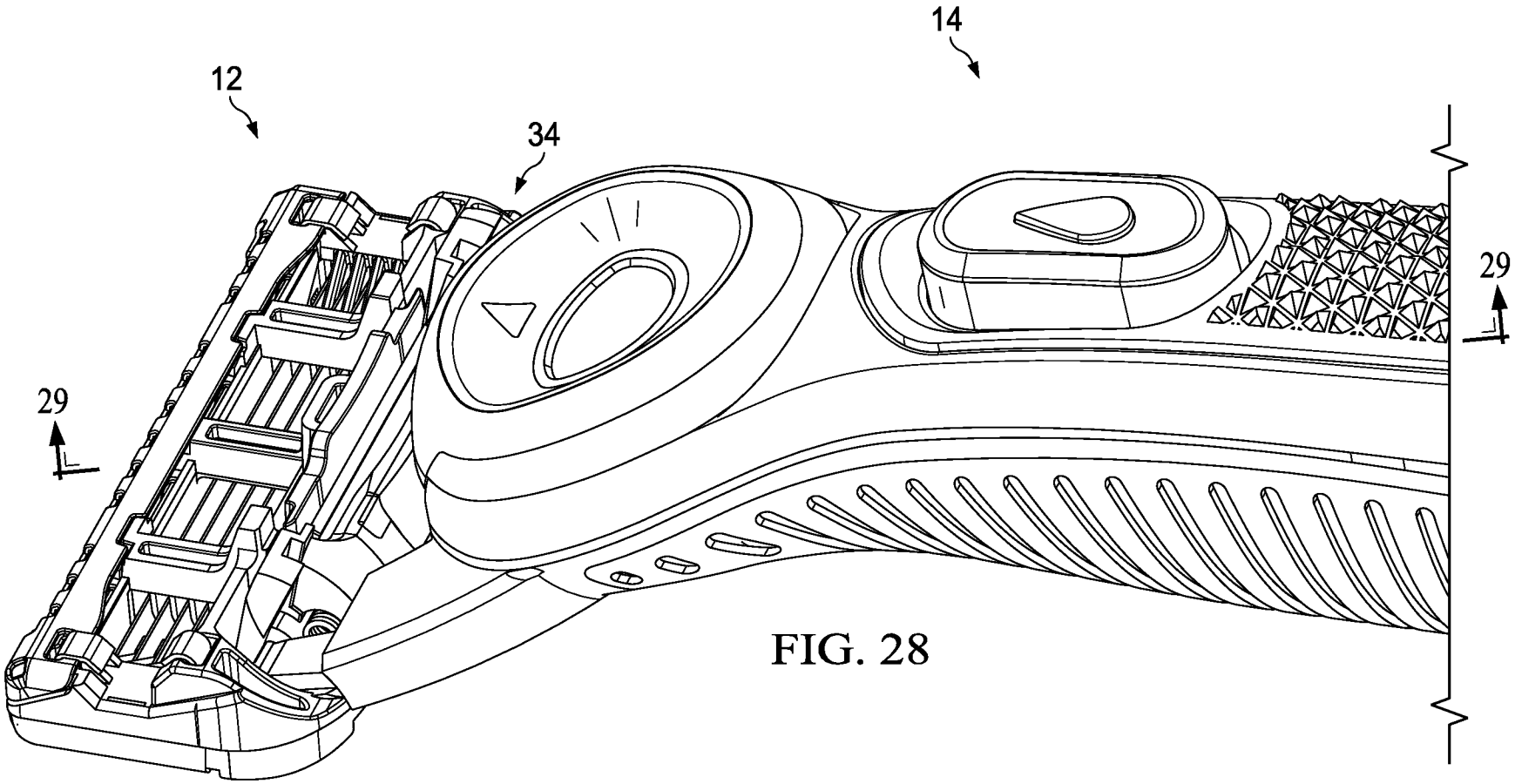
FIG. 28 is a lower side isometric view depicting the shaving system of FIG. 27.
Figure 29:
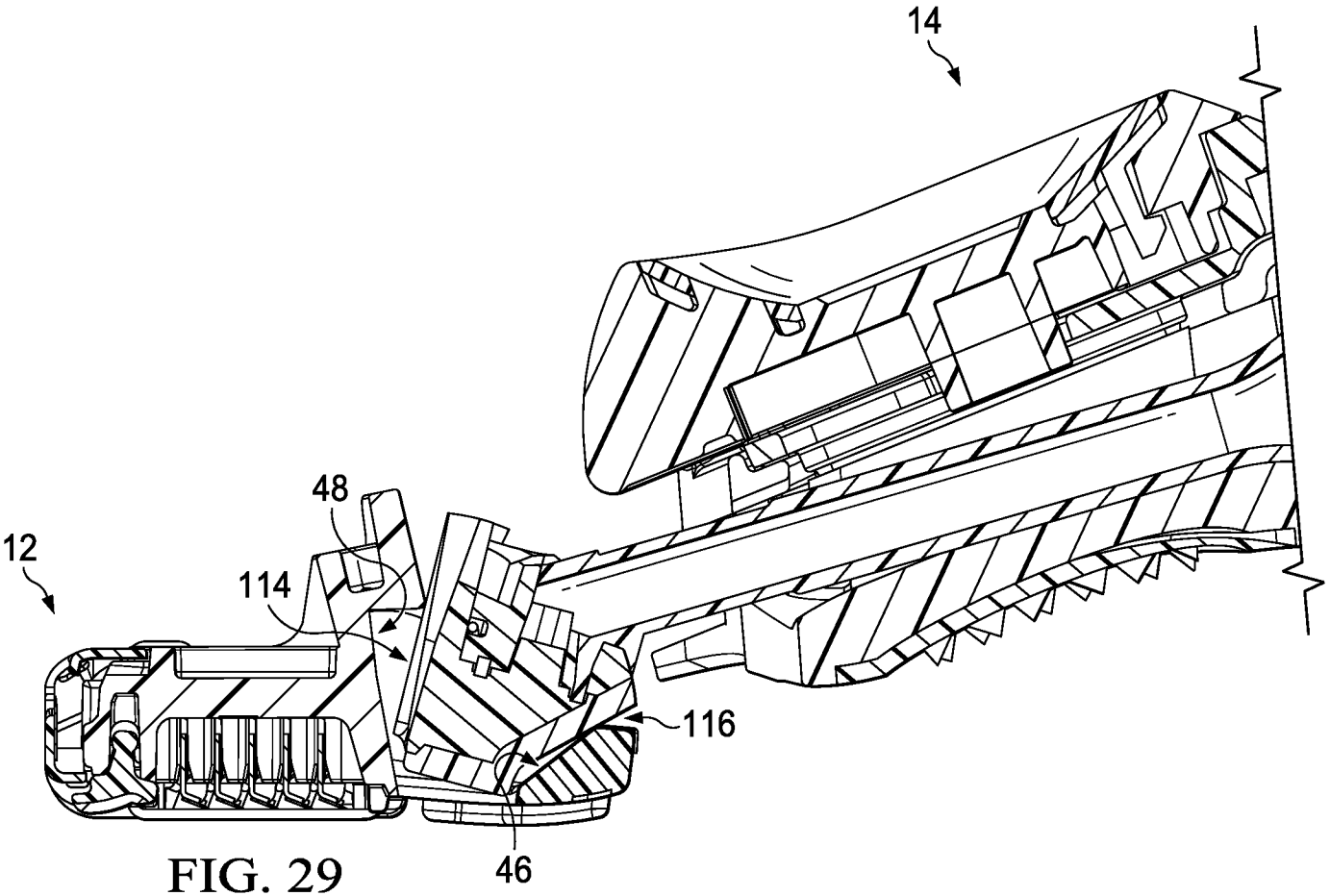
FIG. 29 is a cross-sectional view taken along the line 29-29 of FIG. 28.

As the pivoting head 34 is further inserted into the handle receptacle 24 (e.g., by continuing to move the handle 14 further towards the cartridge 12 and/or by pivoting the handle 14 further upwardly) from the position illustrated in FIGS. 24-26, the front wall 46 and the rear wall 48 can deflect, as illustrated in FIGS. 27-29. The deflection of the front and rear walls 46, 48 can be facilitated by the flexibility of the front and rear corners 84, 86 (FIG. 7) described above. It is to be appreciated that although both the front and rear walls 46, 48 are shown to deflect, only one of the front wall 46 or the rear wall 48 might deflect to allow for insertion of the pivoting head 34 into the handle receptacle 24.

Figure 30:
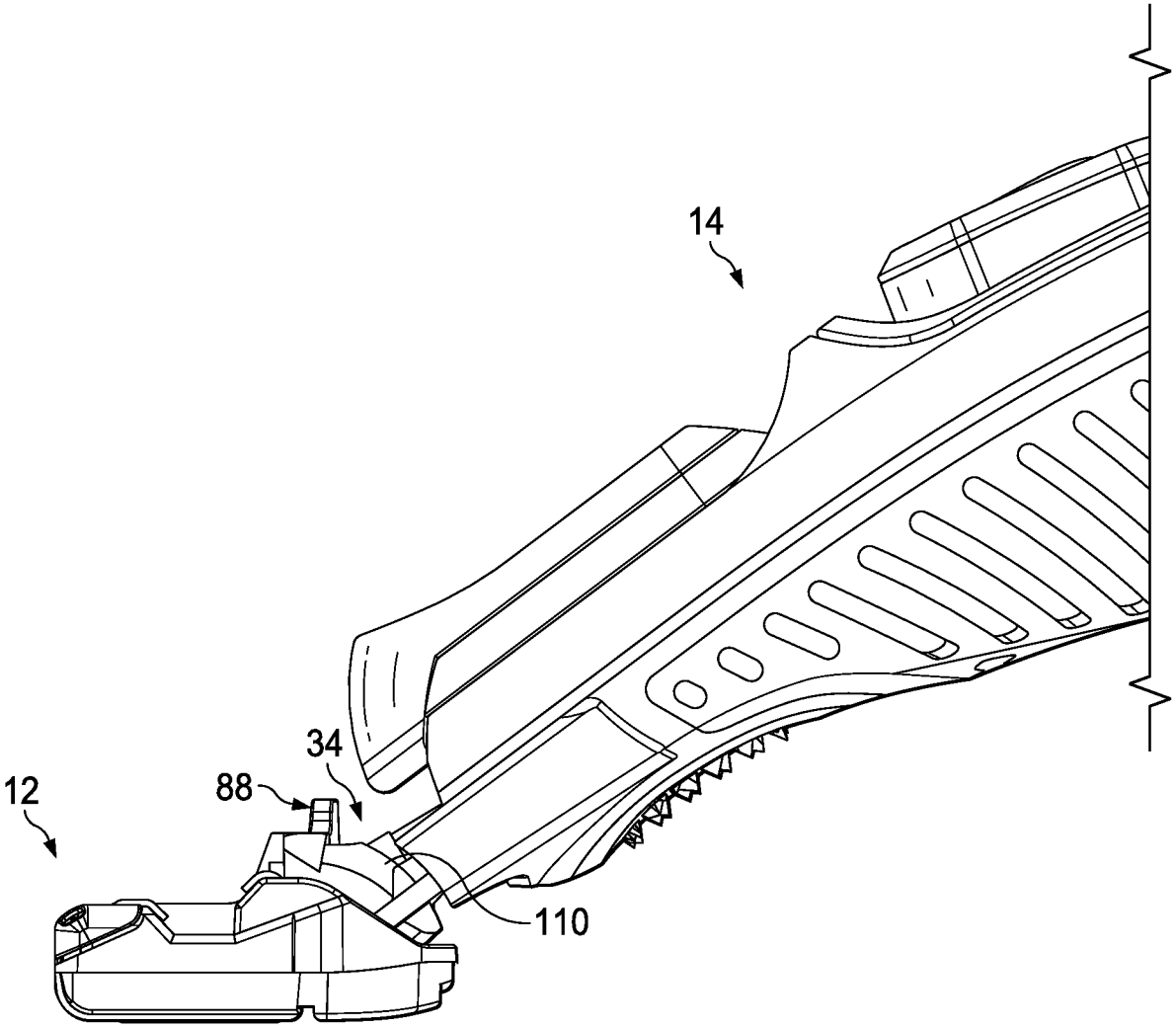
FIG. 30 is a partially exploded side view depicting the shaving system of FIG. 27 but with the pivoting head shown fully installed into the handle receptacle of the cartridge.
Figure 31:
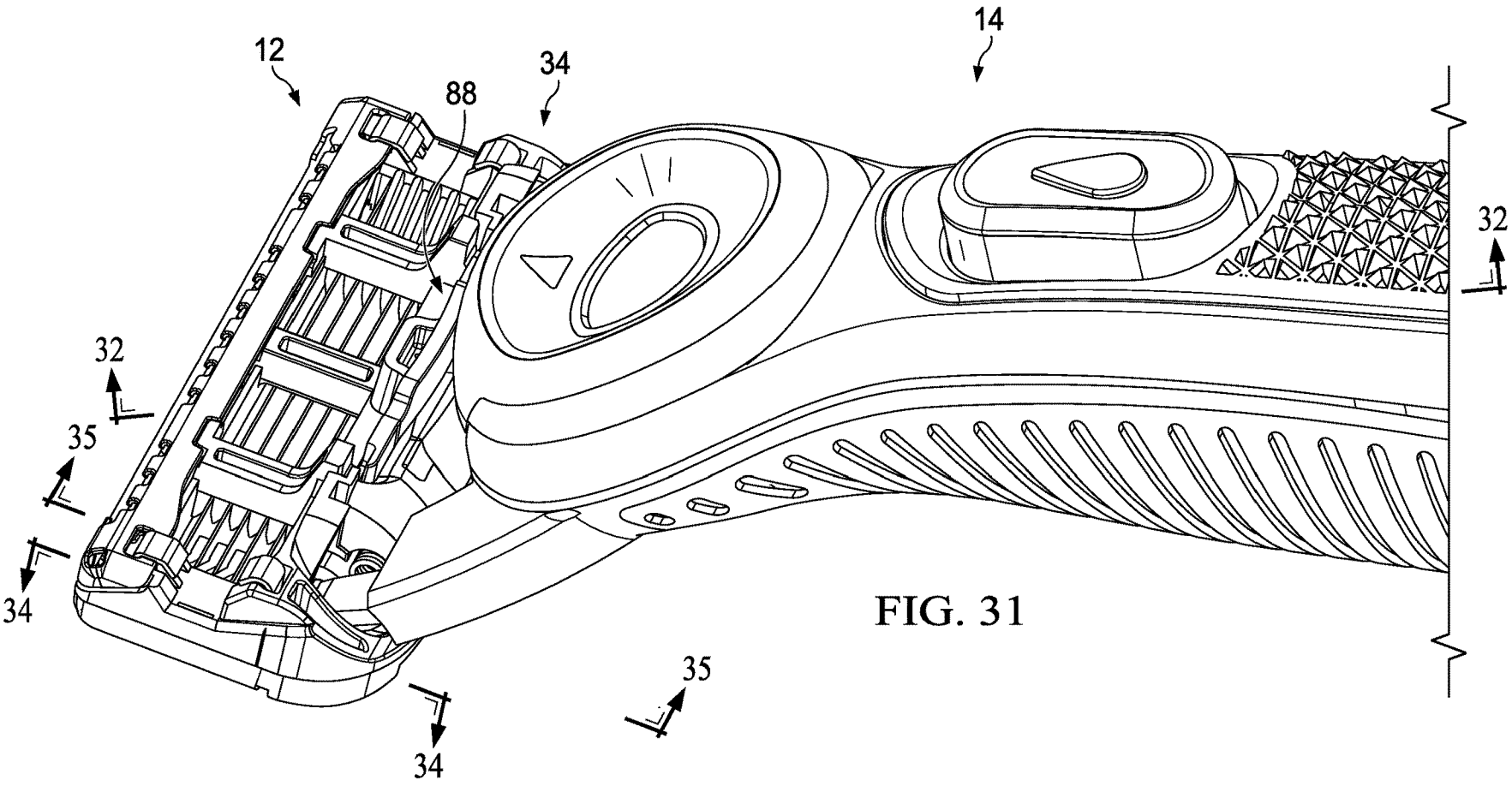
FIG. 31 is a lower side isometric view depicting the shaving system of FIG. 30.
Figure 32:
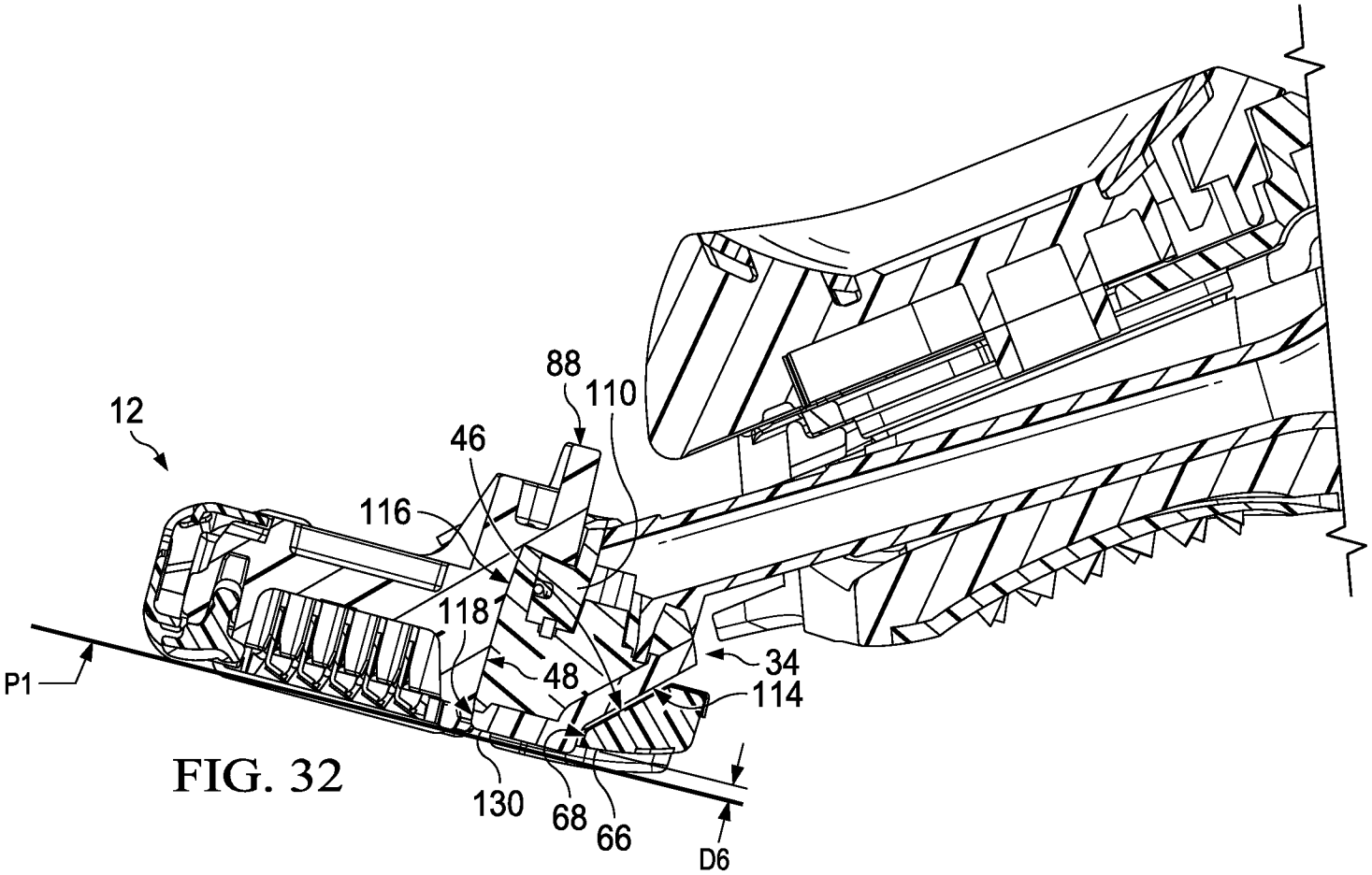
FIG. 32 is a cross-sectional view taken along the line 32-32 of FIG. 31.

The pivoting head 34 can be further inserted into the handle receptacle 24 (e.g., by continuing to move the handle 14 further towards the cartridge 12 and/or by pivoting the handle 14 further upwardly) until the pivoting head 34 is fully installed in the handle receptacle 24, as illustrated in FIGS. 30-32. As illustrated in FIG. 32, when the pivoting head 34 is fully installed in the handle receptacle 24 (FIG. 17), the front and rear walls 46, 48 are no longer deflected and the locking member 88 overhangs the rear wall 116 and a portion of the cover member 110. The angle $\alpha 2$ (FIG. 6) of the locking member 88 can effectively angle the locking member 88 towards the pivoting head 34. The portions of the cover member 110 and the rear wall 116 that are disposed above the locking member 88 can have an angled shape that corresponds with the angle $\alpha 2$ of the locking member 88. The angle $\alpha 2$ of the locking member 88 can effectively enhance the securement of the pivoting head 34 within the handle receptacle 24 by discouraging inadvertent separation of the cartridge 12 from the handle 14. The angle $\alpha 2$ of the locking member 88 can also facilitate effective retention of the pivoting head 34 to the cartridge 12 when the trimmer assembly 40 is used to shave a user's skin.

It is to be appreciated that the cartridge 12 does not comprise a pivot mechanism in and of itself. Also, the interface between the cartridge 12 and the handle 14 does not comprise a pivot mechanism in and of itself. However, when the cartridge 12 is connected to the handle 14 via the pivoting head 34, the pivoting head 34 and the cartridge 12 are selectively locked together and while they do not pivot relative to one another, they pivot together relative to the handle 14 about the pivot axis A1 (FIG. 11).

The overall funnel-shape of the handle receptacle 24 described above can correspond to the trapezoidal prism-shape of the pivoting head 34 described above such that pivoting head 34 nests within the handle receptacle 24 when fully installed. For example, as illustrated in FIG. 32, the front and rear walls 114, 116 of the pivoting head 34 can be seated against the front and rear walls 46, 48 of the cartridge 12, respectively. In addition, although not shown in FIGS. 30-32, the side exterior surfaces 122, 126 of the front and rear walls 114, 116 (FIG. 16), respectively, can be seated against the sidewalls 50. Such nesting of the pivoting head 34 within the handle receptacle 24 can enhance the securement of the pivoting head 34 to the cartridge 12 to inhibit any undesired movement therebetween during shaving. In particular, the relative shapes of the handle receptacle 24 and the pivoting head 34 can result in a tight fit between the cartridge 12 and the pivoting head 34 which can provide smaller gaps between the cartridge 12 and the pivoting head 34 by virtually eliminating the small radii and abrupt corners that are difficult to manufacture in the mating surfaces of two components. These smaller gaps provide for a more comfortable skin contacting surface during shaving by preventing areas where hair or other shave debris can be trapped, especially around tight places, such as the neck and underarms.

Still referring to FIG. 32, the head portion 118 of the pivoting head 34 can project at least partially into the upper opening 68 such that the head portion 118 is exposed at the upper surface 66 and to a user's skin at the shaving plane P1. When a user shaves with the shaving system 10, the head portion 118 can contact the user's skin to distribute any shaving fluid dispensed from the apertures 132 (FIG. 12) to the user's skin ahead of the razor blades 28. As the user pulls the cartridge 12 across their skin, the shaving fluid can accordingly lubricate the skin prior to being shaved by the razor blades 28. The shaving system 10 can accordingly be configured to deliver benefits (e.g., lubrication) to the user's skin by extending the head portion 118 of the pivoting head 34 through the upper opening 68 (FIG. 5).

In one embodiment, the head portion 118 can project through the upper opening 68 such that the face surface 130 protrudes from the upper surface 66 and is spaced from the upper surface 66 by a vertical distance D6. In the example shown in FIG. 32, the vertical distance D6 can be substantially similar to the vertical distance D1 described above with respect to FIG. 6 such that the face surface 130 extends along the shaving plane P1. In such an arrangement, the vertical distance D6 can be between about 0.25 mm and about 1 mm, and preferably about 0.5 mm. However, the vertical distance D6 can be selected to be greater than or less than the vertical distance D1 such that the face surface 130 is disposed respectively above or below the shaving plane P1. In another embodiment, the head portion 118 of the pivoting head 34 can project into the upper opening 68 such that the face surface 130 is substantially flush with the upper surface 66. In yet another embodiment, the head portion 118 of the pivoting head 34 can project partially into the upper opening 68 such that the head portion 118 is recessed within the upper opening 68.

It is to be appreciated that location of the face surface 130 relative to the shaving plane P1 can be determined by the relative distance D2 (FIG. 6) between the shoulder surface 72 and the shaving plane P1 and the vertical height H3 (FIG. 13) of the head portion 118.

Figure 33:
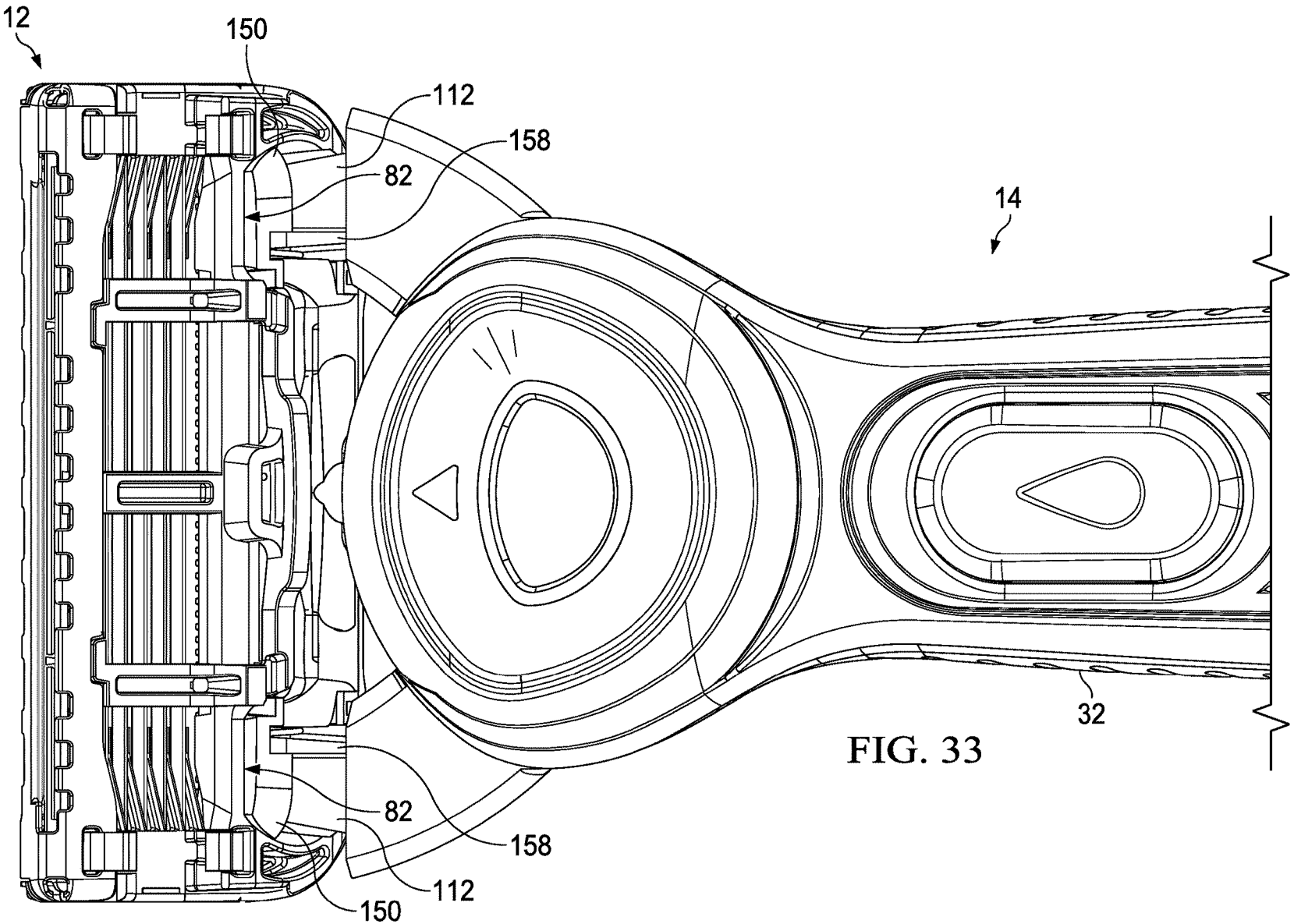
FIG. 33 is a lower plane view depicting the shaving system of FIG. 27.

Referring now to FIGS. 33 and 34, when the pivoting head 34 is fully installed in the handle receptacle 24 (as illustrated in FIGS. 30-32), the rear wall 116 of the pivoting head 34 can be seated against the rear wall 48 of the cartridge 12 such that the tab members 150 of the pivoting head 34 extend into respective ones of the notches 82 of the rear wall 48. As illustrated in FIG. 34, the tab members 150 can each define a length L6 and the pin members 113 can each define a length L7 that is less than the length L6 of the tab members 150. The pin members 113 can be spaced from each other by a distance D7. The central portion 148 of the rear wall 116 can have a length L8 that extends laterally and is less than the distance D7. The pin members 113 of the arms 112 can be disposed within respective ones of the tab members 150 which can allow the pin members 113 to be located nearer to the blade support portion 26 than would be possible at the central portion 148 of the rear wall 116.

Figure 35:
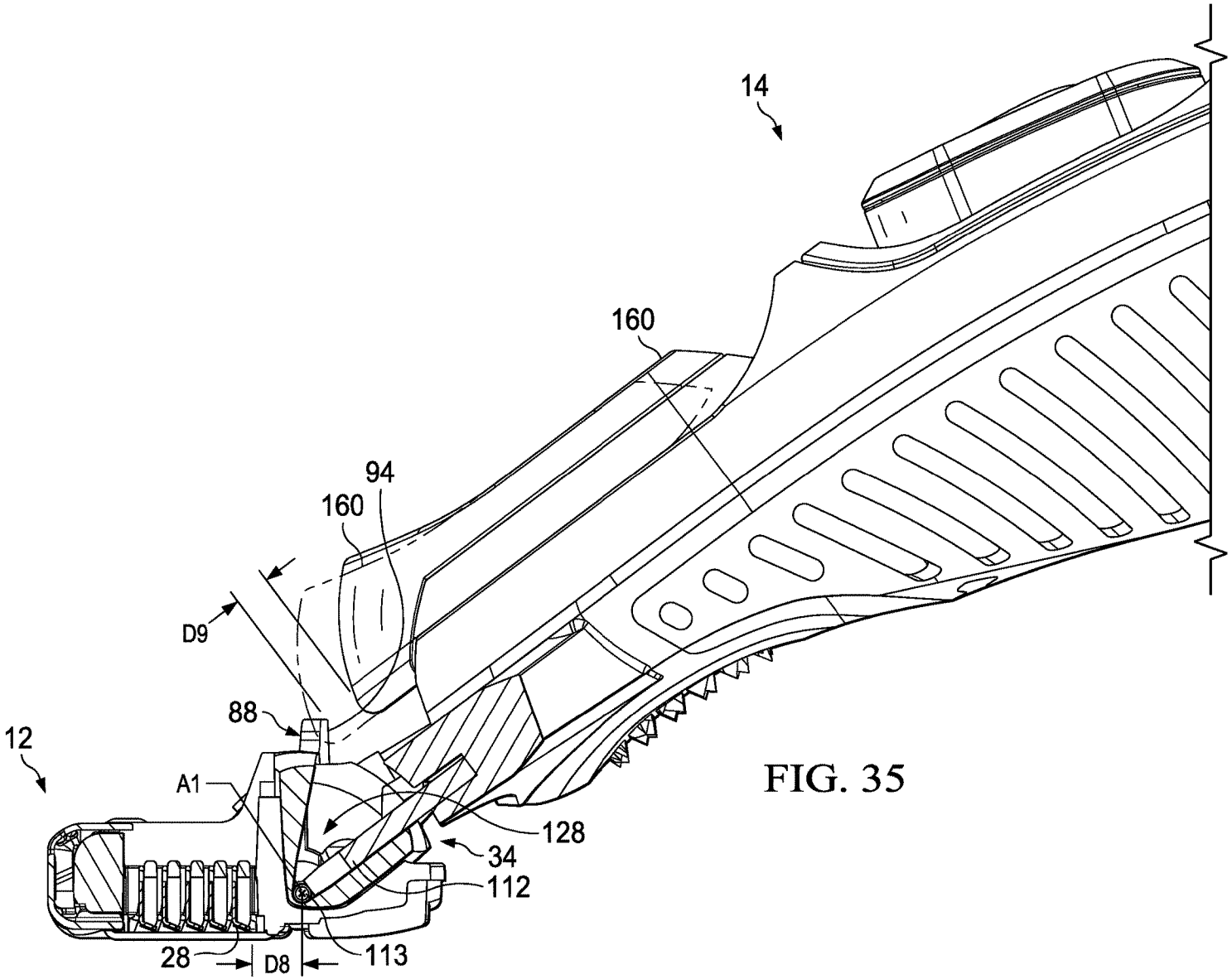
FIG. 35 is a cross-sectional view taken along the line 35-35 of FIG. 31.

Referring now to FIG. 35, the pivot axis A1 defined by the pin members 113 can be spaced from the nearest razor blade 28 by a distance D8 which can be less than conventional arrangements and without sacrificing the structural integrity achieved by those conventional arrangements. In addition, the location of the pivot axis A1 relatively close to the nearest shaving blade 28 can allow the cartridge 12 to follow the skin more closely during a shave stroke and with less blade tip pressure thereby providing a smoother, more comfortable, and more effective shave. In one embodiment, the distance D8 can be between about 0.7 mm and about 2.5 mm and preferably about 2.0 mm and more preferably about 1.5 mm.

Figure 36:
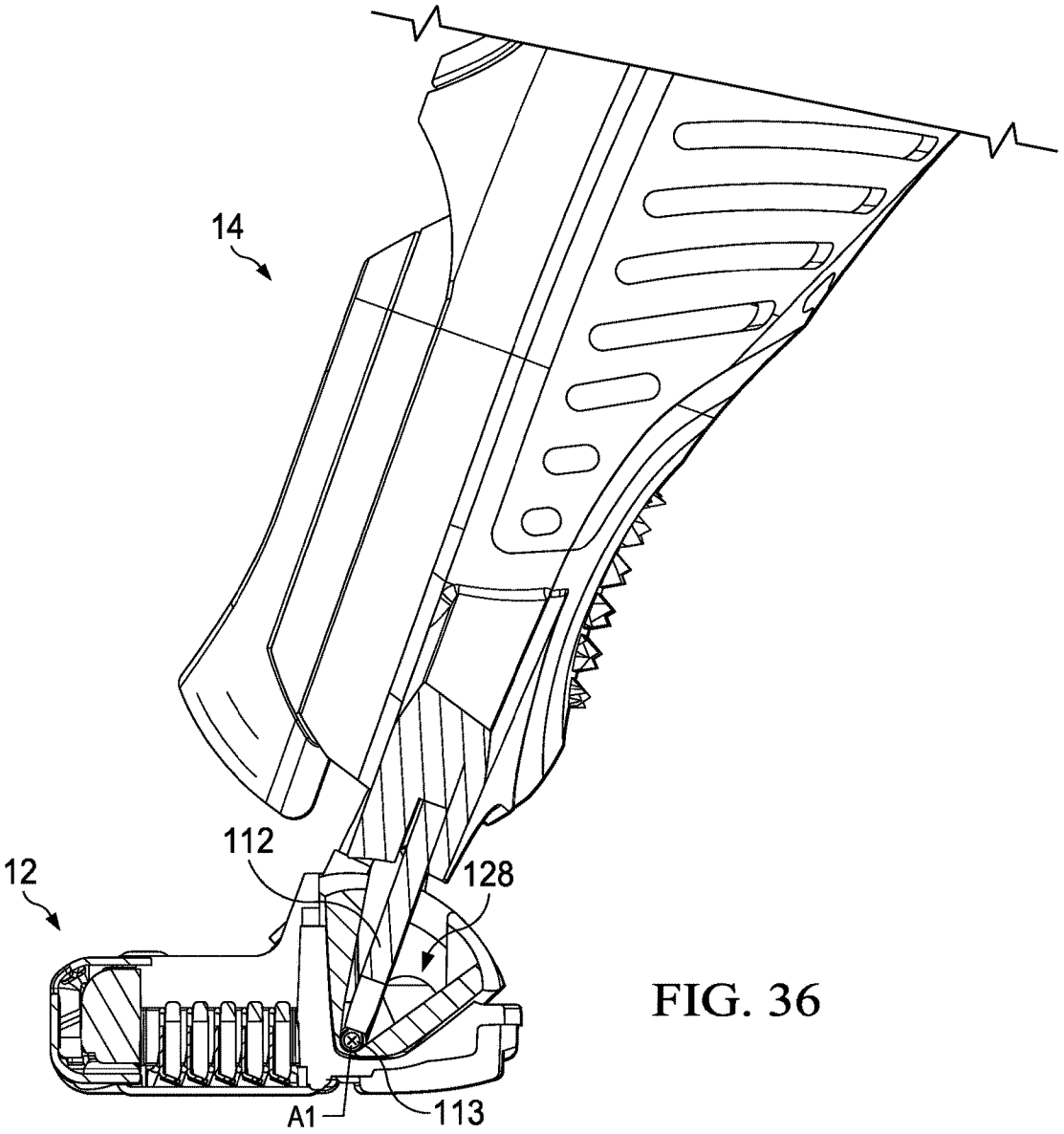
FIG. 36 is a cross-sectional view of FIG. 35 but with the handle shown in a fully pivoted position.

During shaving, the handle 14 can pivot about the pivot axis A1 relative to the cartridge 12 between a home position as illustrated in FIG. 35 and a fully pivoted position as illustrated in FIG. 36 to allow the cartridge 12 to contour to the user's skin. When the cartridge 12 is pivoted, the arms 112 can travel within the V-shaped grooves 128 to allow for pivoting of the pivoting head 34 and thus the cartridge 12 between the home position and the fully pivoted position. The V-shaped grooves 128 can define the pivot limits of the home position and the fully pivoted position of the pivoting head 34. A spring 156, as illustrated in FIG. 34, can be disposed between the base member 108 and the cover member 110 (FIG. 11) and can comprise a pair of arms 158 (FIG. 33) that extend to the main body 32. The spring 156 can bias the pivoting head 34 into the home position such that when a user shaves with the shaving system 10, the spring 156 can maintain contact between the cartridge 12 and the user's skin. It is to be appreciated that the pivot limits and biasing can be accomplished by any means known in the art, including mechanical limits.

Referring now to FIG. 35, the handle 14 can comprise an ejection button 160 that is slidable between a retracted position (shown in solid lines) and an extended position (shown in dashed lines). When the cartridge 12 is installed on the pivoting head 34, the ejection button 160 can be slid from the retracted position to the extended position to facilitate ejection of the cartridge 12 from the handle 14. When the shaving system 10 is being used for shaving the ejection button 160 can be biased into the retracted position. When the user wishes to eject the cartridge 12 from the handle 14, such as, for example, when the cartridge 12 has reached the end of its useful life, the user can push the ejection button 160 towards the extended position and into contact with the deflection member 94 of the locking member 88. Once the ejection button 160 contacts the deflection member 94, the user can further urge the ejection button 160 towards the extended position until the pivoting head 34 is out of engagement with the locking member 88 (e.g., into the position shown in FIGS. 27-29) and can be removed from the cartridge 12.

Still referring to FIG. 35, the ejection button 160 can be spaced from the locking member 88 by a distance D9 that is sufficient to prevent interference between the ejection button 160 and the locking member 88 when the cartridge 12 is pivoted into the fully pivoted position, as illustrated in FIG. 36. In one embodiment, the distance D9 can be between about 2.0 mm and about 5.0 mm and preferably about 3.0 mm.

Figure 37:
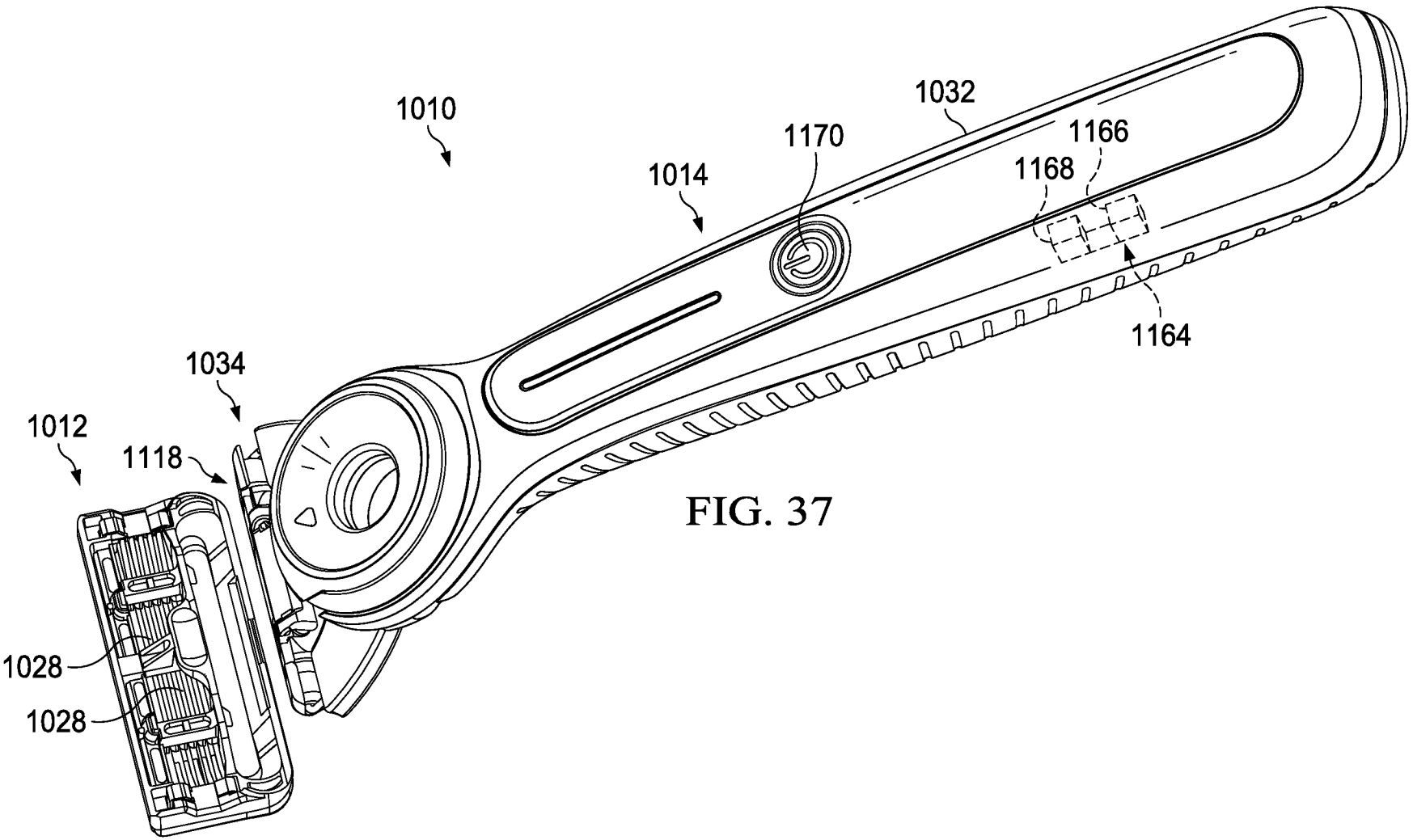
FIG. 37 is a partially exploded isometric view depicting a shaving system having a handle and a cartridge, in accordance with another embodiment.
Figure 38:
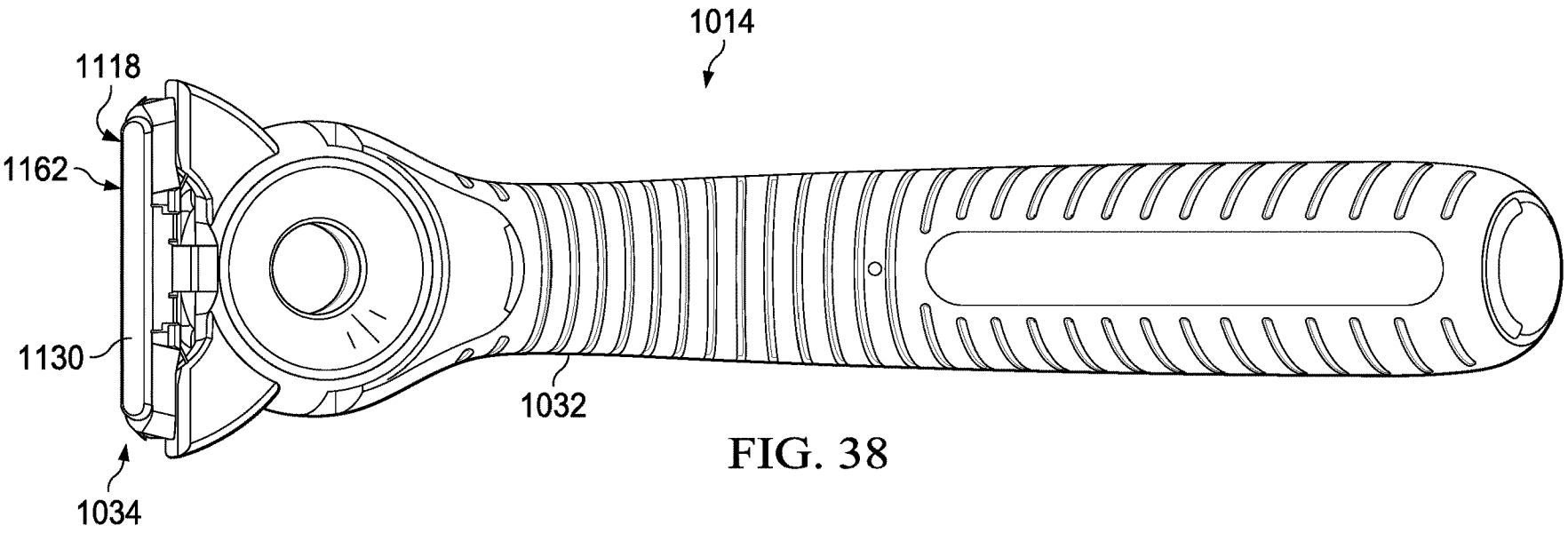
FIG. 38 is an upper isometric view depicting the handle of FIG. 37.

FIGS. 37 and 38 illustrate an alternative embodiment of a shaving system 1010 that includes a cartridge 1012 and a handle 1014 that can be similar to, or the same as in many respects as, the cartridge 12 and the handle 14, respectively, illustrated in FIGS. 1-36. For example, the cartridge 1012 can comprise a plurality of razor blades 1028. The handle 1014 can comprise a main body 1032 and a pivoting head 1034 pivotally coupled with the main body 1032. The pivoting head 1034 can be configured for releasable attachment to the cartridge 1012 in a similar manner as described above with respect to FIGS. 1-36. The pivoting head 1034 can comprise a head portion 1118. However, the head portion 1118 can comprise a heating element 1162 (FIG. 38) that is in electrical communication with a heating system 1164 (FIG. 37). The heating system 1164 can comprise a power storage device 1166 and a heating controller 1168 that is in electrical communication with the power storage device 1166. A power button 1170 can be in electrical communication with the heating element 1162 and the heating controller 1168. The power button 1170 can be configured to facilitate selective energization of the heating element 1162. When the power button 1170 is activated (e.g., depressed), power can be delivered from the power storage device 1166 to the heating element 1162 to generate heat from the heating element 1162. The heating controller 1168 can regulate the power flow from the power storage device 1166 to the heating element 1162 to regulate the amount of heat generated by the heating element 1162. In one embodiment, the power storage device 1166 can comprise a rechargeable battery that can be recharged with a power cord or through inductive charging. In another embodiment, the power storage device 1166 can comprise a disposable battery.

When a user shaves with the shaving system 1010 and the heating element 1162 is generating heat (e.g., after the power button 1170 has been activated), the head portion 1118 can contact the user's skin to heat the user's skin ahead of the razor blades 1028. As the user pulls the cartridge 1012 across their skin, the heat can soften the skin prior to being shaved by the razor blades 1028. In certain embodiments, the heating element 1162 can comprise a metal such as aluminum or stainless steel. In certain embodiments, the heating element 1162 can comprise a high capacity material such as metal or phase change materials. In certain embodiments, the heating element 1162 can comprise high thermal conductivity materials such as copper, aluminum, or thermally conductive plastics such as CoolPoly® (trademark symbol). It is to be appreciated that although the pivoting head 1034 is described as selectively heating a user's skin, the pivoting head 1034 can additionally or alternatively be configured to facilitate selective cooling of the user's skin. In some embodiments, heating or cooling delivered by the pivoting head 1034 can also be achieved passively such as by dipping or running the pivoting head 1034 under water at a different temperature than ambient.

Figure 39:
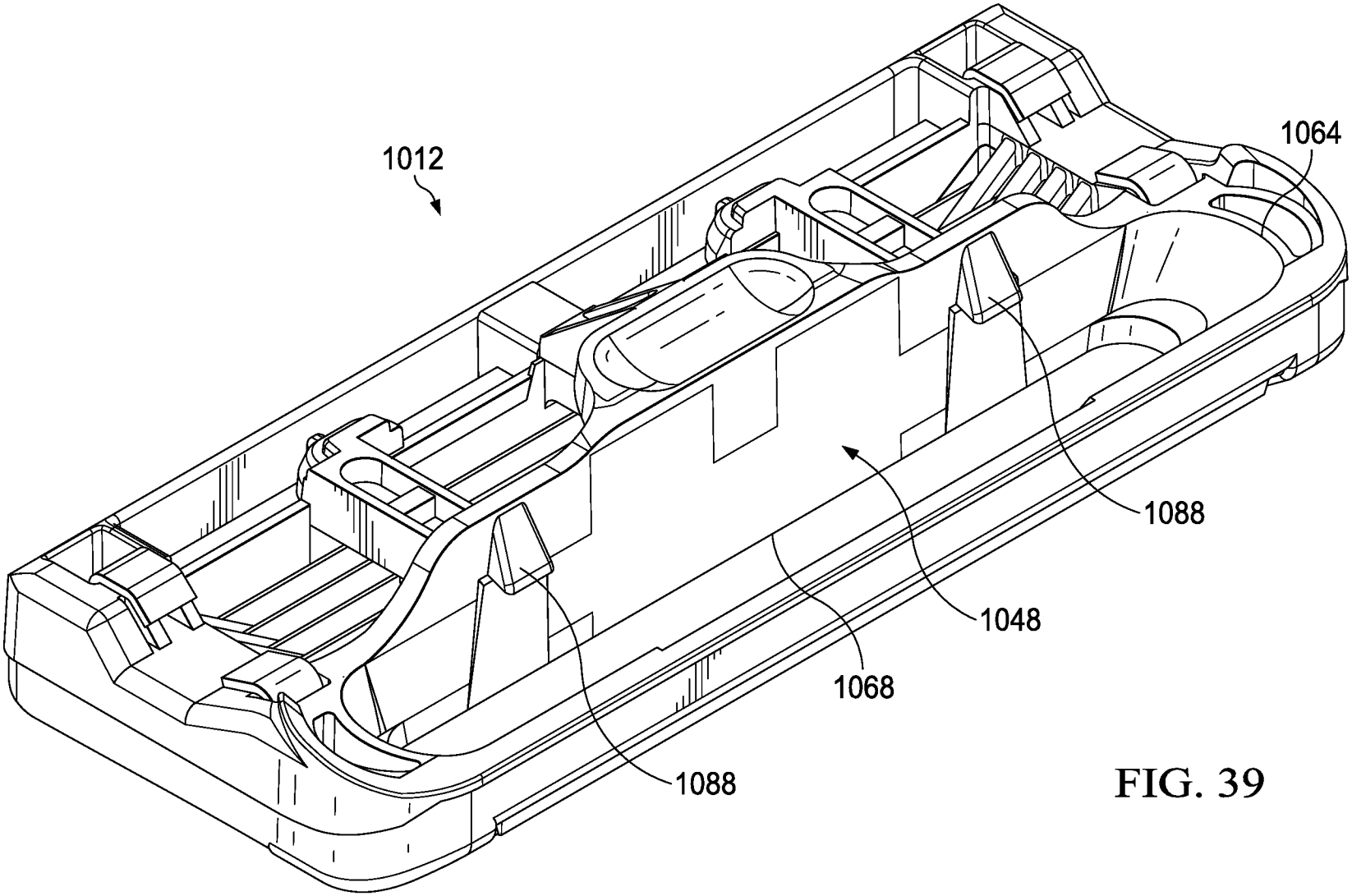
FIG. 39 is an isometric view depicting the cartridge of FIG. 37.

Referring now to FIG. 39, the cartridge 1012 will be described in further detail. The cartridge 1012 can be similar to, or the same as in many respects as, the cartridge 12, illustrated in FIGS. 1-36. For example, the cartridge 1012 can comprise a rear wall 1048 that partially defines a lower opening 1064 and an upper opening 1068. However, the cartridge 1012 can comprise a pair of locking members 1088 that are spaced from each other and extend from the rear wall 1048 about midway between the lower opening 1064 and the upper opening 1068.

It should be understood that providing consumer benefits (e.g., lotion, heating, cooling) from the handle (e.g., 14, 1014) solves the challenge of balancing designing a safe product with good product integrity (e.g., in cases of accidental drops), delivering the benefit from the handle (e.g., 14, 1014) to the face surface (e.g., 130) around the pivots needed for shave strokes to closely track the skin, and fitting the delivery benefit components among the other functional components of the handle (e.g., 14, 1014) such as the arms (e.g., 112) and the ejection button (e.g., 160). Designing a safe product with good product integrity is a challenge because by having many, if not most, of the benefit delivery elements disposed in the handle (e.g., 14, 1014), the handle can weigh two to three times more than most wet shaving razor systems commonly found on the market. For instance, most conventional shaving razor handles weigh less than 56 grams, and the vast majority weighs less than 45 grams. The handles (e.g., 14, 1014) of the present disclosure can have a mass up to about 120 grams with preferred mass of about 80 grams. In some embodiments, the handle (e.g., 14, 1014) can have a mass of about 57 grams to about 150 grams and more preferably about 80 grams. Such a mass is considered "heavy" in the present disclosure. The handle 14 shown in FIGS. 1 and 11-16 can have a mass about 75 grams and the handle 1014 shown in FIGS. 37 and 38 has a mass of about 85 grams.

Combinations

Various examples are provided below:

A. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface; and an upper surface defining an upper opening; and at least one razor blade disposed in the blade support portion between the cap and the guard, wherein:

the lower surfaces cooperate to define a lower opening;

the front wall and the rear wall are spaced from each other such that the interior surfaces cooperate to at least partially define a handle receptacle that extends between the lower opening and the upper opening;

the upper opening is more proximate the shaving plane than the lower opening;

the rear wall is more proximate to the blade support portion than the front wall;

a lower cross-sectional area is defined at least partially by the interior surfaces proximate the lower opening;

an upper cross-sectional area is defined at least partially by the interior surfaces proximate the upper opening;

the upper cross-sectional area is more proximate the upper opening than then lower opening;

each of the upper cross-sectional area and the lower cross-sectional area is taken at a cross-section that is parallel to the shaving plane; and the lower cross-sectional area is greater than the upper cross-sectional area.

B. The shaving razor cartridge of Paragraph B wherein the lower cross-sectional area is between about 60 $mm^2$ and about 250 $mm^2$, and the upper cross-sectional area is between about 40 $mm^2$ and about 120 $mm^2$.

C. The shaving razor cartridge of Paragraph B wherein the lower cross-sectional area is about 118 $mm^2$, and the upper cross-sectional area is about 80 $mm^2$.

D. The shaving razor cartridge of Paragraph A wherein the handle interface portion further comprises a first sidewall comprising a lower surface and an interior surface, and a second sidewall comprising a lower surface and an interior surface, wherein:

the first sidewall and the second sidewall are spaced from each other and extend between the front wall and the rear wall such that the front wall, the rear wall, the first sidewall, and the second sidewall cooperate to define the handle receptacle;

an intermediate cross-sectional area is defined by the handle receptacle between the upper opening and the lower opening and is taken at a cross-section that is parallel to the shaving plane; and the intermediate cross-sectional area is less than the lower cross-sectional area and is greater than the upper cross-sectional area.

E. The shaving razor cartridge of Paragraph D wherein the intermediate cross-sectional area is disposed about midway between the lower cross-sectional area and the upper cross-sectional area.

F. The shaving razor cartridge of Paragraph A wherein the upper cross-sectional area is the smallest cross-sectional area defined by the interior surfaces and the lower cross-sectional area is the largest cross-sectional area defined by the interior surfaces.

G. The shaving razor cartridge of Paragraph A wherein the upper cross-sectional area is taken at a vertical distance of about 1 mm from the shaving plane.

H. The shaving razor cartridge of Paragraph A wherein:

the at least one razor blade extends laterally between opposing sides of the blade support portion;

the upper opening has a first length that extends laterally along the handle interface portion;

the lower opening has a second length that extends laterally along the handle interface portion; and the first length is greater than the second length.

I. The shaving razor cartridge of Paragraph H wherein the first length is between about 29 mm and about 39 mm and the second length is between about 26 mm and about 36 mm.

J. The shaving razor cartridge of Paragraph A wherein:

the at least one razor blade extends laterally between opposing sides of the blade support portion;

the lower opening has a first width that extends longitudinally along the handle interface portion;

the upper opening has a second width that extends longitudinally along the handle interface portion; and the first width is greater than the second width.

K. The shaving razor cartridge of Paragraph J wherein the first width is between about 3 mm and about 8 mm and the second width is between about 1.5 mm and about 5 mm.

L. The shaving razor cartridge of Paragraph K wherein the first width is about 6.5 mm and the second width is about 3.6 mm.

M. The shaving razor cartridge of Paragraph A wherein the respective interior surfaces of the front wall and the rear wall are tapered inwardly towards the upper opening.

N. The shaving razor cartridge of Paragraph M wherein:

the handle interface portion further comprises a first sidewall comprising a lower surface and an interior surface;

the handle interface portion further comprises a second sidewall comprising a lower surface and an interior surface;

the first sidewall and the second sidewall are spaced from each other and extend between the front wall and the rear wall such that the front wall, the rear wall, the first sidewall, and the second sidewall cooperate to define the handle receptacle; and the respective interior surfaces of the first sidewall and the second sidewall are tapered inwardly towards the upper opening.

O. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane; and a rear wall comprising a lower surface and an interior surface, the interior surface extending along a rear plane; and at least one razor blade disposed in the blade support portion between the cap and the guard, wherein:

the lower surfaces cooperate to define a lower opening;

the front wall and the rear wall are spaced from each other such that the interior surfaces cooperate to at least partially define a handle receptacle that extends to the lower opening;

the rear wall is more proximate to the blade support portion than the front wall; and the front plane and the rear plane intersect at an included angle.

P. The shaving razor cartridge of Paragraph O wherein the front wall has a first height, the rear wall has a second height, and the first height is less than the second height.

Q. The shaving razor cartridge of Paragraph P wherein the first height is between about 1.5 mm and about 7.5 mm, and the second height is between about 7.5 mm and about 12 mm.

R. The shaving razor cartridge of Paragraph O wherein:

the handle interface portion comprises an upper surface that defines an upper opening;

the handle receptacle extends between the lower opening and the upper opening; and the upper opening is more proximate to the shaving plane than the lower opening.

S. The shaving razor cartridge of Paragraph R wherein:

the at least one razor blade extends laterally between opposing sides of the blade support portion;

the upper opening has a first length that extends laterally along the handle interface portion;

the lower opening has a second length that extends laterally along the handle interface portion; and the first length is greater than the second length.

T. The shaving razor cartridge of Paragraph S wherein the first length is between about 29 mm and about 39 mm and the second length is between about 26 mm and about 36 mm.

U. The shaving razor cartridge of Paragraph O wherein the included angle is between about 30 degrees and about 70 degrees.

V. The shaving razor cartridge of Paragraph U wherein the included angle is between about 45 degrees and about 48 degrees.

W. The shaving razor cartridge of Paragraph R wherein the upper surface is within a vertical distance of the shaving plane.

X. The shaving razor cartridge of Paragraph W wherein the upper surface is disposed between the shaving plane and the lower surfaces.

Y. The shaving razor cartridge of Paragraph X wherein the vertical distance is less than 1 mm.

Z. The shaving razor cartridge of Paragraph O wherein the front plane is substantially perpendicular to the shaving plane.

AB. The shaving razor cartridge of Paragraph Z wherein the interior surfaces of each of the front wall and the rear wall are generally planar.

AC. The shaving razor cartridge of Paragraph R wherein:

the at least one razor blade extends laterally between opposing sides of the blade support portion;

the lower opening has a first width that extends longitudinally along the handle interface portion;

the upper opening has a second width that extends longitudinally along the handle interface portion; and the first width is greater than the second width.

AD. The shaving razor cartridge of Paragraph R wherein the first width is between about 3 mm and about 8 mm and the second width is between about 1.5 mm and about 5 mm.

AE. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface; and an upper surface that defines an upper opening; and at least one razor blade disposed in the blade support portion between the cap and the guard, the at least one razor blade extending laterally between opposing sides of the blade support portion, wherein:

the lower surfaces cooperate to define a lower opening;

the front wall and the rear wall are spaced from each other such that the interior surfaces cooperate to at least partially define a handle receptacle that extends between the upper opening and the lower opening;

the upper opening is more proximate to the shaving plane than the lower opening;

the lower opening has a first length that extends laterally along the handle interface portion;

the upper opening has a second length that extends laterally along the handle interface portion; and the first length is greater than the second length.

AF. The shaving razor cartridge of Paragraph AE wherein the first length is between about 29 mm and about 39 mm and the second length is between about 26 mm and about 36 mm.

AG. The shaving razor cartridge of Paragraph AE wherein the respective interior surfaces of the front wall and the rear wall are tapered inwardly towards the upper opening.

AH. The shaving razor cartridge of Paragraph AG wherein the handle interface portion further comprises a first sidewall comprising a lower surface and an interior surface, and a second sidewall comprising a lower surface and an interior surface, wherein:

the first sidewall and the second sidewall are spaced from each other and extend between the front wall and the rear wall such that the front wall, the rear wall, the first sidewall, and the second sidewall cooperate to define the handle receptacle; and the respective interior surfaces of the first sidewall and the second sidewall are tapered inwardly towards the upper opening.

AI. The shaving razor cartridge of Paragraph AE wherein:

the lower opening has a first width that extends longitudinally along the handle interface portion;

the upper opening has a second width that extends longitudinally along the handle interface portion; and the first width is greater than the second width.

AJ. The shaving razor cartridge of Paragraph AI wherein the first width is between about 3 mm and about 8 mm and the second width is between about 1.5 mm and about 5 mm.

AK. The shaving razor cartridge of Paragraph AJ wherein the first width is about 6.5 mm and the second width is about 3.6 mm.

AL. The shaving razor cartridge of Paragraph AE wherein the upper surface is spaced from the shaving plane.

AM. The shaving razor cartridge of Paragraph AE wherein the upper surface is within a vertical distance of the shaving plane.

AN. The shaving razor cartridge of Paragraph AM wherein the upper surface is disposed between the shaving plane and the lower surfaces.

AO. The shaving razor cartridge of Paragraph AN wherein the vertical distance is less than 1 mm.

AP. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface; and an upper surface that defines an upper opening; and at least one razor blade disposed in the blade support portion between the cap and the guard, the at least one razor blade extending laterally between opposing sides of the blade support portion, wherein:

the lower surfaces cooperate to define a lower opening;

the front wall and the rear wall are spaced from each other such that the interior surfaces cooperate to at least partially define a handle receptacle that extends between the upper opening and the lower opening;

the upper opening is more proximate to the shaving plane than the lower opening;

the lower opening has a first width that extends longitudinally along the handle interface portion;

the upper opening has a second width that extends longitudinally along the handle interface portion; and the first width is greater than the second width.

AQ. The shaving razor cartridge of Paragraph AP wherein the first width is between about 3 mm and about 8 mm and the second width is between about 1.5 mm and about 5 mm.

AR. The shaving razor cartridge of Paragraph AQ wherein the first width is about 6.5 mm and the second width is about 3.6 mm.

AS. The shaving razor cartridge of Paragraph AP wherein the respective interior surfaces of the front wall and the rear wall are tapered inwardly towards the upper opening.

AT. The shaving razor cartridge of Paragraph AS wherein the handle interface portion further comprises a first sidewall comprising a lower surface and an interior surface, and a second sidewall comprising a lower surface and an interior surface, wherein:

the first sidewall and the second sidewall are spaced from each other and extend between the front wall and the rear wall such that the front wall, the rear wall, the first sidewall, and the second sidewall cooperate to define the handle receptacle; and the respective interior surfaces of the first sidewall and the second sidewall are tapered inwardly towards the upper opening.

AU. The shaving razor cartridge of Paragraph AP wherein:

the interior surface of the front wall extends along a front plane;

the interior surface of the rear wall extends along a rear plane; and the front plane and the rear plane intersect at an included angle.

AV. The shaving razor cartridge of Paragraph AU wherein the included angle is between about 30 degrees and about 70 degrees.

AW. The shaving razor cartridge of Paragraph AV wherein the included angle is between about 45 degrees and about 48 degrees.

AX. The shaving razor cartridge of Paragraph AP wherein the upper surface is within a vertical distance of the shaving plane.

AY. The shaving razor cartridge of Paragraph AX wherein the upper surface is disposed between the shaving plane and the lower surfaces.

AZ. The shaving razor cartridge of Paragraph AY wherein the vertical distance is less than 1 mm.

BA. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane;

a rear wall comprising a lower surface and an interior surface, the interior surface extending along a rear plane;

an upper surface;

a front lip portion disposed between the front wall and the upper surface and comprising an interior surface; and a rear lip portion disposed between the front wall and the upper surface and comprising an interior surface; and at least one razor blade disposed in the blade support portion between the cap and the guard, wherein:

the lower surfaces cooperate to define a lower opening;

the front wall and the front lip portion are each spaced from the rear wall and the rear lip portion, respectively, such that the interior surfaces of each of the front wall, the rear wall, the front lip portion, and the rear lip portion cooperate to at least partially define a handle receptacle that extends to the lower opening;

the rear wall is more proximate to the blade support portion than the front wall; and the interior surface of the front wall and the interior surface of the front lip portion are non-coplanar.

BB. The shaving razor cartridge of Paragraph BA wherein the interior surface of the front lip portion and the interior surface of the rear lip portion are substantially parallel with one another.

BC. The shaving razor cartridge of Paragraph BB wherein the interior surface of the front lip portion and the interior surface of the rear lip portion are substantially perpendicular to the shaving plane.

BD. The shaving razor cartridge of Paragraph BA wherein the interior surface of the front wall and the interior surface of the rear wall are angled with respect to each other by between about 30 degrees and about 70 degrees.

BE. The shaving razor cartridge of Paragraph BD wherein the interior surface of the front wall and the interior surface of the rear wall are angled with respect to each other by between about 45 degrees and about 48 degrees.

BF. The shaving razor cartridge of Paragraph BA wherein:

the handle interface portion further comprises an upper surface that defines an upper opening;

the handle receptacle extends between the upper opening and the lower opening; and the upper opening is more proximate to the shaving plane than the lower opening.

BG. The shaving razor cartridge of Paragraph BF wherein the front lip portion and the rear lip portion extend to the upper surface.

BH. The shaving razor cartridge of Paragraph BF wherein the respective interior surfaces of the front wall and the rear wall are tapered inwardly towards the upper opening.

BI. The shaving razor cartridge of Paragraph BA wherein the upper surface is within a vertical distance of the shaving plane.

BJ. The shaving razor cartridge of Paragraph BI wherein the upper surface is disposed between the shaving plane and the lower surfaces.

BK. The shaving razor cartridge of Paragraph BJ wherein the vertical distance is less than 1 mm.

BL. The shaving razor cartridge of Paragraph BA wherein one or more of the front lip portion and the rear lip portion are configured to engage a portion of a handle.

BM. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane;

a rear wall comprising a lower surface and an interior surface, the interior surface extending along a rear plane;

an upper surface defining an upper opening;

a front lip portion disposed between the front wall and the upper surface and comprising an interior surface; and a rear lip portion disposed between the front wall and the upper surface and comprising an interior surface; and at least one razor blade disposed in the blade support portion between the cap and the guard, wherein:

the lower surfaces cooperate to define a lower opening;

the front wall and the front lip portion are each spaced from the rear wall and the rear lip portion, respectively, such that the interior surfaces of each of the front wall, the rear wall, the front lip portion, and the rear lip portion cooperate to at least partially define a handle receptacle that extends between the lower opening and the upper opening;

the rear wall is more proximate to the blade support portion than the front wall;

the upper opening is more proximate to the shaving plane than the lower opening; and one or more of the front lip portion and the rear lip portion are configured to engage a portion of a handle.

BN. The shaving razor cartridge of Paragraph BM wherein the interior surface of the rear wall and the interior surface of the rear lip portion are generally coplanar.

BO. The shaving razor cartridge of Paragraph BM wherein the interior surface of the front lip portion and the interior surface of the rear lip portion are substantially parallel with one another.

BP. The shaving razor cartridge of Paragraph BO wherein the interior surface of the front lip portion and the interior surface of the rear lip portion are substantially perpendicular to the shaving plane.

BQ. The shaving razor cartridge of Paragraph BM wherein the interior surface of the front wall and the interior surface of the rear wall are angled with respect to each other by between about 30 degrees and about 70 degrees.

BR. The shaving razor cartridge of Paragraph BQ wherein the interior surface of the front wall and the interior surface of the rear wall are angled with respect to each other by between about 45 degrees and about 48 degrees.

BS. The shaving razor cartridge of Paragraph BM wherein the front lip portion and the rear lip portion extend to the upper surface.

BT. The shaving razor cartridge of Paragraph BM wherein the respective interior surfaces of the front wall and the rear wall are tapered inwardly towards the upper opening.

BU. The shaving razor cartridge of Paragraph BM wherein the upper surface is within a vertical distance of the shaving plane.

BV. The shaving razor cartridge of Paragraph BU wherein the upper surface is disposed between the shaving plane and the lower surfaces.

BW. The shaving razor cartridge of Paragraph BV wherein the vertical distance is less than 1 mm.

BX. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane;

a rear wall comprising a lower surface and an interior surface, the interior surface extending along a rear plane;

an upper surface defining an upper opening;

a front lip portion disposed between the front wall and the upper surface and comprising an interior surface; and a rear lip portion disposed between the front wall and the upper surface and comprising an interior surface; and at least one razor blade disposed in the blade support portion between the cap and the guard, wherein:

the lower surfaces cooperate to define a lower opening;

the front wall and the front lip portion are each spaced from the rear wall and the rear lip portion, respectively, such that the interior surfaces of each of the front wall, the rear wall, the front lip portion, and the rear lip portion cooperate to at least partially define a handle receptacle that extends between the upper opening and the lower opening;

the front lip portion and the rear lip portion extend to the upper surface;

the interior surface of the front wall and the interior surface of the front lip portion are non-coplanar;

the respective interior surfaces of the front wall and the rear wall are tapered inwardly towards the upper opening.

BY. The shaving razor cartridge of Paragraph BX wherein the interior surface of the rear wall and the interior surface of the rear lip portion are generally coplanar.

BZ. The shaving razor cartridge of Paragraph BX wherein the interior surface of the front lip portion and the interior surface of the rear lip portion are substantially parallel with one another.

CA. The shaving razor cartridge of Paragraph BZ wherein the interior surface of the front lip portion and the interior surface of the rear lip portion are substantially perpendicular to the shaving plane.

CB. The shaving razor cartridge of Paragraph BX wherein the interior surface of the front wall and the interior surface of the rear wall are angled with respect to each other by between about 30 degrees and about 70 degrees.

CC. The shaving razor cartridge of Paragraph CB wherein the interior surface of the front wall and the interior surface of the rear wall are angled with respect to each other by between about 45 degrees and about 48 degrees.

CD. The shaving razor cartridge of Paragraph CC wherein the upper surface is within a vertical distance of the shaving plane.

CE. The shaving razor cartridge of Paragraph CD wherein the upper surface is disposed between the shaving plane and the lower surfaces.

CF. The shaving razor cartridge of Paragraph CE wherein the vertical distance is less than 1 mm.

CG. The shaving razor cartridge of Paragraph BX wherein the rear wall is more proximate to the blade support portion than the front wall.

CH. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane;

a rear wall comprising a lower surface and an interior surface, the interior surface extending along a rear plane;

an upper surface defining an upper opening;

a front lip portion disposed between the front wall and the upper surface and comprising an interior surface; and a rear lip portion disposed between the front wall and the upper surface and comprising an interior surface; and at least one razor blade disposed in the blade support portion between the cap and the guard, the at least one razor blade extending laterally between opposing sides of the blade support portion, wherein:

the lower surfaces cooperate to define a lower opening;

the front wall and the front lip portion are each spaced from the rear wall and the rear lip portion, respectively, such that the interior surfaces of each of the front wall, the rear wall, the front lip portion, and the rear lip portion cooperate to at least partially define a handle receptacle that extends between the upper opening and the lower opening;

the front lip portion and the rear lip portion extend to the upper surface;

the lower opening has a first width that extends longitudinally along the handle interface portion;

the upper opening has a second width that extends longitudinally along the handle interface portion; and the first width is greater than the second width.

CI. The shaving razor cartridge of Paragraph CH wherein the interior surface of the front lip portion and the interior surface of the rear lip portion are substantially parallel with one another.

CJ. The shaving razor cartridge of Paragraph CH wherein the interior surface of the front lip portion and the interior surface of the rear lip portion are substantially perpendicular to the shaving plane.

CK. The shaving razor cartridge of Paragraph CH wherein the interior surface of the front wall and the interior surface of the rear wall are angled with respect to each other by between about 30 degrees and about 70 degrees.

CL. The shaving razor cartridge of Paragraph CK wherein the interior surface of the front wall and the interior surface of the rear wall are angled with respect to each other by between about 45 degrees and about 48 degrees.

CM. The shaving razor cartridge of Paragraph CH wherein the upper surface is within a vertical distance of the shaving plane.

CN. The shaving razor cartridge of Paragraph CM wherein the upper surface is disposed between the shaving plane and the lower surfaces.

CO. The shaving razor cartridge of Paragraph CN wherein the vertical distance is less than 1 mm.

CP. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a rear wall comprising a lower surface and an interior surface, the interior surface extending along a rear plane; and a front wall comprising a lower surface and an interior surface, the front wall being spaced from the rear wall and cooperating with the rear wall to at least partially define a handle receptacle; and at least one razor blade disposed in the blade support portion between the cap and the guard, wherein:

the lower surfaces cooperate to define a lower opening to which the handle receptacle extends;

the rear wall is more proximate to the blade support portion than the front wall;

the rear plane is substantially perpendicular to the shaving plane; and the front wall has a first height, the rear wall has a second height and the first height is less than the second height.

CQ. The shaving razor cartridge of Paragraph CP wherein the interior surface of the front wall is substantially planar and defines a front plane and wherein the front wall is angled with respect to the rear wall such that the front plane and the rear plane intersect at an included angle.

CR. The shaving razor cartridge of Paragraph CQ wherein the included angle is between about 30 degrees and about 70 degrees.

CS. The shaving razor cartridge of Paragraph CP wherein the first height is between about 1.5 mm and about 7.5 mm, and the second height is between about 7.5 mm and about 12 mm.

CT. The shaving razor cartridge of Paragraph CP wherein:

the handle interface portion further comprises an upper surface that defines an upper opening;

the handle receptacle extends to the upper opening; and the upper opening is more proximate to the shaving plane than the lower opening.

CU. The shaving razor cartridge of Paragraph CT wherein:

the at least one razor blade extends laterally between opposing sides of the blade support portion;

the lower opening has a first length that extends laterally along the handle interface portion;

the upper opening has a second length that extends laterally along the handle interface portion; and the first length is greater than the second length.

CV. The shaving razor cartridge of Paragraph CU wherein the first length is between about 29 mm and about 39 mm and the second length is between about 26 mm and about 36 mm.

CW. The shaving razor cartridge of Paragraph CV wherein the respective interior surfaces of the front wall and the rear wall are tapered inwardly towards the upper opening.

CX. The shaving razor cartridge of Paragraph CT wherein the upper surface is within a vertical distance of the shaving plane.

CY. The shaving razor cartridge of Paragraph CX wherein the upper surface is disposed between the shaving plane and the lower surfaces.

CZ. The shaving razor cartridge of Paragraph CY wherein the vertical distance is less than 1 mm.

DA. A shaving razor cartridge comprising:

a housing that extends between a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface; and an upper surface defining an upper opening; and at least one razor blade disposed in the blade support portion between the cap and the guard, the at least one razor blade extending laterally between opposing sides of the blade support portion, wherein:

the lower surfaces cooperate to define a lower opening;

the front wall and the rear wall are spaced from each other such that the interior surfaces cooperate to at least partially define a handle receptacle that extends between the upper opening and the lower opening;

the upper opening has an opening width that extends longitudinally along the handle interface portion; and a ratio of the overall width to the opening width is about 3:1 to about 2:1.

DB. The shaving razor cartridge of Paragraph DA wherein the overall width is between about 10 mm and about 11 mm and the opening width is between about 1.5 mm and about 5 mm.

DC. The shaving razor cartridge of Paragraph DA wherein the front wall has a first height, the rear wall has a second height and the first height is less than the second height.

DD. The shaving razor cartridge of Paragraph DC wherein the first height is between about 1.5 mm and about 7.5 mm, and the second height is between about 7.5 mm and about 12 mm.

DE. The shaving razor cartridge of Paragraph DA wherein:

the lower opening has a first length that extends laterally along the handle interface portion;

the upper opening has a second length that extends laterally along the handle interface portion; and the first length is greater than the second length.

DF. The shaving razor cartridge of Paragraph DE wherein the first length is between about 29 mm and about 39 mm and the second length is between about 26 mm and about 36 mm.

DG. The shaving razor cartridge of Paragraph DA wherein:

the interior surface of the front wall is substantially planar and defines a front plane;

the interior surface of the rear wall is substantially planar and defines a rear plane; and the respective interior surfaces of the front wall and the rear wall are tapered inwardly towards at the lower opening such that the front plane and the rear plane intersect at an included angle.

DH. The shaving razor cartridge of Paragraph DG wherein the front plane is substantially perpendicular to the shaving plane.

DI. The shaving razor cartridge of Paragraph DA wherein the upper surface is within a vertical distance of the shaving plane.

DJ. The shaving razor cartridge of Paragraph DI wherein the upper surface is disposed between the shaving plane and the lower surfaces.

DK. The shaving razor cartridge of Paragraph DJ wherein the vertical distance is less than 1 mm.

DL. A shaving razor cartridge comprising:

a housing that extends between a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising a lower surface, a central portion, a first distal portion, and a second distal portion; and at least one razor blade disposed in the blade support portion between the cap and the guard, the at least one razor blade extending laterally between opposing sides of the blade support portion, wherein:

each of the first distal portion and the second distal portion extends from the central portion;

the central portion, the first distal portion, and the second distal portion comprise respective interior surfaces;

the lower surfaces cooperate to define a lower opening;

the front wall and the rear wall are spaced from each other such that the interior surfaces cooperate to at least partially define a handle receptacle that extends to the lower opening;

the interior surface of the central portion is spaced horizontally from the front wall by a first distance;

the interior surface of the first distal portion is spaced horizontally from the front wall by a second distance; and the first distance is less than the second distance.

DM. The shaving razor cartridge of Paragraph DL wherein the first distance is between about 2 mm and 5 mm and the second distance is between about 2.5 mm and about 5.5 mm.

DN. The shaving razor cartridge of Paragraph DL the interior surface of the second distal portion is spaced horizontally from the front wall by a third distance that is substantially equal to the second distance.

DO. The shaving razor cartridge of Paragraph DL wherein the rear wall is more proximate to the blade support portion than the front wall.

DP. The shaving razor cartridge of Paragraph DL wherein:

the handle interface portion comprises an upper surface that defines an upper opening;

the handle receptacle extends to the upper opening; and the upper opening is more proximate to the shaving plane than the lower opening.

DQ. The shaving razor cartridge of Paragraph DP wherein the upper surface is spaced from the shaving plane.

DR. The shaving razor cartridge of Paragraph DL wherein the respective interior surfaces of the first distal portion and the second distal portion extend substantially perpendicularly to the shaving plane and extend to the lower surface of the rear wall.

DS. A shaving razor cartridge comprising:

a housing that extends between a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising a lower surface, a central portion, a first distal portion, and a second distal portion; and at least one razor blade disposed in the blade support portion between the cap and the guard, wherein:

each of the first distal portion and the second distal portion extends from the central portion;

the central portion and each of the first distal portion and the second distal portion comprise respective interior surfaces;

the lower surfaces cooperate to define a lower opening;

the front wall and the rear wall are spaced from each other such that the interior surfaces cooperate to at least partially define a handle receptacle that extends to the lower opening;

the central portion of the rear wall comprises a first thickness;

the first distal portion of the rear wall comprises a second thickness; and the first thickness is greater than the second thickness.

DT. The shaving razor cartridge of Paragraph DS wherein a ratio of the first thickness to the second thickness is between about 3:1 and about 3:2.

DU. The shaving razor cartridge of Paragraph DT wherein the first thickness is between about 0.75 mm and about 3 mm and the second thickness is between about 0.5 mm and about 1 mm.

DV. The shaving razor cartridge of Paragraph DU wherein the first thickness is about 1 mm and the second thickness is about 0.75 mm.

DW. The shaving razor cartridge of Paragraph DS wherein the second distal portion of the rear wall comprises a third thickness and the second thickness and the third thickness are substantially the same.

DX. The shaving razor cartridge of Paragraph DS wherein the rear wall is more proximate to the blade support portion than the front wall.

DY. The shaving razor cartridge of Paragraph DS wherein one or more of the first distal portion and the second distal portion are configured to flex relative to the central portion to facilitate removal and insertion of a handle with respect to the handle receptacle.

DZ. The shaving razor cartridge of Paragraph DS wherein:

the handle interface portion comprises an upper surface that defines an upper opening;

the handle receptacle extends between the upper opening and the lower opening; and the upper opening is more proximate to the shaving plane than the lower opening.

EA. The shaving razor cartridge of Paragraph DZ wherein the upper surface is within a vertical distance of the shaving plane.

EB. The shaving razor cartridge of Paragraph EA wherein the upper surface is disposed between the shaving plane and the lower surfaces.

EC. The shaving razor cartridge of Paragraph EB wherein the vertical distance is less than 1 mm.

ED. The shaving razor cartridge of Paragraph DS further comprising a locking member extending from the central portion of the rear wall towards the front wall, the locking member configured to facilitate selective retention of a razor handle to the housing.

EE. The shaving razor cartridge of Paragraph ED wherein:

the blade support portion comprises a blade support member that supports the at least one razor blade; and the locking member comprises an upper surface that is generally vertically aligned with the blade support member.

EF. The shaving razor cartridge of Paragraph ED wherein the locking member comprises a deflection member and at least one support arm, the deflection member coupled with the at least one support arm, and the at least one support arm coupled with the rear wall such that the deflection member is offset from the rear wall.

EG. The shaving razor cartridge of Paragraph ED wherein the locking member comprises an upper surface and the upper surface of the locking member and the lower surface of the rear wall are spaced from each other.

EH. The shaving razor cartridge of Paragraph EG wherein the upper surface of the locking member and the lower surface of the rear wall cooperate to define a slot therebetween that is configured to receive at least a portion of a razor handle.

EI. A shaving razor cartridge comprising:

a housing that extends between a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising, a lower surface, a central portion, a first distal portion, and a second distal portion, the central portion, the first distal portion and the second distal portion each comprising respective interior surfaces; and at least one razor blade disposed in the blade support portion between the cap and the guard, wherein:

each of the first distal portion and the second distal portion extends from the central portion;

each of the first distal portion and the second distal portion defines a notch that is configured to receive a portion of a handle.

EJ. The shaving razor cartridge of Paragraph EI further comprising a locking member extending from the central portion of the rear wall towards the front wall, the locking member configured to facilitate selective retention of a razor handle to the housing.

EK. The shaving razor cartridge of Paragraph EJ wherein the locking member comprises an upper surface, and the upper surface of the locking member and the lower surface of the rear wall are spaced from each other.

EL. The shaving razor cartridge of Paragraph EK wherein the upper surface of the locking member and the lower surface of the rear wall cooperate to define a slot therebetween that is configured to receive at least a portion of a razor handle.

EM. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface;

a first sidewall extending between the front wall and the rear wall and comprising a lower surface and an interior surface;

a second sidewall extending between the front wall and the rear wall and comprising a lower surface and an interior surface;

an upper surface defining an upper opening; and a first shoulder portion comprising a first interior shoulder surface and extending laterally from at least one of the front wall, the rear wall, and the first sidewall such that the interior surface of each of the front wall, the rear wall, and the first sidewall from which the first shoulder portion extends meets with the first interior shoulder surface at a first interface; and at least one razor blade disposed in the blade support portion between the cap and the guard, wherein:

the lower surfaces cooperate to define a lower opening;

the first sidewall and the second sidewall are spaced from each other and the front wall and the rear wall are spaced from each other such that the respective interior surfaces of the front wall, the rear wall, the first sidewall and the second sidewall cooperate to define a handle receptacle that extends between the upper opening and the lower opening;

the front wall, the rear wall, the first sidewall, and the second sidewall cooperate to define a first perimeter that extends along the first interface;

the first shoulder portion extends to the upper surface;

the upper opening defines a second perimeter; and the first perimeter is greater than the second perimeter.

EN. The shaving razor cartridge of Paragraph EM further comprising a second shoulder portion comprising a second interior shoulder surface, wherein:

the first shoulder portion extends laterally from the first sidewall such that the interior surface of the first sidewall meets with the first interior shoulder surface at the first interface;

the second shoulder portion extends laterally from the second sidewall such that the interior surface of the second sidewall meets with the second interior shoulder surface at a second interface; and the first perimeter extends additionally along the second interface.

EQ. The shaving razor cartridge of Paragraph EN wherein the first interior shoulder surface and the second interior shoulder surface are each more proximate the upper opening than the lower opening.

EP. The shaving razor cartridge of Paragraph EO wherein the first interior shoulder surface and the second interior shoulder surface are each spaced from the shaving plane by a vertical distance of between about 0.5 mm and about 3 mm.

EQ. The shaving razor cartridge of Paragraph EP wherein the vertical distance is about 1 mm.

ER. The shaving razor cartridge of Paragraph EO further comprising a locking member extending from the rear wall towards the front wall, the locking member configured to facilitate selective retention of a razor handle to the housing, wherein:

the locking member comprises an upper surface; and the upper surface of the locking member is spaced from the first interior shoulder surface of the first shoulder portion by a vertical distance of between 2 mm to 7 mm.

ES. The shaving razor cartridge of Paragraph ER wherein the vertical distance is about 5 mm.

ET. The shaving razor cartridge of Paragraph EN wherein the first interior shoulder surface and the second interior shoulder surface are each substantially planar and substantially parallel with the shaving plane.

EU. The shaving razor cartridge of Paragraph EM wherein interior surfaces of the front wall and the rear wall taper inwardly towards the upper opening.

EV. The shaving razor cartridge of Paragraph EM wherein:

the at least one razor blade extending laterally between opposing sides of the blade support portion;

the lower opening has a first length that extends laterally along the handle interface portion;

the upper opening has a second length that extends laterally along the handle interface portion; and the first length is greater than the second length.

EW. The shaving razor cartridge of Paragraph EV wherein the first length is between about 29 mm and about 39 mm and the second length is between about 26 mm and about 36 mm.

EX. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a wall comprising a lower surface defining a lower opening;

an upper surface defining an upper opening; and a shoulder portion comprising an interior shoulder surface and extending from the wall, the shoulder portion cooperating with the wall to define a handle receptacle that extends between the upper opening and the lower opening, the shoulder portion extending to the upper surface; and at least one razor blade disposed in the blade support portion between the cap and the guard, wherein the upper opening is more proximate the shaving plane than the upper opening.

EY. The shaving razor cartridge of Paragraph EX wherein:

the wall comprises a sidewall; and the shoulder portion extends laterally from the sidewall.

EZ. The shaving razor cartridge of Paragraph EX wherein:

the at least one razor blade extends laterally between opposing sides of the blade support portion;

the lower opening has a first length that extends laterally along the handle interface portion;

the upper opening has a second length that extends laterally along the handle interface portion; and the first length is greater than the second length.

FA. The shaving razor cartridge of Paragraph EZ wherein the first length is between about 29 mm and about 39 mm and the second length is between about 26 mm and about 36 mm.

FB. The shaving razor cartridge of Paragraph EX wherein the interior surface of the shoulder portion is substantially planar and is substantially parallel with the shaving plane.

FC. The shaving razor cartridge of Paragraph EX wherein:

the at least one razor blade extends laterally between opposing sides of the blade support portion;

the lower opening has a first width that extends longitudinally along the handle interface portion;

the upper opening has a second width that extends longitudinally along the handle interface portion; and the first width is greater than the second width.

FD. The shaving razor cartridge of Paragraph FC wherein the first width is between about 3 mm and about 8 mm and the second width is between about 1.5 mm and about 5 mm.

FE. The shaving razor cartridge of Paragraph EX wherein the interior shoulder surface is more proximate the upper opening than the lower opening.

FF. The shaving razor cartridge of Paragraph EX wherein the interior shoulder surface is spaced from the shaving plane by a vertical distance of between about 0.5 mm and about 3 mm.

FG. The shaving razor cartridge of Paragraph FF wherein the vertical distance is about 1 mm.

FH. The shaving razor cartridge of Paragraph FX further comprising a locking member extending from the wall, the locking member configured to facilitate selective retention of a razor handle to the housing, wherein:

the locking member comprises an upper surface; and the upper surface of the locking member is spaced from the interior shoulder surface by a vertical distance of between 2 mm to 7 mm.

FI. The shaving razor cartridge of Paragraph FH wherein the vertical distance is about 5 mm.

FJ. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface;

a first sidewall extending between the front wall and the rear wall and comprising a lower surface and an interior surface;

a second sidewall extending between the front wall and the rear wall and comprising a lower surface and an interior surface;

an upper surface defining an upper opening;

a first shoulder portion comprising a first interior shoulder surface and extending laterally from the first sidewall and a portion of each of the front wall and the rear wall such that the respective interior surfaces of the first sidewall, the front wall, and the rear wall meets with the first interior shoulder surface at a first interface;

a second shoulder portion comprising a second interior shoulder surface and extending laterally from the second sidewall and a portion of each of the front wall and the rear wall such that the respective interior surfaces of the second sidewall, the front wall, and the rear wall meets with the second interior shoulder surface at a second interface; and at least one razor blade disposed in the blade support portion between the cap and the guard, wherein:

the front wall, the rear wall, the first sidewall, and the second sidewall cooperate to define a first perimeter that extends along the first interface and the second interface;

the lower surfaces cooperate to define a lower opening;

the first sidewall and the second sidewall are spaced from each other and the front wall and the rear wall are spaced from each other such that the respective interior surfaces of the front wall, the rear wall, the first sidewall, the second sidewall, the first shoulder portion, and the second shoulder portion cooperate to define a handle receptacle that extends between the upper opening and the lower opening;

each of the first shoulder portion and the second shoulder portion extends to the upper opening;

the upper opening defines a second perimeter;

the first perimeter is less than the second perimeter; and the upper opening is more proximate the shaving plane than the lower opening.

FK. The shaving razor cartridge of Paragraph FJ wherein:

the at least one razor blade extends laterally between opposing sides of the blade support portion;

the lower opening has a first length that extends laterally along the handle interface portion;

the upper opening has a second length that extends laterally along the handle interface portion; and the first length is greater than the second length.

FL. The shaving razor cartridge of Paragraph FK wherein the first length is between about 29 mm and about 39 mm and the second length is between about 26 mm and about 36 mm.

FM. The shaving razor cartridge of Paragraph FJ wherein the first shoulder portion and the second shoulder portion are substantially crescent shaped.

FN. The shaving razor cartridge of Paragraph FJ wherein:

the at least one razor blade extends laterally between opposing sides of the blade support portion;

the lower opening has a first width that extends longitudinally along the handle interface portion;

the upper opening has a second width that extends longitudinally along the handle interface portion; and the first width is greater than the second width.

FO. The shaving razor cartridge of Paragraph FJ wherein the first interior shoulder surface and the second interior shoulder surface are each more proximate the upper opening than the lower opening.

FP. The shaving razor cartridge of Paragraph FO wherein the first interior shoulder surface and the second interior shoulder surface are each spaced from the shaving plane by a vertical distance of between about 0.5 mm and about 3 mm.

FQ. The shaving razor cartridge of Paragraph FP wherein the vertical distance is about 1 mm. FR. The shaving razor cartridge of Paragraph FJ further comprising a locking member extending from the rear wall towards the front wall, the locking member configured to facilitate selective retention of a razor handle to the housing, wherein:

the locking member comprises an upper surface; and the upper surface of the locking member is spaced from the first interior shoulder surface of the first shoulder portion by a vertical distance of between 2 mm to 7 mm.

FS. The shaving razor cartridge of Paragraph FR wherein the vertical distance is about 5 mm.

FT. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a rear wall comprising a lower surface and an interior surface; and a front wall comprising a lower surface and an interior surface and spaced from the rear wall;

a first sidewall that extends between the rear wall and the front wall and comprises an interior surface;

a second sidewall that extends between the rear wall and the front wall comprises an interior surface, the second sidewall being spaced from the first sidewall; and at least one razor blade disposed in the blade support portion between the cap and the guard, wherein:

the front wall intersects each of the first sidewall and the second sidewall at a pair of front corners;

the rear wall intersects each of the first sidewall and the second sidewall at a pair a pair of rear corners;

the lower surfaces cooperate to define a lower opening;

the front wall, the rear wall, the first sidewall, and the second sidewall cooperate to at least partially define a handle receptacle that extends to the lower opening;

the rear wall is more proximate to the blade support portion than the front wall;

one or more of the front corners and the rear corners are configured to flex relative adjacent respective portions of the front wall, the rear wall, the first sidewall, and the second sidewall to facilitate removal and insertion of a handle with respect to the handle receptacle.

FU. The shaving razor cartridge of Paragraph FT wherein each of the front corners and the rear corners are configured to flex relative adjacent respective portions of the front wall, the rear wall, the first sidewall, and the second sidewall to facilitate removal and insertion of a handle with respect to the handle receptacle.

FV. The shaving razor cartridge of Paragraph FT wherein:

one or more of the front corners comprises a first cross-sectional moment of inertia;

one or more of the front wall, the first sidewall, and the second sidewall comprises a second cross-sectional moment of inertia adjacent to the front corners; and the second cross-sectional moment of inertia is greater than the first cross-sectional moment of inertia.

FW. The shaving razor cartridge of Paragraph FV wherein the first cross-sectional moment of inertia is less than about 2 $mm^4$.

FX. The shaving razor cartridge of Paragraph FT wherein:

one or more of the rear corners comprises a first cross-sectional moment of inertia;

one or more of the rear wall, the first sidewall, and the second sidewall comprises a second cross-sectional moment of inertia adjacent to the rear corners; and the second cross-sectional moment of inertia is greater than the first cross-sectional moment of inertia.

FY. The shaving razor cartridge of Paragraph FX wherein the first cross-sectional moment of inertia is less than about 2 $mm^4$.

FZ. The shaving razor cartridge of Paragraph FT wherein:

one or more of the front corners comprises a first cross-sectional moment of inertia;

one or more of the rear corners comprises a second cross-sectional moment of inertia;

one or more of the front wall, the rear wall, the first sidewall, and the second sidewall comprises a third cross-sectional moment of inertia adjacent to the front corners; and the third cross-sectional moment of inertia is greater than each of the first cross-sectional moment of inertia and the second cross-sectional moment of inertia.

GA. The shaving razor cartridge of Paragraph FZ wherein one or more of the first cross-sectional moment of inertia and the second cross-sectional moment of inertia is less than about 2 $mm^4$.

GB. The shaving razor cartridge of Paragraph GA wherein the first cross-sectional moment of inertia and the second cross-sectional moment of inertia are substantially equal.

GC. The shaving razor cartridge of Paragraph FT wherein the front wall has a first height, the rear wall has a second height and the first height is less than the second height.

GD. The shaving razor cartridge of Paragraph GC wherein the first height is between about 1.5 mm and about 7.5 mm, and the second height is between about 7.5 mm and about 12 mm.

GE. The shaving razor cartridge of Paragraph FT wherein:

the handle interface portion further comprises an upper surface defining an upper opening; and the handle receptacle extends between the lower opening and the upper opening; and the upper opening is more proximate to the shaving plane than the lower opening.

GF. The shaving razor cartridge of Paragraph GE wherein:

the at least one razor blade extends laterally between opposing sides of the blade support portion;

the lower opening has a first length that extends laterally along the handle interface portion;

the upper opening has a second length that extends laterally along the handle interface portion; and the first length is greater than the second length.

GG. The shaving razor cartridge of Paragraph GF wherein the first length is between about 29 mm and about 39 mm and the second length is between about 26 mm and about 36 mm.

GH. The shaving razor cartridge of Paragraph GE wherein the upper surface is within a vertical distance of the shaving plane.

GI. The shaving razor cartridge of Paragraph GH wherein the upper surface is disposed between the shaving plane and the lower surfaces.

GJ. The shaving razor cartridge of Paragraph GI wherein the vertical distance is less than 1 mm.

GK. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface, the front wall and the rear wall being spaced from each other such that the interior surfaces cooperate to at least partially define a handle receptacle;

an upper surface that defines an upper opening; and a locking member extending from the interior surface of the rear wall towards the front wall, the locking member configured to facilitate selective retention of a razor handle to the housing; and at least one razor blade disposed in the blade support portion between the cap and the guard, wherein:

the lower surfaces cooperate to define a lower opening;

the handle receptacle extends between the lower opening and the upper opening;

the locking member overhangs the rear wall and extends into the handle receptacle; and the upper opening is more proximate to the shaving plane than the lower opening.

GL. The shaving razor cartridge of Paragraph GK wherein the locking member extends from the rear wall at a vertical distance that is between about 1 mm and about 3 mm.

GM. The shaving razor cartridge of Paragraph GL wherein the vertical distance is about 2 mm.

GN. The shaving razor cartridge of Paragraph GK wherein:

the locking member comprises a deflection member and at least one support arm;

the at least one support arm is coupled with the rear wall and extends from the rear wall; and the deflection member is coupled with the at least one support arm.

GO. The shaving razor cartridge of Paragraph GN wherein:

the deflection member comprises a pair of distal members and central portion that is interposed between the pair of distal members;

the at least one support arm comprises a pair of support arms;

the distal members are coupled with respective ones of the support arms; and the central portion is more proximate the front wall than the distal members.

GP. The shaving razor cartridge of Paragraph GO wherein the deflection member comprises an upper surface and the lower surface of the rear wall and the upper surface of the deflection member are spaced from each other and cooperate to define a slot therebetween.

GQ. The shaving razor cartridge of Paragraph GP wherein the upper surface of the deflection member and the interior surface of the rear wall are angled with respect to each other by less than 90 degrees.

GR. The shaving razor cartridge of Paragraph GQ wherein the upper surface of the deflection member and the interior surface of the rear wall are angled with respect to each other by about 80 degrees.

GS. The shaving razor cartridge of Paragraph GN wherein:

the interior surface of the rear wall is substantially planar and defines a rear plane that intersects the locking member; and the deflection member is interposed between the rear plane and the front wall.

GT. The shaving razor cartridge of Paragraph GK wherein the front wall has a first height, the rear wall has a second height and the first height is less than the second height.

GU. The shaving razor cartridge of Paragraph GT wherein the first height is between about 1.5 mm and about 7.5 mm, and the second height is between about 7.5 mm and about 12 mm.

GV. The shaving razor cartridge of Paragraph GU wherein:

the at least one razor blade extends laterally between opposing sides of the blade support portion;

the lower opening has a first length that extends laterally along the handle interface portion;

the upper opening has a second length that extends laterally along the handle interface portion; and the first length is greater than the second length.

GW. The shaving razor cartridge of Paragraph GV wherein the first length is between about 29 mm and about 39 mm and the second length is between about 26 mm and about 36 mm.

GX. The shaving razor cartridge of Paragraph GK wherein the upper surface is within a vertical distance of the shaving plane.

GY. The shaving razor cartridge of Paragraph GX wherein the upper surface is disposed between the shaving plane and the lower surfaces.

GZ. The shaving razor cartridge of Paragraph GY wherein the vertical distance is less than 1 mm.

HA. A shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface, the front wall and the rear wall being spaced from each other such that the interior surfaces cooperate to at least partially define a handle receptacle;

an upper surface that defines an upper opening; and a locking member extending from the interior surface of the rear wall towards the front wall, the locking member configured to facilitate selective retention of a razor handle to the housing; and at least one razor blade disposed in the blade support portion between the cap and the guard, wherein:

the lower surfaces cooperate to define a lower opening;

the handle receptacle extends between the lower opening and the upper opening;

the upper opening is more proximate to the shaving plane than the lower opening;

the locking member comprises a deflection member and a pair of support arms that overhang the rear wall and extend into the handle receptacle;

each support arm of the pair of support arms is coupled with the rear wall and extends from the rear wall;

the deflection member comprises a pair of distal members and central portion that is interposed between the pair of distal members;

the distal members are coupled with respective ones of the support arms; and the central portion is more proximate the front wall than the distal members.

HB. The shaving razor cartridge of Paragraph HA wherein the locking member extends from the rear wall at a vertical distance that is between about 1 mm and about 3 mm.

HC. The shaving razor cartridge of Paragraph HB wherein the vertical distance is about 2 mm.

HD. The shaving razor cartridge of Paragraph HC wherein the deflection member comprises an upper surface and the lower surface of the rear wall and the upper surface of the deflection member are spaced from each other and cooperate to define a slot therebetween.

HE. The shaving razor cartridge of Paragraph HA wherein the upper surface of the deflection member and the interior surface of the rear wall are angled with respect to each other by less than 90 degrees.

HF. The shaving razor cartridge of Paragraph HE wherein the upper surface of the deflection member and the interior surface of the rear wall are angled with respect to each other by about 80 degrees.

HG. The shaving razor cartridge of Paragraph HF wherein the front wall has a first height, the rear wall has a second height and the first height is less than the second height.

HH. The shaving razor cartridge of Paragraph HG wherein the first height is between about 1.5 mm and about 7.5 mm, and the second height is between about 7.5 mm and about 12 mm.

HI. The shaving razor cartridge of Paragraph HH wherein:

the at least one razor blade extends laterally between opposing sides of the blade support portion;

the lower opening has a first length that extends laterally along the handle interface portion;

the upper opening has a second length that extends laterally along the handle interface portion; and;

the first length is greater than the second length.

HJ. The shaving razor cartridge of Paragraph HI wherein the first length is between about 29 mm and about 39 mm and the second length is between about 26 mm and about 36 mm.

HK. A shaving handle comprising:

a main body;

a pair of arms extending from the main body;

a pivoting head comprising:

a base member pivotally coupled with the pair of arms to facilitate pivoting of the pivoting head about a pivot axis between a home position and a fully pivoted position, the base member comprising:

a front wall comprising a front exterior surface that extends along a front plane; and a rear wall comprising a rear exterior surface that extends along a rear plane; and a biasing member operably coupled with the main body and configured to bias the pivoting head into the home position, wherein the front plane and the rear plane intersect at an included angle.

HL. The shaving razor handle of Paragraph HK wherein the included angle is between about 30 degrees and about 70 degrees.

HM. The shaving razor handle of Paragraph HL wherein the included angle is between about 45 degrees and about 48 degrees.

HN. The shaving razor handle of Paragraph HK wherein the front wall and the rear wall are angled with respect to each other and define a pair of V-shaped grooves and each of the arms extends between of the V-shaped grooves and are configured to travel within the V-shaped grooves when the pivoting head is pivoted.

HO. The shaving razor handle of Paragraph HK further comprising a head portion that extends upwardly from the front wall and the rear wall and comprises a face surface.

HP. The shaving razor handle of Paragraph HO wherein the face surface defines an aperture.

HQ. The shaving razor handle of Paragraph HP further comprising a fluid reservoir, wherein the aperture is in fluid communication with the fluid reservoir.

HR. The shaving razor handle of Paragraph HO wherein the head portion is formed at least partially of a conductive material.

HS. The shaving razor handle of Paragraph HR wherein the conductive material is in electrical communication with a heating controller.

HT. The shaving razor handle of Paragraph HO wherein the head portion comprises a lip surface that is non-coplanar with the front exterior surface.

HU. A shaving handle comprising:

a main body;

a pair of arms extending from the main body;

a pivoting head that extends between an upper end and a lower end, the pivoting head comprising:

a base member pivotally coupled with the pair of arms to facilitate pivoting of the pivoting head about a pivot axis between a home position and a fully pivoted position, the base member comprising:

a front wall comprising a front exterior surface; and a rear wall comprising a rear exterior surface; and a biasing member operably coupled with the main body and configured to bias the pivoting head into the home position, wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

HV. The shaving razor handle of Paragraph HU wherein:

the lower length is between about 25 mm and about 55 mm; and the upper length is between about 20 mm and about 40 mm.

HW. The shaving razor handle of Paragraph HV wherein:

the lower length is about 35 mm; and the upper length is about 30 mm.

HX. The shaving razor handle of Paragraph HU wherein the front wall and the rear wall are angled with respect to each other and define a pair of V-shaped grooves and each of the arms extends between of the V-shaped grooves and are configured to travel within the V-shaped grooves when the pivoting head is pivoted.

HY. The shaving razor handle of Paragraph HU further comprising a head portion that extends upwardly from the front wall and the rear wall and comprises a face surface.

HZ. The shaving razor handle of Paragraph HY wherein the face surface defines an aperture.

IA. The shaving razor handle of Paragraph HZ further comprising a fluid reservoir, wherein the aperture is in fluid communication with the fluid reservoir.

IB. The shaving razor handle of Paragraph HY wherein the head portion is formed at least partially of a conductive material.

IC. The shaving razor handle of Paragraph IB wherein the conductive material is in electrical communication with a heating controller.

ID. The shaving razor handle of Paragraph HY wherein the head portion comprises a lip surface that is non-coplanar with the front exterior surface.

IE. A shaving handle comprising:

a main body;

a pair of arms extending from the main body;

a pivoting head that extends between an upper end and a lower end, the pivoting head comprising:

a base member pivotally coupled with the pair of arms to facilitate pivoting of the pivoting head about a pivot axis between a home position and a fully pivoted position, the base member comprising:

a front wall comprising a front exterior surface; and a rear wall comprising a rear exterior surface; and a biasing member operably coupled with the main body and configured to bias the pivoting head into the home position, wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

IF. The shaving razor handle of Paragraph IE wherein:

the lower width is between about 3 mm and about 8 mm; and the upper width is between about 1 mm and about 6 mm.

IG. The shaving razor handle of Paragraph IF wherein:

the lower width is about 3.9 mm; and the upper width is about 3.4 mm.

IH. The shaving razor handle of Paragraph IE wherein the front wall and the rear wall are angled with respect to each other and define a pair of V-shaped grooves and each of the arms extends between of the V-shaped grooves and are configured to travel within the V-shaped grooves when the pivoting head is pivoted.

II. The shaving razor handle of Paragraph IE further comprising a head portion that extends upwardly from the front wall and the rear wall and comprises a face surface.

IJ. The shaving razor handle of Paragraph II wherein the face surface defines an aperture.

IK. The shaving razor handle of Paragraph IJ further comprising a fluid reservoir, wherein the aperture is in fluid communication with the fluid reservoir.

IL. The shaving razor handle of Paragraph II wherein the head portion is formed at least partially of a conductive material.

IM. The shaving razor handle of Paragraph IL wherein the conductive material is in electrical communication with a heating controller.

IN. The shaving razor handle of Paragraph II wherein the head portion comprises a lip surface that is non-coplanar with the front exterior surface.

IO. A shaving handle comprising:

a main body;

a first arm extending from the main body and comprising a first pin;

a second arm extending from the main body and comprising a second pin, the first pin and the second pin defining a pivot axis;

a pivoting head that extends between an upper end and a lower end, the pivoting head comprising:

a base member pivotally coupled with the first pin and the second pin to facilitate pivoting of the pivoting head about the pivot axis between a home position and a fully pivoted position, the base member comprising:

a front wall comprising a front exterior surface; and a rear wall comprising a rear exterior surface, a central portion, a first tab member and a second tab member, each of the first tab member and the second tab member being disposed at opposite ends of the central portion and protruding longitudinally relative to the central portion; and a biasing member operably coupled with the main body and configured to bias the pivoting head into the home position, wherein:

the first pin is disposed in the first tab member; and the second pin is disposed in the second tab member.

IP. The shaving razor handle of Paragraph IO wherein:

the central portion of the rear wall comprises a first thickness;

the first tab member comprises a second thickness; and the first thickness is greater than the second thickness.

IQ. The shaving razor handle of Paragraph IP wherein a ratio of the first thickness to the second thickness is between about 3:1 and about 3:2.

IR. The shaving razor handle of Paragraph IQ wherein the first thickness is between about 0.75 mm and about 3 mm and the second thickness is between about 0.5 mm and about 1 mm.

IS. The shaving razor handle of Paragraph IR wherein the first thickness is about 1 mm and the second thickness is about 0.75 mm.

IT. The shaving razor handle of Paragraph IP wherein the second tab member comprises a third thickness and the second thickness and the third thickness are substantially the same.

IU. The shaving razor handle of Paragraph IO wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

IV. The shaving razor handle of Paragraph IU wherein:

the lower length is between about 25 mm and about 55 mm; and the upper length is between about 20 mm and about 40 mm.

IW. The shaving razor handle of Paragraph IV wherein:

the lower length is about 35 mm; and the upper length is about 30 mm.

IX. The shaving razor handle of Paragraph IO wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

IY. The shaving razor handle of Paragraph IX wherein:

the lower width is between about 3 mm and about 8 mm; and the upper width is between about 1 mm and about 6 mm.

IZ. The shaving razor handle of Paragraph IY wherein:

the lower width is about 3.9 mm; and the upper width is about 3.4 mm.

JA. A shaving handle comprising:

a main body;

a first arm extending from the main body;

a second arm extending from the main body;

a pivoting head that extends between an upper end and a lower end, the pivoting head comprising:

a base member pivotally coupled with the first arm and the second arm to facilitate pivoting of the pivoting head about a pivot axis between a home position and a fully pivoted position, the base member comprising:

a front wall comprising a front exterior surface; and a rear wall comprising a rear exterior surface, a central portion, a first tab member and a second tab member, each of the first tab member and the second tab member being disposed at opposite ends of the central portion; and a biasing member operably coupled with the main body and configured to bias the pivoting head into the home position, wherein:

the central portion of the rear wall comprises a first thickness;

the first tab member comprises a second thickness; and the first thickness is greater than the second thickness.

JB. The shaving razor handle of Paragraph JA wherein a ratio of the first thickness to the second thickness is between about 3:1 and about 3:2.

JC. The shaving razor handle of Paragraph JB wherein the first thickness is between about 0.75 mm and about 3 mm and the second thickness is between about 0.5 mm and about 1 mm.

JD. The shaving razor handle of Paragraph JC wherein the first thickness is about 1 mm and the second thickness is about 0.75 mm.

JE. The shaving razor handle of Paragraph JA wherein the second tab member comprises a third thickness and the second thickness and the third thickness are substantially the same.

JF. The shaving razor handle of Paragraph JA wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

JG. The shaving razor handle of Paragraph JF wherein:

the lower length is between about 25 mm and about 55 mm; and the upper length is between about 20 mm and about 40 mm.

JH. The shaving razor handle of Paragraph JG wherein:

the lower length is about 35 mm; and the upper length is about 30 mm.

JI. The shaving razor handle of Paragraph JA wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

JJ. The shaving razor handle of Paragraph JI wherein:

the lower width is between about 3 mm and about 8 mm; and the upper width is between about 1 mm and about 6 mm.

JK. The shaving razor handle of Paragraph JJ wherein:

the lower width is about 3.9 mm; and the upper width is about 3.4 mm.

JL. A shaving handle comprising:
a main body;
a pair of arms extending from the main body;
a pivoting head that extends between an upper end and a lower end, the pivoting head comprising:
a base member pivotally coupled with the pair of arms to facilitate pivoting of the pivoting head about a pivot axis between a home position and a fully pivoted position, the base member comprising:
a front wall comprising a front exterior surface;
a rear wall comprising a rear exterior surface; and
a head portion that extends upwardly from the front wall and the rear wall and comprises an exterior lip surface and a face surface;
a biasing member operably coupled with the main body and configured to bias the pivoting head into the home position; and
a pair of shoulder portions that extend laterally between the front wall, the rear wall, and the head portion and are each disposed on opposite sides of the head portion, wherein each of the shoulder portions comprises a shoulder surface that interfaces with a portion of each of the front exterior surface, the rear exterior surface, and the exterior lip surface.

JM. The shaving razor handle of Paragraph JL wherein the face surface defines an aperture.

JN. The shaving razor handle of Paragraph JM further comprising a fluid reservoir, wherein the aperture is in fluid communication with the fluid reservoir.

JO. The shaving razor handle of Paragraph JL wherein the head portion is formed at least partially of a conductive material.

JP. The shaving razor handle of Paragraph JO wherein the conductive material is in electrical communication with a heating controller.

JQ. The shaving razor handle of Paragraph JP wherein the exterior lip surface is non-coplanar with the front exterior surface.

JR. The shaving razor handle of Paragraph JL wherein the head portion comprises a first vertical height measured from the shoulder surfaces that is between about 0.5 mm and about 2 mm.

JS. The shaving razor handle of Paragraph JR wherein the first vertical height is about 0.9 mm.

JT. The shaving razor handle of Paragraph JS wherein the front wall comprises a second vertical height that is between about 1.5 mm and about 5 mm.

JU. The shaving razor handle of Paragraph JT wherein the second vertical height is about 3.1 mm.

JV. The shaving razor handle of Paragraph JU wherein the rear wall comprises a third vertical height that is between about 5.5 mm and about 12 mm.

JW. The shaving razor handle of Paragraph JV wherein the third vertical height is about 8 mm.

JX. The shaving razor handle of Paragraph JL wherein:
the pivoting head comprises a lower length at the lower end that extends laterally and is defined by the front wall and the rear wall;
the pivoting head comprises an upper length at the upper end that extends laterally and is defined by the front wall and the rear wall; and
the lower length of the pivoting head at the lower end is longer than the upper length of the pivoting head at the upper end.

JY. The shaving razor handle of Paragraph JX wherein:
the lower length is between about 25 mm and about 55 mm; and
the upper length is between about 20 mm and about 40 mm.

JZ. The shaving razor handle of Paragraph JY wherein:
the lower length is about 35 mm; and
the upper length is about 30 mm.

KA. The shaving razor handle of Paragraph JL wherein:
the pivoting head comprises a lower width at the lower end that extends longitudinally and is defined by the front wall and the rear wall;
the pivoting head comprises an upper width at the upper end that extends longitudinally and is defined by the front wall and the rear wall; and
the lower width of the pivoting head at the lower end is wider than the upper width of the pivoting head at the upper end.

KB. The shaving razor handle of Paragraph KA wherein:
the lower width is between about 3 mm and about 8 mm; and
the upper width is between about 1 mm and about 6 mm.

KC. The shaving razor handle of Paragraph KB wherein:
the lower width is about 3.9 mm; and
the upper width is about 3.4 mm.

KD. A shaving handle comprising:
a main body;
a pair of arms extending from the main body;
a pivoting head that extends between an upper end and a lower end, the pivoting head comprising:
a base member pivotally coupled with the pair of arms to facilitate pivoting of the pivoting head about a pivot axis between a home position and a fully pivoted position, the base member comprising:
a front wall;
a rear wall; and
a head portion that extends upwardly from the front wall and the rear wall and comprises an exterior lip surface and a face surface;
a biasing member operably coupled with the main body and configured to bias the pivoting head into the home position, wherein:
the exterior lip surface is non-coplanar with the front exterior surface; and
the head portion comprises a first vertical height that is between about 0.5 mm and about 2 mm.

KE. The shaving razor handle of Paragraph KD wherein the first vertical height is about 0.9 mm.

KF. The shaving razor handle of Paragraph KE wherein the front wall comprises a second vertical height that is between about 1.5 mm and about 5 mm.

KG. The shaving razor handle of Paragraph KF wherein the second vertical height is about 3.1 mm.

KH. The shaving razor handle of Paragraph KG wherein the rear wall comprises a third vertical height that is between about 5.5 mm and about 12 mm.

KI. The shaving razor handle of Paragraph KH wherein the third vertical height is about 8 mm.

KJ. The shaving razor handle of Paragraph KD wherein:
the pivoting head comprises a lower length at the lower end that extends laterally and is defined by the front wall and the rear wall;
the pivoting head comprises an upper length at the upper end that extends laterally and is defined by the front wall and the rear wall; and
the lower length of the pivoting head at the lower end is longer than the upper length of the pivoting head at the upper end.

KK. The shaving razor handle of Paragraph KJ wherein:
the lower length is between about 25 mm and about 55 mm; and
the upper length is between about 20 mm and about 40 mm.

KL. The shaving razor handle of Paragraph KK wherein:
the lower length is about 35 mm; and
the upper length is about 30 mm.

KM. The shaving razor handle of Paragraph KD wherein:
the pivoting head comprises a lower width at the lower end that extends longitudinally and is defined by the front wall and the rear wall;
the pivoting head comprises an upper width at the upper end that extends longitudinally and is defined by the front wall and the rear wall; and
the lower width of the pivoting head at the lower end is wider than the upper width of the pivoting head at the upper end.

KN. The shaving razor handle of Paragraph KM wherein:
the lower width is between about 3 mm and about 8 mm; and
the upper width is between about 1 mm and about 6 mm.

KO. The shaving razor handle of Paragraph KN wherein:
the lower width is about 3.9 mm; and
the upper width is about 3.4 mm.

KP. The shaving razor handle of Paragraph KD wherein the front wall and the rear wall are angled with respect to each other and define a pair of V-shaped grooves and each of the arms extends between of the V-shaped grooves and are configured to travel within the V-shaped grooves when the pivoting head is pivoted.

KQ. The shaving razor handle of Paragraph KD wherein the face surface defines an aperture.

KR. The shaving razor handle of Paragraph KQ further comprising a fluid reservoir, wherein the aperture is in fluid communication with the fluid reservoir.

KS. The shaving razor handle of Paragraph KD wherein the head portion is formed at least partially of a conductive material.

KT. The shaving razor handle of Paragraph KS wherein the conductive material is in electrical communication with a heating controller.

KU. A shaving handle comprising:
a main body;
a pair of arms extending from the main body;
a pivoting head that extends between an upper end and a lower end, the pivoting head comprising:
a base member pivotally coupled with the pair of arms to facilitate pivoting of the pivoting head about a pivot axis between a home position and a fully pivoted position, the base member comprising:
a front wall comprising a first vertical height; and
a rear wall comprising a second vertical height;
a biasing member operably coupled with the main body and configured to bias the pivoting head into the home position, wherein the first vertical height is less than the second vertical height.

KV. The shaving razor handle of Paragraph KU wherein the front wall and the rear wall are angled with respect to each other and define a pair of V-shaped grooves and each of the arms extends between of the V-shaped grooves and are configured to travel within the V-shaped grooves when the pivoting head is pivoted.

KW. The shaving razor handle of Paragraph KU wherein the first vertical height is between about 1.5 mm and about 5 mm.

KX. The shaving razor handle of Paragraph KW wherein the first vertical height is about 3.1 mm.

KY. The shaving razor handle of Paragraph KX wherein the second vertical height is between about 5.5 mm and about 12 mm.

KZ. The shaving razor handle of Paragraph KY wherein the third vertical height is about 8 mm.

LA. The shaving razor handle of Paragraph KU wherein:
the pivoting head comprises a lower length at the lower end that extends laterally and is defined by the front wall and the rear wall;
the pivoting head comprises an upper length at the upper end that extends laterally and is defined by the front wall and the rear wall; and
the lower length of the pivoting head at the lower end is longer than the upper length of the pivoting head at the upper end.

LB. The shaving razor handle of Paragraph LA wherein:
the lower length is between about 25 mm and about 55 mm; and
the upper length is between about 20 mm and about 40 mm.

LC. The shaving razor handle of Paragraph LB wherein:
the lower length is about 35 mm; and
the upper length is about 30 mm.

LD. The shaving razor handle of Paragraph KU wherein:
the pivoting head comprises a lower width at the lower end that extends longitudinally and is defined by the front wall and the rear wall;
the pivoting head comprises an upper width at the upper end that extends longitudinally and is defined by the front wall and the rear wall; and
the lower width of the pivoting head at the lower end is wider than the upper width of the pivoting head at the upper end.

LE. The shaving razor handle of Paragraph LD wherein:
the lower width is between about 3 mm and about 8 mm; and
the upper width is between about 1 mm and about 6 mm.

LF. The shaving razor handle of Paragraph LE wherein:
the lower width is about 3.9 mm; and
the upper width is about 3.4 mm.

LG. The shaving razor handle of Paragraph KU wherein the front wall and the rear wall are angled with respect to each other and define a pair of V-shaped grooves and each of the arms extends between of the V-shaped grooves and are configured to travel within the V-shaped grooves when the pivoting head is pivoted.

LH. The shaving razor handle of Paragraph KU wherein the face surface defines an aperture.

LI. The shaving razor handle of Paragraph LH further comprising a fluid reservoir, wherein the aperture is in fluid communication with the fluid reservoir.

LJ. The shaving razor handle of Paragraph KU wherein the head portion is formed at least partially of a conductive material.

LK. The shaving razor handle of Paragraph U wherein the conductive material is in electrical communication with a heating controller.

LL. A shaving system comprising:
a shaving razor cartridge comprising:
a housing that extends between a front end and a rear end, the housing comprising:
a blade support portion positioned between the front end and the rear end and comprising:
a cap; and a guard spaced from the cap and cooperating with the cap to define a shaving plane; and a handle interface portion positioned between the front end and the rear end and comprising:

a front wall comprising a lower surface and an interior surface, the interior surface extending along a front plane; and a rear wall comprising a lower surface and an interior surface, the interior surface extending along a rear plane; and at least one razor blade disposed in the blade support portion between the cap and the guard, wherein:

the lower surfaces cooperate to define a lower opening;

the front wall and the rear wall are spaced from each other such that the interior surfaces cooperate to at least partially define a handle receptacle that extends to the lower opening;

the rear wall is more proximate to the blade support portion than the front wall; and the front plane and the rear plane intersect at a first included angle; and a shaving handle comprising:

a main body;

a pair of arms extending from the main body;

a pivoting head configured for selective insertion into the handle receptacle, the pivoting head comprising:

a base member pivotally coupled with the pair of arms to facilitate pivoting of the pivoting head about a pivot axis between a home position and a fully pivoted position, the base member comprising:

a front wall comprising a front exterior surface that extends along a front plane; and a rear wall comprising a rear exterior surface that extends along a rear plane; and a biasing member operably coupled with the main body and configured to bias the pivoting head into the home position, wherein the front plane and the rear plane intersect at a second included angle.

LM. The shaving system of Paragraph LL wherein the first and second included angles are each between about 30 degrees and about 70 degrees.

LN. The shaving system of Paragraph LM wherein the first and second included angles are each between about 45 degrees and about 48 degrees.

LO. The shaving system of Paragraph LL wherein the front wall and the rear wall of the handle are angled with respect to each other and define a pair of V-shaped grooves and each of the arms extends between of the V-shaped grooves and are configured to travel within the V-shaped grooves when the pivoting head is pivoted.

LP. A shaving system comprising a shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface; and an upper surface that defines an upper opening; and at least one razor blade disposed in the blade support portion between the cap and the guard, the at least one razor blade extending laterally between opposing sides of the blade support portion, wherein:

the lower surfaces cooperate to define a lower opening;

the front wall and the rear wall are spaced from each other such that the interior surfaces cooperate to at least partially define a handle receptacle that extends between the upper opening and the lower opening;

the upper opening is more proximate to the shaving plane than the lower opening;

the lower opening has a first length that extends laterally along the handle interface portion;

the upper opening has a second length that extends laterally along the handle interface portion; and the first length is greater than the second length; and a handle comprising:

a main body;

a pair of arms extending from the main body;

a pivoting head that extends between an upper end and a lower end, the pivoting head being configured for selective installation within the handle receptacle of the cartridge, the pivoting head comprising:

a base member pivotally coupled with the pair of arms to facilitate pivoting of the pivoting head about a pivot axis between a home position and a fully pivoted position, the base member comprising:

a front wall comprising a front exterior surface; and a rear wall comprising a rear exterior surface; and a biasing member operably coupled with the main body and configured to bias the pivoting head into the home position, wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

LQ. The shaving system of Paragraph LP wherein:

the lower length is between about 25 mm and about 55 mm; and the upper length is between about 20 mm and about 40 mm.

LR. The shaving system of Paragraph LQ wherein:

the lower length is about 35 mm; and the upper length is about 30 mm.

LS. The shaving system of Paragraph LP wherein the front wall and the rear wall of the pivoting head are angled with respect to each other and define a pair of V-shaped grooves and each of the arms extends between of the V-shaped grooves and are configured to travel within the V-shaped grooves when the pivoting head is pivoted.

LT. The shaving system of Paragraph LP wherein the pivoting head further comprising a head portion that extends upwardly from the front wall and the rear wall of the pivoting head and is configured to extend into the upper opening when the pivoting member is installed in the handle receptacle and wherein the head portion comprises a face surface.

LU. The shaving system of Paragraph LT wherein the face surface defines an aperture.

LV. The shaving system of Paragraph LU further comprising a fluid reservoir, wherein the aperture is in fluid communication with the fluid reservoir.

LW. The shaving system of Paragraph LT wherein the head portion is formed at least partially of a conductive material.

LX. The shaving system of Paragraph LW wherein the conductive material is in electrical communication with a heating controller.

LY. A shaving system comprising:

a shaving razor cartridge comprising:

a housing that extends between a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising a lower surface, a central portion, a first distal portion, and a second distal portion; and at least one razor blade disposed in the blade support portion between the cap and the guard, wherein:

each of the first distal portion and the second distal portion extends from the central portion and defines a notch;

the central portion and each of the first distal portion and the second distal portion comprise respective interior surfaces;

the lower surfaces cooperate to define a lower opening;

the front wall and the rear wall are spaced from each other such that the interior surfaces cooperate to at least partially define a handle receptacle that extends to the lower opening; and a shaving handle comprising:

a main body;

a first arm extending from the main body and comprising a first pin;

a second arm extending from the main body and comprising a second pin, the first pin and the second pin defining a pivot axis;

a pivoting head that extends between an upper end and a lower end, the pivoting head being configured for selective installation in the handle receptacle, the pivoting head comprising:

a base member pivotally coupled with the first pin and the second pin to facilitate pivoting of the pivoting head about the pivot axis between a home position and a fully pivoted position, the base member comprising:

a front wall comprising a front exterior surface; and a rear wall comprising a rear exterior surface, a central portion, a first tab member and a second tab member, each of the first tab member and the second tab member being disposed at opposite ends of the central portion and protruding longitudinally relative to the central portion; and a biasing member operably coupled with the main body and configured to bias the pivoting head into the home position, wherein:

the first pin is disposed in the first tab member;

the second pin is disposed in the second tab member, and when the pivoting head is installed in the handle receptacle, the first tab member and the second tab member extend into respective ones of the notches.

LZ. The shaving system handle of Paragraph LY wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

PA. The shaving system handle of Paragraph LZ wherein:

the lower length is between about 25 mm and about 55 mm; and the upper length is between about 20 mm and about 40 mm.

PB. The shaving system handle of Paragraph PA wherein:

the lower length is about 35 mm; and the upper length is about 30 mm.

PC. The shaving system handle of Paragraph LY wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

PD. The shaving system handle of Paragraph PC wherein:

the lower width is between about 3 mm and about 8 mm; and the upper width is between about 1 mm and about 6 mm.

PE. The shaving system handle of Paragraph PD wherein:

the lower width is about 3.9 mm; and the upper width is about 3.4 mm.

PF. A shaving system comprising:

a shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface;

a first sidewall extending between the front wall and the rear wall and comprising a lower surface and an interior surface;

a second sidewall extending between the front wall and the rear wall and comprising a lower surface and an interior surface;

an upper surface defining an upper opening; and a first shoulder portion comprising a first interior shoulder surface and extending laterally from at least one of the front wall, the rear wall, and the first sidewall such that the interior surface of each of the front wall, the rear wall, and the first sidewall from which the first shoulder portion extends meets with the first interior shoulder surface at a first interface; and at least one razor blade disposed in the blade support portion between the cap and the guard, wherein:

the lower surfaces cooperate to define a lower opening;

the first sidewall and the second sidewall are spaced from each other and the front wall and the rear wall are spaced from each other such that the respective interior surfaces of the front wall, the rear wall, the first sidewall and the second sidewall cooperate to define a handle receptacle that extends between the upper opening and the lower opening;

the front wall, the rear wall, the first sidewall, and the second sidewall cooperate to define a first perimeter that extends along the first interface;

the first shoulder portion extends to the upper surface;

the upper opening defines a second perimeter; and the first perimeter is greater than the second perimeter; and a shaving handle comprising:

a main body;

a pair of arms extending from the main body;

a pivoting head that extends between an upper end and a lower end, the pivoting head being configured for selective installation within the handle receptacle, the pivoting head comprising:

a base member pivotally coupled with the pair of arms to facilitate pivoting of the pivoting head about a pivot axis between a home position and a fully pivoted position, the base member comprising:

a front wall comprising a front exterior surface;

a rear wall comprising a rear exterior surface; and a head portion that extends upwardly from the front wall and the rear wall and comprises an exterior lip surface and a face surface;

a biasing member operably coupled with the main body and configured to bias the pivoting head into the home position; and a pair of shoulder portions that extend laterally between the front wall, the rear wall, and the head portion and are each disposed on opposite sides of the head portion, wherein each of the shoulder portions comprises a shoulder surface that interfaces with a portion of each of the front exterior surface, the rear exterior surface, and the exterior lip surface and wherein the first and second shoulder portions of the pivoting head interface with the shoulder portions of the pivoting head when the pivoting head is installed in the handle receptacle.

PG. The shaving system of Paragraph PF wherein the face surface defines an aperture.

PH. The shaving system of Paragraph PG further comprising a fluid reservoir, wherein the aperture is in fluid communication with the fluid reservoir.

PI. The shaving system of Paragraph PF wherein the head portion is formed at least partially of a conductive material.

PJ. The shaving system of Paragraph PI wherein the conductive material is in electrical communication with a heating controller.

PK. The shaving system of Paragraph PJ wherein the exterior lip surface is non-coplanar with the front exterior surface.

PL. The shaving system of Paragraph PF wherein the head portion comprises a first vertical height measured from the shoulder surfaces that is between about 0.5 mm and about 2 mm.

PM. The shaving system of Paragraph PL wherein the first vertical height is about 0.9 mm.

PN. The shaving system of Paragraph PM wherein the front wall comprises a second vertical height that is between about 1.5 mm and about 5 mm.

PO. The shaving system of Paragraph PN wherein the second vertical height is about 3.1 mm.

PP. The shaving system of Paragraph PO wherein the rear wall comprises a third vertical height that is between about 5.5 mm and about 12 mm.

PQ. The shaving system of Paragraph PP wherein the third vertical height is about 8 mm.

PR. The shaving system of Paragraph PF wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

PS. The shaving system of Paragraph PR wherein:

the lower length is between about 25 mm and about 55 mm; and the upper length is between about 20 mm and about 40 mm.

PT. The shaving system of Paragraph PS wherein:

the lower length is about 35 mm; and the upper length is about 30 mm.

PU. The shaving system of Paragraph PF wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

PV. The shaving system of Paragraph PU wherein:

the lower width is between about 3 mm and about 8 mm; and the upper width is between about 1 mm and about 6 mm.

PW. The shaving system of Paragraph PV wherein:

the lower width is about 3.9 mm; and the upper width is about 3.4 mm.

PX. A shaving system comprising:

a shaving razor cartridge comprising:

a housing that extends between a front end and a rear end, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface;

a rear wall comprising a lower surface and an interior surface;

a first sidewall extending between the front wall and the rear wall and comprising a lower surface and an interior surface;

a second sidewall extending between the front wall and the rear wall and comprising a lower surface and an interior surface;

an upper surface defining an upper opening; and a first shoulder portion comprising a first interior shoulder surface and extending laterally from at least one of the front wall, the rear wall, and the first sidewall such that the interior surface of each of the front wall, the rear wall, and the first sidewall from which the first shoulder portion extends meets with the first interior shoulder surface at a first interface; and at least one razor blade disposed in the blade support portion between the cap and the guard, wherein:

the lower surfaces cooperate to define a lower opening;

the first sidewall and the second sidewall are spaced from each other and the front wall and the rear wall are spaced from each other such that the respective interior surfaces of the front wall, the rear wall, the first sidewall and the second sidewall cooperate to define a handle receptacle that extends between the upper opening and the lower opening;

the first shoulder portion extends to the upper surface; and the first shoulder surface is spaced from the upper surface by a first vertical distance; and a shaving handle comprising:

a main body;

a pair of arms extending from the main body;

a pivoting head that extends between an upper end and a lower end, the pivoting head comprising:

a base member pivotally coupled with the pair of arms to facilitate pivoting of the pivoting head about a pivot axis between a home position and a fully pivoted position, the base member comprising:

a front wall;

a rear wall; and a head portion that extends upwardly from the front wall and the rear wall and comprises an exterior lip surface and a face surface;

a biasing member operably coupled with the main body and configured to bias the pivoting head into the home position, wherein:

the exterior lip surface is non-coplanar with the front exterior surface; and the head portion comprises a first vertical height that is greater than the first vertical distance.

PY. The shaving system of Paragraph PX wherein the first vertical height between about 0.5 mm and about 2 mm.

PZ. The shaving system of Paragraph PY wherein the front wall comprises a second vertical height that is between about 1.5 mm and about 5 mm.

QA. The shaving system of Paragraph PZ wherein the second vertical height is about 3.1 mm.

QB. The shaving system of Paragraph QA wherein the rear wall comprises a third vertical height that is between about 5.5 mm and about 12 mm.

QC. The shaving system of Paragraph QB wherein the third vertical height is about 8 mm.

QD. The shaving system of Paragraph PX wherein:

the pivoting head comprises a lower length at the lower end that extends laterally and is defined by the front wall and the rear wall;

the pivoting head comprises an upper length at the upper end that extends laterally and is defined by the front wall and the rear wall; and the lower length of the pivoting head at the lower end is longer than the upper length of the pivoting head at the upper end.

QE. The shaving system of Paragraph QD wherein:

the lower length is between about 25 mm and about 55 mm; and the upper length is between about 20 mm and about 40 mm.

QF. The shaving system of Paragraph QE wherein:

the lower length is about 35 mm; and the upper length is about 30 mm.

QG. The shaving system of Paragraph PX wherein:

the pivoting head comprises a lower width at the lower end that extends longitudinally and is defined by the front wall and the rear wall;

the pivoting head comprises an upper width at the upper end that extends longitudinally and is defined by the front wall and the rear wall; and the lower width of the pivoting head at the lower end is wider than the upper width of the pivoting head at the upper end.

QH. The shaving system of Paragraph QG wherein:

the lower width is between about 3 mm and about 8 mm; and the upper width is between about 1 mm and about 6 mm.

QI. The shaving system of Paragraph QH wherein:

the lower width is about 3.9 mm; and the upper width is about 3.4 mm.

QJ. The shaving system of Paragraph PX wherein the front wall and the rear wall are angled with respect to each other and define a pair of V-shaped grooves and each of the arms extends between of the V-shaped grooves and are configured to travel within the V-shaped grooves when the pivoting head is pivoted.

QK. The shaving system of Paragraph PX wherein the face surface defines an aperture.

QL. The shaving system of Paragraph QK further comprising a fluid reservoir, wherein the aperture is in fluid communication with the fluid reservoir.

QM. The shaving system of Paragraph PX wherein the head portion is formed at least partially of a conductive material.

QN. The shaving system of Paragraph QM wherein the conductive material is in electrical communication with a heating controller.

The dimensions (e.g., the length, widths, heights, and distances) and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising a lower surface, a central portion, a first distal portion, and a second distal portion; and at least one razor blade disposed in the blade support portion between the cap and the guard, the at least one razor blade extending between opposing sides of the blade support portion, wherein:

each of the first distal portion and the second distal portion extends from the central portion;

the central portion, the first distal portion, and the second distal portion comprise respective interior surfaces;

the lower surfaces cooperate to define a lower opening;

the front wall and the rear wall are spaced from each other such that the interior surfaces cooperate to at least partially define a handle receptacle that extends to the lower opening;

the interior surface of the central portion is spaced horizontally from the front wall by a first distance;

the interior surface of the first distal portion is spaced horizontally from the front wall by a second distance; and the first distance is less than the second distance.

2. The shaving razor cartridge of claim 1 wherein the first distance is between 2 mm and 5 mm and the second distance is between 2.5 mm and 5.5 mm.

3. The shaving razor cartridge of claim 1 the interior surface of the second distal portion is spaced horizontally from the front wall by a third distance that is substantially equal to the second distance.

4. The shaving razor cartridge of claim 1 wherein:

the handle interface portion comprises an upper surface that defines an upper opening;

the handle receptacle extends to the upper opening; and the upper opening is more proximate to the shaving plane than the lower opening.

5. The shaving razor cartridge of claim 4 wherein the upper surface is spaced from the shaving plane.

6. The shaving razor cartridge of claim 1 wherein the respective interior surfaces of the first distal portion and the second distal portion extend substantially perpendicularly to the shaving plane and extend to the lower surface of the rear wall.

7. A shaving razor cartridge comprising:

a housing having a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising a lower surface, a central portion, a first distal portion, and a second distal portion; and at least one razor blade disposed in the blade support portion between the cap and the guard, wherein:

each of the first distal portion and the second distal portion extends from the central portion;

the central portion and each of the first distal portion and the second distal portion comprise respective interior surfaces;

the lower surfaces cooperate to define a lower opening;

the front wall and the rear wall are spaced from each other such that the interior surfaces cooperate to at least partially define a handle receptacle that extends to the lower opening;

the central portion of the rear wall comprises a first thickness;

the first distal portion of the rear wall comprises a second thickness; and the first thickness is greater than the second thickness.

8. The shaving razor cartridge of claim 7 wherein a ratio of the first thickness to the second thickness is between 3:1 and 3:2.

9. The shaving razor cartridge of claim 8 wherein the first thickness is between 0.75 mm and 3 mm and the second thickness is between 0.5 mm and 1 mm.

10. The shaving razor cartridge of claim 7 wherein the second distal portion of the rear wall comprises a third thickness and the second thickness and the third thickness are substantially the same.

11. The shaving razor cartridge of claim 7 wherein:

the handle interface portion comprises an upper surface that defines an upper opening;

the handle receptacle extends between the upper opening and the lower opening; and the upper opening is more proximate to the shaving plane than the lower opening.

12. The shaving razor cartridge of claim 11 wherein the upper surface is within a vertical distance of the shaving plane and the upper surface is disposed between the shaving plane and the lower surfaces.

13. The shaving razor cartridge of claim 12 wherein the vertical distance is less than 1 mm.

14. The shaving razor cartridge of claim 7 further comprising a locking member extending from the central portion of the rear wall towards the front wall, the locking member configured to facilitate selective retention of a handle to the housing.

15. The shaving razor cartridge of claim 14 wherein:

the blade support portion comprises a blade support member that supports the at least one razor blade; and the locking member comprises an upper surface that is generally vertically aligned with the blade support member.

16. The shaving razor cartridge of claim 14 wherein the locking member comprises a deflection member and at least one support arm, the deflection member coupled with the at least one support arm, and the at least one support arm coupled with the rear wall such that the deflection member is offset from the rear wall.

17. The shaving razor cartridge of claim 14 wherein the locking member comprises an upper surface and the upper surface of the locking member and the lower surface of the rear wall are spaced from each other and wherein the upper surface of the locking member and the lower surface of the rear wall cooperate to define a slot therebetween that is configured to receive at least a portion of the handle.

18. A shaving razor cartridge comprising:

a housing having a front end and a rear end and defines an overall width, the housing comprising:

a blade support portion positioned between the front end and the rear end and comprising:

a cap; and a guard spaced from the cap and cooperating with the cap to define a shaving plane; and a handle interface portion positioned between the front end and the rear end and comprising:

a front wall comprising a lower surface and an interior surface; and a rear wall comprising, a lower surface, a central portion, a first distal portion, and a second distal portion, the central portion, the first distal portion and the second distal portion each comprising respective interior surfaces; and at least one razor blade disposed in the blade support portion between the cap and the guard, wherein:

each of the first distal portion and the second distal portion extends from the central portion;

each of the first distal portion and the second distal portion defines a notch that is configured to receive a portion of a handle.

19. The shaving razor cartridge of claim 18 further comprising a locking member extending from the central portion of the rear wall towards the front wall, the locking member configured to facilitate selective retention of the handle to the housing.

20. The shaving razor cartridge of claim 19 wherein the locking member comprises an upper surface, and the upper surface of the locking member and the lower surface of the rear wall are spaced from each other and wherein the upper surface of the locking member and the lower surface of the rear wall cooperate to define a slot therebetween that is configured to receive at least a portion of the handle.

* * * * *